US007094739B2

(12) United States Patent
Kessler et al.

(10) Patent No.: US 7,094,739 B2
(45) Date of Patent: Aug. 22, 2006

(54) DISHWASHER MACHINE DETERGENTS WITH LOW VISCOSITY SURFACTANTS

(75) Inventors: Arnd Kessler, Leverkusen (DE); Christian Nitsch, Duesseldorf (DE); Rolf Bayersdoerfer, Duesseldorf (DE); Wolfgang Wick, Dormagen (DE); Sven Mueller, Dulsburg (DE); Peter Schmiedel, Duesseldorf (DE)

(73) Assignee: Henkel Kommandigesellschaft auf Aktien (Henkel KGaA), Duesseldorf (DE)

( * ) Notice: Subject to any disclaimer, the term of this patent is extended or adjusted under 35 U.S.C. 154(b) by 3 days.

(21) Appl. No.: 10/764,232

(22) Filed: Jan. 23, 2004

(65) Prior Publication Data

US 2004/0167051 A1 Aug. 26, 2004

Related U.S. Application Data

(63) Continuation of application No. PCT/EP02/07822, filed on Jul. 13, 2002.

(30) Foreign Application Priority Data

Jul. 25, 2001 (DE) ..... 101 36 001

(51) Int. Cl.

| | |
|---|---|
| ***C11D 1/722*** | (2006.01) |
| ***C11D 3/02*** | (2006.01) |
| ***C11D 3/37*** | (2006.01) |
| ***C11D 3/386*** | (2006.01) |
| ***C11D 3/395*** | (2006.01) |

(52) U.S. Cl. ..... 510/220; 510/226; 510/320; 510/360; 510/413; 510/421; 510/475; 510/531

(58) Field of Classification Search ..... 510/220, 510/226, 320, 360, 413, 421, 475, 531
See application file for complete search history.

(56) References Cited

U.S. PATENT DOCUMENTS

| | | | | |
|---|---|---|---|---|
| 3,504,041 | A | 3/1970 | Weipert et al. | |
| 3,625,901 | A | 12/1971 | Rue et al. | |
| 4,836,951 | A | 6/1989 | Totten et al. | |
| 5,110,503 | A | 5/1992 | Cohen | |
| 5,698,507 | A * | 12/1997 | Gorlin et al. | 510/223 |
| 6,013,613 | A * | 1/2000 | Scheper et al. | 510/220 |
| 6,680,286 | B1 * | 1/2004 | Kawaguchi et al. | 510/434 |
| 2004/0167049 | A1 * | 8/2004 | Kessler et al. | 510/220 |
| 2004/0167050 | A1 * | 8/2004 | Kessler et al. | 510/220 |
| 2004/0167051 | A1 * | 8/2004 | Kessler et al. | 510/220 |

FOREIGN PATENT DOCUMENTS

| | | |
|---|---|---|
| DE | 20 59 403 | 6/1971 |
| EP | 0 724 013 A1 | 7/1996 |
| EP | 1 050 576 A1 | 11/2000 |
| JP | 54-83912 | 7/1979 |
| WO | WO 00/50552 A1 | 8/2000 |

OTHER PUBLICATIONS

Database WPI, Section Ch, Week 197933, Derwent Publications Ltd., London, GB, AN 1979-60457B, XP002219264 of JP 54083912 (1979).

Fainerman et al., "Adsorption kinetics of octylphenyl ethers of poly(ethylene glycol)s on solution-air interface", *Colloids and Surfaces A*, 90, pp. 213-224 (1994).

* cited by examiner

*Primary Examiner*—Brian P. Mruk
(74) *Attorney, Agent, or Firm*—Glenn E.J. Murphy; John E. Drach

(57) ABSTRACT

Machine dishwashing detergents comprising builder(s), surfactant(s), and optionally further ingredients, and furthermore 0.1 to 50% by weight of one or more nonionic surfactants which, in 80% strength by weight solution in distilled water, have a viscosity (Brookfield, spindle 31, 30 rpm, 20° C.) of less than 450 mPas.

27 Claims, No Drawings

DISHWASHER MACHINE DETERGENTS WITH LOW VISCOSITY SURFACTANTS

CROSS REFERENCE TO RELATED APPLICATIONS

This application is a continuation under 35 U.S.C. § 365(c) and 35 U.C.S. § 120 of international application PCT/EP02/07822, filed on Jul. 13, 2002, the international application not being published in English. This application also claims priority under 35 U.S.C. § 119 of DE 101 36 001.0, filed Jul. 24, 2001, which is incorporated herein by reference in its entirety.

BACKGROUND OF THE INVENTION

The present invention relates to machine dishwashing detergents and methods of using these compositions. Specifically, the invention relates to machine dishwashing detergents which comprise nonionic surfactants which have particularly low viscosities in aqueous solution.

Machine dishwashing in domestic dishwashing machines is a process which differs fundamentally from laundry washing in domestic washing machines. Whereas in a washing machine the item to be washed is permanently agitated in the liquor and, in this way, the washing is mechanically assisted, in a dishwashing machine, the rinse liquor is applied by a spraying system to the surfaces to be cleaned. There, the cleaning liquor must itself counteract even stubborn soilings without assistance by mechanical influences. The performance level of machine dishwashing detergents must therefore be much higher than that of conventional textile detergents.

In addition, there is a trend in machine dishwashing toward ever lower temperatures, ever shorter rinse cycles, and a reduced dosing of detergents for ecological reasons, in some countries it also being necessary to observe restrictions with regard to the use of certain ingredients (for example phosphates).

The performance requirements of modern machine dishwashing detergents are continually increasing under the abovementioned framework conditions. As a result of these increased performance requirements, there is a continual need for performance-enhanced machine dishwashing detergents that achieve high cleaning performances at a lower concentration, also at lower temperatures and short wash times.

The object of the present invention was to provide machine dishwashing detergents which meet the increased performance requirements. The compositions to be provided should be superior to conventional compositions, even when compared at a lower concentration, in particular on greasy soilings. In addition, the compositions should be able to be prepared as conventional machine dishwashing detergents ("cleaners") in powder or granule form or as tablets or in pourable supply form, and also in the form of a combination product ("2in1" products which combine detergent and rinse aid, and also "3in1" products, which combine detergent, rinse aid and salt replacement).

It has now been found that machine dishwashing detergents that satisfy the profile of requirements given above can be provided if they comprise builders and certain nonionic surfactants, and also optionally further ingredients of cleaning compositions.

DESCRIPTION OF THE INVENTION

The present invention provides machine dishwashing detergents comprising builder(s), surfactant(s), and optionally further ingredients and furthermore 0.1 to 50% by weight of one or more nonionic surfactants which, in 80% strength by weight solution in distilled water, have a viscosity (Brookfield, spindle 31, 30 rpm, 20° C.) of less than 450 mPas.

The lower viscosity of the surfactant at high concentrations brings about a significantly improved solubility of the overall formulation. Without being bound to one fixed theory, it is understandable that the dissolution of a granule or of a tablet or of a drop of a liquid formulation, which in each case comprise large amounts of surfactant, proceeds more rapidly when the surfactant does not pass through gel phases or when even highly concentrated surfactant solutions (which are formed in the first moment upon ingress of water) are of such low viscosity that further dilution takes place rapidly and without problems.

In addition, the low viscosity of the surfactants used according to the invention in highly concentrated solutions further improves the energy efficiency during production. Thus, for example, lower pump outputs to convey the surfactant solutions, and lower stirrer capacities of the mixing tools to granulate the surfactant solution are required in order to achieve equally good distribution of the surfactants.

A further advantage of the compositions according to the invention is their better storage stability compared with compositions containing conventional surfactants. Despite the low viscosity of the surfactants, the formulation does not have a tendency to bleed or clump even during storage under high atmospheric humidity and/or temperature.

In preferred embodiments of the present invention, the surfactant in a highly concentrated aqueous solution has a yet lower viscosity. In this respect, preference is given to compositions according to the invention in which the nonionic surfactant(s), in 80% strength by weight solution in distilled water, have a viscosity (Brookfield, spindle 31, 30 rpm, 20° C.) of less than 400 mPas preferably of less than 300 mPas, particularly preferably of less than 250 mPas and in particular of less than 200 mPas.

Particularly preferred dishwasher machine detergents according to the invention comprise one or more nonionic surfactants which, in 80% strength by weight solution in distilled water, has/have a viscosity (Brookfield, spindle 31, 30 rpm, 20° C.) of less than 150 mPas. By way of example, mention may be made here of values of less than 145 mPas, less than 140 mPas, less than 135 mPas, less than 130 mPas, less than 125 mPas, less than 120 mPas, less than 115 mPas, less than 110 mPas, less than 105 mPas and even less than 100 mPas at the specified conditions (80% strength by weight solution in distilled water, Brookfield viscometer, spindle 31, 30 revolutions per minute, 20° C.).

It is particularly preferred if yet more highly concentrated solutions of the nonionic surfactants used have low or even lower viscosities. In this connection, particular preference is given to dishwasher machine detergents according to the invention which are characterized in that the nonionic surfactant(s), in 90% strength by weight solution in distilled water, have a viscosity (Brookfield, spindle 31, 30 rpm, 20° C.) of less than 250 mPas, preferably of less than 200 mPas, particularly preferably of less than 150 mPas and in particular of less than 100 mPas.

Irrespective of the viscosity of the surfactants present according to the invention in the compositions in aqueous solutions, it may be advantageous for certain formulations if the surfactants are liquid at room temperature. As well as the easier processability for compositions in the form of powders or granules, this has the additional advantage that the surfactants do not have to be melted during processing, as a result of which the production costs can be further reduced.

Nonionic surfactants which, in 80% strength by weight solution in distilled water, have a viscosity (Brookfield, spindle 31, 30 rpm, 20° C.) of less than 450 mPas can be of varying molecular structure. Depending on the nature and length of the hydrophobic and of the hydrophilic radical in the molecule, the properties of the surfactants can be controlled to give desirable properties.

The nonionic surfactants with the above-described properties are used in the compositions according to the invention in amounts of from 0.1 to 50% by weight, in each case based on the total composition. Preferred machine dishwashing detergents according to the invention comprise the nonionic surfactant(s) in amounts of from 0.5 to 40% by weight, preferably from 1 to 30% by weight, particularly preferably from 2.5 to 25% by weight and in particular from 5 to 20% by weight, in each case based on the total composition.

For the purposes of the present invention, particularly preferred nonionic surfactants have proven to be low-foam nonionic surfactants which have alternating ethylene oxide and alkylene oxide units. Of these, preference is in turn given to surfactants with EO-AO-EO-AO blocks, where in each case one to ten EO and/or AO groups are bonded to one another before a block from the other groups in each case follows. Preference is given here to machine dishwashing detergents according to the invention which comprise, as nonionic surfactant(s), surfactants of the general formula I $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H \quad (I)$$

in which $R^1$ is a straight-chain or branched, saturated or mono- or polyunsaturated $C_{6-24}$-alkyl or -alkenyl radical; each group $R^2$ and $R^3$, independently of one another, is chosen from $—CH_3$, $—CH_2CH_3$, $—CH_2CH_2—CH_3$, $CH(CH_3)_2$ and the indices w, x, y, z, independently of one another, are integers from 1 to 6.

The preferred nonionic surfactants of the formula I can be prepared by known methods from the corresponding alcohols $R^1$—OH and ethylene oxide or alkylene oxide. The radical $R^1$ in the above formula I can vary depending on the origin of the alcohol. If native sources are used, the radical $R^1$ has an even number of carbon atoms and is usually unbranched, where the linear radicals from alcohols of native origin having 12 to 18 carbon atoms, e.g. from coconut, palm, tallow fatty or oleyl alcohol, are preferred. Alcohols obtainable from synthetic sources are, for example, the Guerbet alcohols or radicals which are methyl-branched in the 2 position or linear and methyl-branched in the mixture, as are customarily present in oxo alcohol radicals. Irrespective of the nature of the alcohol used for the preparation of the nonionic surfactants present according to the invention in the compositions, preference is given to machine dishwashing detergents according to the invention in which $R^1$ in formula I is an alkyl radical having 6 to 24, preferably 8 to 20, particularly preferably 9 to 15 and in particular 9 to 11 carbon atoms.

A suitable alkylene oxide unit which is present in alternating manner relative to the ethylene oxide unit in the preferred nonionic surfactants is, in particular, butylene oxide, as well as propylene oxide. However, further alkylene oxides in which $R^2$ and $R^3$, independently of one another, are chosen from $—CH_2CH_2—CH_3$ and $CH(CH_3)_2$ are also suitable. Preferred machine dishwashing detergents are characterized in that $R^2$ and $R^3$ are a radical $—CH_3$, w and x, independently of one another, are values of 3 or 4 and y and z, independently of one another, are values of 1 or 2.

In summary, particular preference is given to using nonionic surfactants in the compositions according to the invention which have a $C_{9-15}$-alkyl radical having 1 to 4 ethylene oxide units, followed by 1 to 4 propylene oxide units, followed by 1 to 4 ethylene oxide units, followed by 1 to 4 propylene oxide units. These surfactants have the required low viscosity in aqueous solution and can be used particularly advantageously according to the invention.

The given carbon chain lengths and degrees of ethoxylation or degrees of alkoxylation are statistical average values which may be an integer or a fraction for a specific product. Due to the preparation process, commercial products of said formulae consist mostly not of an individual representative, but of mixtures, giving rise to average values and consequently fractional values both for the carbon chain lengths and also for the degrees of ethoxylation or degrees of alkoxylation. In the table below, nonionic surfactants which are particularly preferably present in the compositions according to the invention are characterized with regard to the radical $R^1$, the radicals $R^2$ and $R^3$, and the indices w, x, y and z. Preferred compositions according to the invention comprise one or more surfactants from the table below or mixtures thereof.

| No. | $R^1$ | $R^2$ | $R^3$ | w | x | y | z |
|---|---|---|---|---|---|---|---|
| 1 | $CH_3—(CH_2)_8—$ | $CH_3—$ | $CH_3—$ | 1 | 1 | 1 | 1 |
| 2 | $CH_3—(CH_2)_8—$ | $CH_3—$ | $CH_3—$ | 2 | 1 | 1 | 1 |
| 3 | $CH_3—(CH_2)_8—$ | $CH_3—$ | $CH_3—$ | 1 | 2 | 1 | 1 |
| 4 | $CH_3—(CH_2)_8—$ | $CH_3—$ | $CH_3—$ | 1 | 1 | 2 | 1 |
| 5 | $CH_3—(CH_2)_8—$ | $CH_3—$ | $CH_3—$ | 1 | 1 | 1 | 2 |
| 6 | $CH_3—(CH_2)_8—$ | $CH_3—$ | $CH_3—$ | 3 | 1 | 1 | 1 |
| 7 | $CH_3—(CH_2)_8—$ | $CH_3—$ | $CH_3—$ | 1 | 3 | 1 | 1 |
| 8 | $CH_3—(CH_2)_8—$ | $CH_3—$ | $CH_3—$ | 1 | 1 | 3 | 1 |
| 9 | $CH_3—(CH_2)_8—$ | $CH_3—$ | $CH_3—$ | 1 | 1 | 1 | 3 |
| 10 | $CH_3—(CH_2)_8—$ | $CH_3—$ | $CH_3—$ | 4 | 1 | 1 | 1 |
| 11 | $CH_3—(CH_2)_8—$ | $CH_3—$ | $CH_3—$ | 1 | 4 | 1 | 1 |
| 12 | $CH_3—(CH_2)_8—$ | $CH_3—$ | $CH_3—$ | 1 | 1 | 4 | 1 |
| 13 | $CH_3—(CH_2)_8—$ | $CH_3—$ | $CH_3—$ | 1 | 1 | 1 | 4 |
| 14 | $CH_3—(CH_2)_8—$ | $CH_3—$ | $CH_3—$ | 1 | 2 | 2 | 1 |
| 15 | $CH_3—(CH_2)_8—$ | $CH_3—$ | $CH_3—$ | 1 | 2 | 1 | 2 |
| 16 | $CH_3—(CH_2)_8—$ | $CH_3—$ | $CH_3—$ | 1 | 1 | 2 | 2 |
| 17 | $CH_3—(CH_2)_8—$ | $CH_3—$ | $CH_3—$ | 2 | 2 | 1 | 1 |
| 18 | $CH_3—(CH_2)_8—$ | $CH_3—$ | $CH_3—$ | 2 | 1 | 2 | 1 |
| 19 | $CH_3—(CH_2)_8—$ | $CH_3—$ | $CH_3—$ | 2 | 1 | 1 | 2 |
| 20 | $CH_3—(CH_2)_8—$ | $CH_3—$ | $CH_3—$ | 1 | 3 | 3 | 1 |
| 21 | $CH_3—(CH_2)_8—$ | $CH_3—$ | $CH_3—$ | 1 | 3 | 1 | 3 |

-continued

| No. | $R^1$ | $R^2$ | $R^3$ | w | x | y | z |
|---|---|---|---|---|---|---|---|
| 22 | $CH_3$—$(CH_2)_8$— | $CH_3$— | $CH_3$— | 1 | 1 | 3 | 3 |
| 23 | $CH_3$—$(CH_2)_8$— | $CH_3$— | $CH_3$— | 3 | 3 | 1 | 1 |
| 24 | $CH_3$—$(CH_2)_8$— | $CH_3$— | $CH_3$— | 3 | 1 | 3 | 1 |
| 25 | $CH_3$—$(CH_2)_8$— | $CH_3$— | $CH_3$— | 3 | 1 | 1 | 3 |
| 26 | $CH_3$—$(CH_2)_8$— | $CH_3$— | $CH_3$— | 1 | 4 | 4 | 1 |
| 27 | $CH_3$—$(CH_2)_8$— | $CH_3$— | $CH_3$— | 1 | 4 | 1 | 4 |
| 28 | $CH_3$—$(CH_2)_8$— | $CH_3$— | $CH_3$— | 1 | 1 | 4 | 4 |
| 29 | $CH_3$—$(CH_2)_8$— | $CH_3$— | $CH_3$— | 4 | 4 | 1 | 1 |
| 30 | $CH_3$—$(CH_2)_8$— | $CH_3$— | $CH_3$— | 4 | 1 | 4 | 1 |
| 31 | $CH_3$—$(CH_2)_8$— | $CH_3$— | $CH_3$— | 4 | 1 | 1 | 4 |
| 32 | $CH_3$—$(CH_2)_8$— | $CH_3$— | $CH_3$— | 1 | 1 | 2 | 3 |
| 33 | $CH_3$—$(CH_2)_8$— | $CH_3$— | $CH_3$— | 1 | 1 | 3 | 2 |
| 34 | $CH_3$—$(CH_2)_8$— | $CH_3$— | $CH_3$— | 1 | 2 | 3 | 1 |
| 35 | $CH_3$—$(CH_2)_8$— | $CH_3$— | $CH_3$— | 1 | 3 | 2 | 1 |
| 36 | $CH_3$—$(CH_2)_8$— | $CH_3$— | $CH_3$— | 1 | 2 | 1 | 3 |
| 37 | $CH_3$—$(CH_2)_8$— | $CH_3$— | $CH_3$— | 1 | 3 | 1 | 2 |
| 38 | $CH_3$—$(CH_2)_8$— | $CH_3$— | $CH_3$— | 2 | 1 | 1 | 3 |
| 39 | $CH_3$—$(CH_2)_8$— | $CH_3$— | $CH_3$— | 2 | 1 | 3 | 1 |
| 40 | $CH_3$—$(CH_2)_8$— | $CH_3$— | $CH_3$— | 2 | 3 | 1 | 1 |
| 41 | $CH_3$—$(CH_2)_8$— | $CH_3$— | $CH_3$— | 3 | 1 | 1 | 2 |
| 42 | $CH_3$—$(CH_2)_8$— | $CH_3$— | $CH_3$— | 3 | 1 | 2 | 1 |
| 43 | $CH_3$—$(CH_2)_8$— | $CH_3$— | $CH_3$— | 3 | 2 | 1 | 1 |
| 44 | $CH_3$—$(CH_2)_8$— | $CH_3$— | $CH_3$— | 1 | 1 | 2 | 4 |
| 45 | $CH_3$—$(CH_2)_8$— | $CH_3$— | $CH_3$— | 1 | 1 | 4 | 2 |
| 46 | $CH_3$—$(CH_2)_8$— | $CH_3$— | $CH_3$— | 1 | 2 | 4 | 1 |
| 47 | $CH_3$—$(CH_2)_8$— | $CH_3$— | $CH_3$— | 1 | 4 | 2 | 1 |
| 48 | $CH_3$—$(CH_2)_8$— | $CH_3$— | $CH_3$— | 1 | 2 | 1 | 4 |
| 49 | $CH_3$—$(CH_2)_8$— | $CH_3$— | $CH_3$— | 1 | 4 | 1 | 2 |
| 50 | $CH_3$—$(CH_2)_8$— | $CH_3$— | $CH_3$— | 2 | 1 | 1 | 4 |
| 51 | $CH_3$—$(CH_2)_8$— | $CH_3$— | $CH_3$— | 2 | 1 | 4 | 1 |
| 52 | $CH_3$—$(CH_2)_8$— | $CH_3$— | $CH_3$— | 2 | 4 | 1 | 1 |
| 53 | $CH_3$—$(CH_2)_8$— | $CH_3$— | $CH_3$— | 4 | 1 | 1 | 2 |
| 54 | $CH_3$—$(CH_2)_8$— | $CH_3$— | $CH_3$— | 4 | 1 | 2 | 1 |
| 55 | $CH_3$—$(CH_2)_8$— | $CH_3$— | $CH_3$— | 4 | 2 | 1 | 1 |
| 56 | $CH_3$—$(CH_2)_8$— | $CH_3$— | $CH_3$— | 1 | 1 | 4 | 3 |
| 57 | $CH_3$—$(CH_2)_8$— | $CH_3$— | $CH_3$— | 1 | 1 | 3 | 4 |
| 58 | $CH_3$—$(CH_2)_8$— | $CH_3$— | $CH_3$— | 1 | 4 | 3 | 1 |
| 59 | $CH_3$—$(CH_2)_8$— | $CH_3$— | $CH_3$— | 1 | 3 | 4 | 1 |
| 60 | $CH_3$—$(CH_2)_8$— | $CH_3$— | $CH_3$— | 1 | 4 | 1 | 3 |
| 61 | $CH_3$—$(CH_2)_8$— | $CH_3$— | $CH_3$— | 1 | 3 | 1 | 4 |
| 62 | $CH_3$—$(CH_2)_8$— | $CH_3$— | $CH_3$— | 4 | 1 | 1 | 3 |
| 63 | $CH_3$—$(CH_2)_8$— | $CH_3$— | $CH_3$— | 4 | 1 | 3 | 1 |
| 64 | $CH_3$—$(CH_2)_8$— | $CH_3$— | $CH_3$— | 4 | 3 | 1 | 1 |
| 65 | $CH_3$—$(CH_2)_8$— | $CH_3$— | $CH_3$— | 3 | 1 | 1 | 4 |
| 66 | $CH_3$—$(CH_2)_8$— | $CH_3$— | $CH_3$— | 3 | 1 | 4 | 1 |
| 67 | $CH_3$—$(CH_2)_8$— | $CH_3$— | $CH_3$— | 3 | 4 | 1 | 1 |
| 68 | $CH_3$—$(CH_2)_8$— | $CH_3$— | $CH_3$— | 1 | 2 | 2 | 2 |
| 69 | $CH_3$—$(CH_2)_8$— | $CH_3$— | $CH_3$— | 2 | 1 | 2 | 2 |
| 70 | $CH_3$—$(CH_2)_8$— | $CH_3$— | $CH_3$— | 2 | 2 | 1 | 2 |
| 71 | $CH_3$—$(CH_2)_8$— | $CH_3$— | $CH_3$— | 2 | 2 | 2 | 1 |
| 72 | $CH_3$—$(CH_2)_8$— | $CH_3$— | $CH_3$— | 1 | 3 | 3 | 3 |
| 73 | $CH_3$—$(CH_2)_8$— | $CH_3$— | $CH_3$— | 3 | 1 | 3 | 3 |
| 74 | $CH_3$—$(CH_2)_8$— | $CH_3$— | $CH_3$— | 3 | 3 | 1 | 3 |
| 75 | $CH_3$—$(CH_2)_8$— | $CH_3$— | $CH_3$— | 3 | 3 | 3 | 1 |
| 76 | $CH_3$—$(CH_2)_8$— | $CH_3$— | $CH_3$— | 1 | 4 | 4 | 4 |
| 77 | $CH_3$—$(CH_2)_8$— | $CH_3$— | $CH_3$— | 4 | 1 | 4 | 4 |
| 78 | $CH_3$—$(CH_2)_8$— | $CH_3$— | $CH_3$— | 4 | 4 | 1 | 4 |
| 79 | $CH_3$—$(CH_2)_8$— | $CH_3$— | $CH_3$— | 4 | 4 | 4 | 1 |
| 80 | $CH_3$—$(CH_2)_8$— | $CH_3$— | $CH_3$— | 2 | 2 | 1 | 3 |
| 81 | $CH_3$—$(CH_2)_8$— | $CH_3$— | $CH_3$— | 2 | 2 | 3 | 1 |
| 82 | $CH_3$—$(CH_2)_8$— | $CH_3$— | $CH_3$— | 2 | 1 | 2 | 3 |
| 83 | $CH_3$—$(CH_2)_8$— | $CH_3$— | $CH_3$— | 2 | 3 | 2 | 1 |
| 84 | $CH_3$—$(CH_2)_8$— | $CH_3$— | $CH_3$— | 2 | 1 | 3 | 2 |
| 85 | $CH_3$—$(CH_2)_8$— | $CH_3$— | $CH_3$— | 2 | 3 | 1 | 2 |
| 86 | $CH_3$—$(CH_2)_8$— | $CH_3$— | $CH_3$— | 1 | 2 | 2 | 3 |
| 87 | $CH_3$—$(CH_2)_8$— | $CH_3$— | $CH_3$— | 1 | 2 | 3 | 2 |
| 88 | $CH_3$—$(CH_2)_8$— | $CH_3$— | $CH_3$— | 1 | 3 | 2 | 2 |
| 89 | $CH_3$—$(CH_2)_8$— | $CH_3$— | $CH_3$— | 3 | 2 | 2 | 1 |
| 90 | $CH_3$—$(CH_2)_8$— | $CH_3$— | $CH_3$— | 3 | 2 | 1 | 2 |
| 91 | $CH_3$—$(CH_2)_8$— | $CH_3$— | $CH_3$— | 3 | 1 | 2 | 2 |
| 92 | $CH_3$—$(CH_2)_8$— | $CH_3$— | $CH_3$— | 2 | 2 | 1 | 4 |
| 93 | $CH_3$—$(CH_2)_8$— | $CH_3$— | $CH_3$— | 2 | 2 | 4 | 1 |
| 94 | $CH_3$—$(CH_2)_8$— | $CH_3$— | $CH_3$— | 2 | 1 | 2 | 4 |
| 95 | $CH_3$—$(CH_2)_8$— | $CH_3$— | $CH_3$— | 2 | 4 | 2 | 1 |
| 96 | $CH_3$—$(CH_2)_8$— | $CH_3$— | $CH_3$— | 2 | 1 | 4 | 2 |
| 97 | $CH_3$—$(CH_2)_8$— | $CH_3$— | $CH_3$— | 2 | 4 | 1 | 2 |
| 98 | $CH_3$—$(CH_2)_8$— | $CH_3$— | $CH_3$— | 1 | 2 | 2 | 4 |

-continued

| No. | $R^1$ | $R^2$ | $R^3$ | w | x | y | z |
|---|---|---|---|---|---|---|---|
| 99 | $CH_3$—$(CH_2)_8$— | $CH_3$— | $CH_3$— | 1 | 2 | 4 | 2 |
| 100 | $CH_3$—$(CH_2)_8$— | $CH_3$— | $CH_3$— | 1 | 4 | 2 | 2 |
| 101 | $CH_3$—$(CH_2)_8$— | $CH_3$— | $CH_3$— | 4 | 2 | 2 | 1 |
| 102 | $CH_3$—$(CH_2)_8$— | $CH_3$— | $CH_3$— | 4 | 2 | 1 | 2 |
| 103 | $CH_3$—$(CH_2)_8$— | $CH_3$— | $CH_3$— | 4 | 1 | 2 | 2 |
| 104 | $CH_3$—$(CH_2)_8$— | $CH_3$— | $CH_3$— | 2 | 2 | 4 | 3 |
| 105 | $CH_3$—$(CH_2)_8$— | $CH_3$— | $CH_3$— | 2 | 2 | 3 | 4 |
| 106 | $CH_3$—$(CH_2)_8$— | $CH_3$— | $CH_3$— | 2 | 4 | 2 | 3 |
| 107 | $CH_3$—$(CH_2)_8$— | $CH_3$— | $CH_3$— | 2 | 3 | 2 | 4 |
| 108 | $CH_3$—$(CH_2)_8$— | $CH_3$— | $CH_3$— | 2 | 4 | 3 | 2 |
| 109 | $CH_3$—$(CH_2)_8$— | $CH_3$— | $CH_3$— | 2 | 3 | 4 | 2 |
| 110 | $CH_3$—$(CH_2)_8$— | $CH_3$— | $CH_3$— | 4 | 2 | 2 | 3 |
| 111 | $CH_3$—$(CH_2)_8$— | $CH_3$— | $CH_3$— | 4 | 2 | 3 | 2 |
| 112 | $CH_3$—$(CH_2)_8$— | $CH_3$— | $CH_3$— | 4 | 3 | 2 | 2 |
| 113 | $CH_3$—$(CH_2)_8$— | $CH_3$— | $CH_3$— | 3 | 2 | 2 | 4 |
| 114 | $CH_3$—$(CH_2)_8$— | $CH_3$— | $CH_3$— | 3 | 2 | 4 | 2 |
| 115 | $CH_3$—$(CH_2)_8$— | $CH_3$— | $CH_3$— | 3 | 4 | 2 | 2 |
| 116 | $CH_3$—$(CH_2)_8$— | $CH_3$— | $CH_3$— | 3 | 3 | 1 | 2 |
| 117 | $CH_3$—$(CH_2)_8$— | $CH_3$— | $CH_3$— | 3 | 3 | 2 | 1 |
| 118 | $CH_3$—$(CH_2)_8$— | $CH_3$— | $CH_3$— | 3 | 1 | 3 | 2 |
| 119 | $CH_3$—$(CH_2)_8$— | $CH_3$— | $CH_3$— | 3 | 2 | 3 | 1 |
| 120 | $CH_3$—$(CH_2)_8$— | $CH_3$— | $CH_3$— | 3 | 1 | 2 | 3 |
| 121 | $CH_3$—$(CH_2)_8$— | $CH_3$— | $CH_3$— | 3 | 2 | 1 | 3 |
| 122 | $CH_3$—$(CH_2)_8$— | $CH_3$— | $CH_3$— | 1 | 3 | 3 | 2 |
| 123 | $CH_3$—$(CH_2)_8$— | $CH_3$— | $CH_3$— | 1 | 3 | 2 | 3 |
| 124 | $CH_3$—$(CH_2)_8$— | $CH_3$— | $CH_3$— | 1 | 2 | 3 | 3 |
| 125 | $CH_3$—$(CH_2)_8$— | $CH_3$— | $CH_3$— | 2 | 3 | 3 | 1 |
| 126 | $CH_3$—$(CH_2)_8$— | $CH_3$— | $CH_3$— | 2 | 3 | 1 | 3 |
| 127 | $CH_3$—$(CH_2)_8$— | $CH_3$— | $CH_3$— | 2 | 1 | 3 | 3 |
| 128 | $CH_3$—$(CH_2)_8$— | $CH_3$— | $CH_3$— | 3 | 3 | 1 | 4 |
| 129 | $CH_3$—$(CH_2)_8$— | $CH_3$— | $CH_3$— | 3 | 3 | 4 | 1 |
| 130 | $CH_3$—$(CH_2)_8$— | $CH_3$— | $CH_3$— | 3 | 1 | 3 | 4 |
| 131 | $CH_3$—$(CH_2)_8$— | $CH_3$— | $CH_3$— | 3 | 4 | 3 | 1 |
| 132 | $CH_3$—$(CH_2)_8$— | $CH_3$— | $CH_3$— | 3 | 1 | 4 | 3 |
| 133 | $CH_3$—$(CH_2)_8$— | $CH_3$— | $CH_3$— | 3 | 4 | 1 | 3 |
| 134 | $CH_3$—$(CH_2)_8$— | $CH_3$— | $CH_3$— | 1 | 3 | 3 | 4 |
| 135 | $CH_3$—$(CH_2)_8$— | $CH_3$— | $CH_3$— | 1 | 3 | 4 | 3 |
| 136 | $CH_3$—$(CH_2)_8$— | $CH_3$— | $CH_3$— | 1 | 4 | 3 | 3 |
| 137 | $CH_3$—$(CH_2)_8$— | $CH_3$— | $CH_3$— | 4 | 3 | 3 | 1 |
| 138 | $CH_3$—$(CH_2)_8$— | $CH_3$— | $CH_3$— | 4 | 3 | 1 | 3 |
| 139 | $CH_3$—$(CH_2)_8$— | $CH_3$— | $CH_3$— | 4 | 1 | 3 | 3 |
| 140 | $CH_3$—$(CH_2)_8$— | $CH_3$— | $CH_3$— | 3 | 3 | 4 | 2 |
| 141 | $CH_3$—$(CH_2)_8$— | $CH_3$— | $CH_3$— | 3 | 3 | 2 | 4 |
| 142 | $CH_3$—$(CH_2)_8$— | $CH_3$— | $CH_3$— | 3 | 4 | 3 | 2 |
| 143 | $CH_3$—$(CH_2)_8$— | $CH_3$— | $CH_3$— | 3 | 2 | 3 | 4 |
| 144 | $CH_3$—$(CH_2)_8$— | $CH_3$— | $CH_3$— | 3 | 4 | 2 | 3 |
| 145 | $CH_3$—$(CH_2)_8$— | $CH_3$— | $CH_3$— | 3 | 2 | 4 | 3 |
| 146 | $CH_3$—$(CH_2)_8$— | $CH_3$— | $CH_3$— | 4 | 3 | 3 | 2 |
| 147 | $CH_3$—$(CH_2)_8$— | $CH_3$— | $CH_3$— | 4 | 3 | 2 | 3 |
| 148 | $CH_3$—$(CH_2)_8$— | $CH_3$— | $CH_3$— | 4 | 2 | 3 | 3 |
| 149 | $CH_3$—$(CH_2)_8$— | $CH_3$— | $CH_3$— | 2 | 3 | 3 | 4 |
| 150 | $CH_3$—$(CH_2)_8$— | $CH_3$— | $CH_3$— | 2 | 3 | 4 | 3 |
| 151 | $CH_3$—$(CH_2)_8$— | $CH_3$— | $CH_3$— | 2 | 4 | 3 | 3 |
| 152 | $CH_3$—$(CH_2)_8$— | $CH_3$— | $CH_3$— | 4 | 4 | 1 | 2 |
| 153 | $CH_3$—$(CH_2)_8$— | $CH_3$— | $CH_3$— | 4 | 4 | 2 | 1 |
| 154 | $CH_3$—$(CH_2)_8$— | $CH_3$— | $CH_3$— | 4 | 1 | 4 | 2 |
| 155 | $CH_3$—$(CH_2)_8$— | $CH_3$— | $CH_3$— | 4 | 2 | 4 | 1 |
| 156 | $CH_3$—$(CH_2)_8$— | $CH_3$— | $CH_3$— | 4 | 1 | 2 | 4 |
| 157 | $CH_3$—$(CH_2)_8$— | $CH_3$— | $CH_3$— | 4 | 2 | 1 | 4 |
| 158 | $CH_3$—$(CH_2)_8$— | $CH_3$— | $CH_3$— | 1 | 4 | 4 | 2 |
| 159 | $CH_3$—$(CH_2)_8$— | $CH_3$— | $CH_3$— | 1 | 4 | 2 | 4 |
| 160 | $CH_3$—$(CH_2)_8$— | $CH_3$— | $CH_3$— | 1 | 2 | 4 | 4 |
| 161 | $CH_3$—$(CH_2)_8$— | $CH_3$— | $CH_3$— | 2 | 4 | 4 | 1 |
| 162 | $CH_3$—$(CH_2)_8$— | $CH_3$— | $CH_3$— | 2 | 4 | 1 | 4 |
| 163 | $CH_3$—$(CH_2)_8$— | $CH_3$— | $CH_3$— | 2 | 1 | 4 | 4 |
| 164 | $CH_3$—$(CH_2)_8$— | $CH_3$— | $CH_3$— | 4 | 4 | 1 | 3 |
| 165 | $CH_3$—$(CH_2)_8$— | $CH_3$— | $CH_3$— | 4 | 4 | 3 | 1 |
| 166 | $CH_3$—$(CH_2)_8$— | $CH_3$— | $CH_3$— | 4 | 1 | 4 | 3 |
| 167 | $CH_3$—$(CH_2)_8$— | $CH_3$— | $CH_3$— | 4 | 3 | 4 | 1 |
| 168 | $CH_3$—$(CH_2)_8$— | $CH_3$— | $CH_3$— | 4 | 1 | 3 | 4 |
| 169 | $CH_3$—$(CH_2)_8$— | $CH_3$— | $CH_3$— | 4 | 3 | 1 | 4 |
| 170 | $CH_3$—$(CH_2)_8$— | $CH_3$— | $CH_3$— | 1 | 4 | 4 | 3 |
| 171 | $CH_3$—$(CH_2)_8$— | $CH_3$— | $CH_3$— | 1 | 4 | 3 | 4 |
| 172 | $CH_3$—$(CH_2)_8$— | $CH_3$— | $CH_3$— | 1 | 3 | 4 | 4 |
| 173 | $CH_3$—$(CH_2)_8$— | $CH_3$— | $CH_3$— | 3 | 4 | 4 | 1 |
| 174 | $CH_3$—$(CH_2)_8$— | $CH_3$— | $CH_3$— | 3 | 4 | 1 | 4 |
| 175 | $CH_3$—$(CH_2)_8$— | $CH_3$— | $CH_3$— | 3 | 1 | 4 | 4 |

-continued

| No. | $R^1$ | $R^2$ | $R^3$ | w | x | y | z |
|---|---|---|---|---|---|---|---|
| 176 | $CH_3$—$(CH_2)_8$— | $CH_3$— | $CH_3$— | 4 | 4 | 3 | 2 |
| 177 | $CH_3$—$(CH_2)_8$— | $CH_3$— | $CH_3$— | 4 | 4 | 2 | 3 |
| 178 | $CH_3$—$(CH_2)_8$— | $CH_3$— | $CH_3$— | 4 | 3 | 4 | 2 |
| 179 | $CH_3$—$(CH_2)_8$— | $CH_3$— | $CH_3$— | 4 | 2 | 4 | 3 |
| 180 | $CH_3$—$(CH_2)_8$— | $CH_3$— | $CH_3$— | 4 | 3 | 2 | 4 |
| 181 | $CH_3$—$(CH_2)_8$— | $CH_3$— | $CH_3$— | 4 | 2 | 3 | 4 |
| 182 | $CH_3$—$(CH_2)_8$— | $CH_3$— | $CH_3$— | 3 | 4 | 4 | 2 |
| 183 | $CH_3$—$(CH_2)_8$— | $CH_3$— | $CH_3$— | 3 | 4 | 2 | 4 |
| 184 | $CH_3$—$(CH_2)_8$— | $CH_3$— | $CH_3$— | 3 | 2 | 4 | 4 |
| 185 | $CH_3$—$(CH_2)_8$— | $CH_3$— | $CH_3$— | 2 | 4 | 4 | 3 |
| 186 | $CH_3$—$(CH_2)_8$— | $CH_3$— | $CH_3$— | 2 | 4 | 3 | 4 |
| 187 | $CH_3$—$(CH_2)_8$— | $CH_3$— | $CH_3$— | 2 | 3 | 4 | 4 |
| 188 | $CH_3$—$(CH_2)_8$— | $CH_3$— | $CH_3$— | 1 | 2 | 3 | 4 |
| 189 | $CH_3$—$(CH_2)_8$— | $CH_3$— | $CH_3$— | 1 | 2 | 4 | 3 |
| 190 | $CH_3$—$(CH_2)_8$— | $CH_3$— | $CH_3$— | 1 | 3 | 2 | 4 |
| 191 | $CH_3$—$(CH_2)_8$— | $CH_3$— | $CH_3$— | 1 | 3 | 4 | 2 |
| 192 | $CH_3$—$(CH_2)_8$— | $CH_3$— | $CH_3$— | 1 | 4 | 2 | 3 |
| 193 | $CH_3$—$(CH_2)_8$— | $CH_3$— | $CH_3$— | 1 | 4 | 3 | 2 |
| 194 | $CH_3$—$(CH_2)_8$— | $CH_3$— | $CH_3$— | 2 | 1 | 3 | 4 |
| 195 | $CH_3$—$(CH_2)_8$— | $CH_3$— | $CH_3$— | 2 | 1 | 4 | 3 |
| 196 | $CH_3$—$(CH_2)_8$— | $CH_3$— | $CH_3$— | 2 | 3 | 1 | 4 |
| 197 | $CH_3$—$(CH_2)_8$— | $CH_3$— | $CH_3$— | 2 | 3 | 4 | 1 |
| 198 | $CH_3$—$(CH_2)_8$— | $CH_3$— | $CH_3$— | 2 | 4 | 1 | 3 |
| 199 | $CH_3$—$(CH_2)_8$— | $CH_3$— | $CH_3$— | 2 | 4 | 3 | 1 |
| 200 | $CH_3$—$(CH_2)_8$— | $CH_3$— | $CH_3$— | 3 | 1 | 2 | 4 |
| 201 | $CH_3$—$(CH_2)_8$— | $CH_3$— | $CH_3$— | 3 | 1 | 4 | 2 |
| 202 | $CH_3$—$(CH_2)_8$— | $CH_3$— | $CH_3$— | 3 | 2 | 1 | 4 |
| 203 | $CH_3$—$(CH_2)_8$— | $CH_3$— | $CH_3$— | 3 | 2 | 4 | 1 |
| 204 | $CH_3$—$(CH_2)_8$— | $CH_3$— | $CH_3$— | 3 | 4 | 1 | 2 |
| 205 | $CH_3$—$(CH_2)_8$— | $CH_3$— | $CH_3$— | 3 | 4 | 2 | 1 |
| 206 | $CH_3$—$(CH_2)_8$— | $CH_3$— | $CH_3$— | 4 | 1 | 2 | 3 |
| 207 | $CH_3$—$(CH_2)_8$— | $CH_3$— | $CH_3$— | 4 | 1 | 3 | 2 |
| 208 | $CH_3$—$(CH_2)_8$— | $CH_3$— | $CH_3$— | 4 | 2 | 1 | 3 |
| 209 | $CH_3$—$(CH_2)_8$— | $CH_3$— | $CH_3$— | 4 | 2 | 3 | 1 |
| 210 | $CH_3$—$(CH_2)_8$— | $CH_3$— | $CH_3$— | 4 | 3 | 1 | 2 |
| 211 | $CH_3$—$(CH_2)_8$— | $CH_3$— | $CH_3$— | 4 | 3 | 2 | 1 |
| 212 | $CH_3$—$(CH_2)_8$— | $CH_3$— | $CH_3$— | 2 | 3 | 3 | 2 |
| 213 | $CH_3$—$(CH_2)_8$— | $CH_3$— | $CH_3$— | 2 | 3 | 2 | 3 |
| 214 | $CH_3$—$(CH_2)_8$— | $CH_3$— | $CH_3$— | 2 | 2 | 3 | 3 |
| 215 | $CH_3$—$(CH_2)_8$— | $CH_3$— | $CH_3$— | 3 | 3 | 2 | 2 |
| 216 | $CH_3$—$(CH_2)_8$— | $CH_3$— | $CH_3$— | 3 | 2 | 3 | 2 |
| 217 | $CH_3$—$(CH_2)_8$— | $CH_3$— | $CH_3$— | 3 | 2 | 2 | 3 |
| 218 | $CH_3$—$(CH_2)_8$— | $CH_3$— | $CH_3$— | 2 | 4 | 4 | 2 |
| 219 | $CH_3$—$(CH_2)_8$— | $CH_3$— | $CH_3$— | 2 | 4 | 2 | 4 |
| 220 | $CH_3$—$(CH_2)_8$— | $CH_3$— | $CH_3$— | 2 | 2 | 4 | 4 |
| 221 | $CH_3$—$(CH_2)_8$— | $CH_3$— | $CH_3$— | 4 | 4 | 2 | 2 |
| 222 | $CH_3$—$(CH_2)_8$— | $CH_3$— | $CH_3$— | 4 | 2 | 4 | 2 |
| 223 | $CH_3$—$(CH_2)_8$— | $CH_3$— | $CH_3$— | 4 | 2 | 2 | 4 |
| 224 | $CH_3$—$(CH_2)_8$— | $CH_3$— | $CH_3$— | 3 | 4 | 4 | 3 |
| 225 | $CH_3$—$(CH_2)_8$— | $CH_3$— | $CH_3$— | 3 | 4 | 3 | 4 |
| 226 | $CH_3$—$(CH_2)_8$— | $CH_3$— | $CH_3$— | 3 | 3 | 4 | 4 |
| 227 | $CH_3$—$(CH_2)_8$— | $CH_3$— | $CH_3$— | 4 | 4 | 3 | 3 |
| 228 | $CH_3$—$(CH_2)_8$— | $CH_3$— | $CH_3$— | 4 | 3 | 4 | 3 |
| 229 | $CH_3$—$(CH_2)_8$— | $CH_3$— | $CH_3$— | 4 | 3 | 3 | 4 |
| 230 | $CH_3$—$(CH_2)_9$— | $CH_3$— | $CH_3$— | 1 | 1 | 1 | 1 |
| 231 | $CH_3$—$(CH_2)_9$— | $CH_3$— | $CH_3$— | 2 | 1 | 1 | 1 |
| 232 | $CH_3$—$(CH_2)_9$— | $CH_3$— | $CH_3$— | 1 | 2 | 1 | 1 |
| 233 | $CH_3$—$(CH_2)_9$— | $CH_3$— | $CH_3$— | 1 | 1 | 2 | 1 |
| 234 | $CH_3$—$(CH_2)_9$— | $CH_3$— | $CH_3$— | 1 | 1 | 1 | 2 |
| 235 | $CH_3$—$(CH_2)_9$— | $CH_3$— | $CH_3$— | 3 | 1 | 1 | 1 |
| 236 | $CH_3$—$(CH_2)_9$— | $CH_3$— | $CH_3$— | 1 | 3 | 1 | 1 |
| 237 | $CH_3$—$(CH_2)_9$— | $CH_3$— | $CH_3$— | 1 | 1 | 3 | 1 |
| 238 | $CH_3$—$(CH_2)_9$— | $CH_3$— | $CH_3$— | 1 | 1 | 1 | 3 |
| 239 | $CH_3$—$(CH_2)_9$— | $CH_3$— | $CH_3$— | 4 | 1 | 1 | 1 |
| 240 | $CH_3$—$(CH_2)_9$— | $CH_3$— | $CH_3$— | 1 | 4 | 1 | 1 |
| 241 | $CH_3$—$(CH_2)_9$— | $CH_3$— | $CH_3$— | 1 | 1 | 4 | 1 |
| 242 | $CH_3$—$(CH_2)_9$— | $CH_3$— | $CH_3$— | 1 | 1 | 1 | 4 |
| 243 | $CH_3$—$(CH_2)_9$— | $CH_3$— | $CH_3$— | 1 | 2 | 2 | 1 |
| 244 | $CH_3$—$(CH_2)_9$— | $CH_3$— | $CH_3$— | 1 | 2 | 1 | 2 |
| 245 | $CH_3$—$(CH_2)_9$— | $CH_3$— | $CH_3$— | 1 | 1 | 2 | 2 |
| 246 | $CH_3$—$(CH_2)_9$— | $CH_3$— | $CH_3$— | 2 | 2 | 1 | 1 |
| 247 | $CH_3$—$(CH_2)_9$— | $CH_3$— | $CH_3$— | 2 | 1 | 2 | 1 |
| 248 | $CH_3$—$(CH_2)_9$— | $CH_3$— | $CH_3$— | 2 | 1 | 1 | 2 |
| 249 | $CH_3$—$(CH_2)_9$— | $CH_3$— | $CH_3$— | 1 | 3 | 3 | 1 |
| 250 | $CH_3$—$(CH_2)_9$— | $CH_3$— | $CH_3$— | 1 | 3 | 1 | 3 |
| 251 | $CH_3$—$(CH_2)_9$— | $CH_3$— | $CH_3$— | 1 | 1 | 3 | 3 |
| 252 | $CH_3$—$(CH_2)_9$— | $CH_3$— | $CH_3$— | 3 | 3 | 1 | 1 |

-continued

| No. | $R^1$ | $R^2$ | $R^3$ | w | x | y | z |
|---|---|---|---|---|---|---|---|
| 253 | $CH_3$—$(CH_2)_9$— | $CH_3$— | $CH_3$— | 3 | 1 | 3 | 1 |
| 254 | $CH_3$—$(CH_2)_9$— | $CH_3$— | $CH_3$— | 3 | 1 | 1 | 3 |
| 255 | $CH_3$—$(CH_2)_9$— | $CH_3$— | $CH_3$— | 1 | 4 | 4 | 1 |
| 256 | $CH_3$—$(CH_2)_9$— | $CH_3$— | $CH_3$— | 1 | 4 | 1 | 4 |
| 257 | $CH_3$—$(CH_2)_9$— | $CH_3$— | $CH_3$— | 1 | 1 | 4 | 4 |
| 258 | $CH_3$—$(CH_2)_9$— | $CH_3$— | $CH_3$— | 4 | 4 | 1 | 1 |
| 259 | $CH_3$—$(CH_2)_9$— | $CH_3$— | $CH_3$— | 4 | 1 | 4 | 1 |
| 260 | $CH_3$—$(CH_2)_9$— | $CH_3$— | $CH_3$— | 4 | 1 | 1 | 4 |
| 261 | $CH_3$—$(CH_2)_9$— | $CH_3$— | $CH_3$— | 1 | 1 | 2 | 3 |
| 262 | $CH_3$—$(CH_2)_9$— | $CH_3$— | $CH_3$— | 1 | 1 | 3 | 2 |
| 263 | $CH_3$—$(CH_2)_9$— | $CH_3$— | $CH_3$— | 1 | 2 | 3 | 1 |
| 264 | $CH_3$—$(CH_2)_9$— | $CH_3$— | $CH_3$— | 1 | 3 | 2 | 1 |
| 265 | $CH_3$—$(CH_2)_9$— | $CH_3$— | $CH_3$— | 1 | 2 | 1 | 3 |
| 266 | $CH_3$—$(CH_2)_9$— | $CH_3$— | $CH_3$— | 1 | 3 | 1 | 2 |
| 267 | $CH_3$—$(CH_2)_9$— | $CH_3$— | $CH_3$— | 2 | 1 | 1 | 3 |
| 268 | $CH_3$—$(CH_2)_9$— | $CH_3$— | $CH_3$— | 2 | 1 | 3 | 1 |
| 269 | $CH_3$—$(CH_2)_9$— | $CH_3$— | $CH_3$— | 2 | 3 | 1 | 1 |
| 270 | $CH_3$—$(CH_2)_9$— | $CH_3$— | $CH_3$— | 3 | 1 | 1 | 2 |
| 271 | $CH_3$—$(CH_2)_9$— | $CH_3$— | $CH_3$— | 3 | 1 | 2 | 1 |
| 272 | $CH_3$—$(CH_2)_9$— | $CH_3$— | $CH_3$— | 3 | 2 | 1 | 1 |
| 273 | $CH_3$—$(CH_2)_9$— | $CH_3$— | $CH_3$— | 1 | 1 | 2 | 4 |
| 274 | $CH_3$—$(CH_2)_9$— | $CH_3$— | $CH_3$— | 1 | 1 | 4 | 2 |
| 275 | $CH_3$—$(CH_2)_9$— | $CH_3$— | $CH_3$— | 1 | 2 | 4 | 1 |
| 276 | $CH_3$—$(CH_2)_9$— | $CH_3$— | $CH_3$— | 1 | 4 | 2 | 1 |
| 277 | $CH_3$—$(CH_2)_9$— | $CH_3$— | $CH_3$— | 1 | 2 | 1 | 4 |
| 278 | $CH_3$—$(CH_2)_9$— | $CH_3$— | $CH_3$— | 1 | 4 | 1 | 2 |
| 279 | $CH_3$—$(CH_2)_9$— | $CH_3$— | $CH_3$— | 2 | 1 | 1 | 4 |
| 280 | $CH_3$—$(CH_2)_9$— | $CH_3$— | $CH_3$— | 2 | 1 | 4 | 1 |
| 281 | $CH_3$—$(CH_2)_9$— | $CH_3$— | $CH_3$— | 2 | 4 | 1 | 1 |
| 282 | $CH_3$—$(CH_2)_9$— | $CH_3$— | $CH_3$— | 4 | 1 | 1 | 2 |
| 283 | $CH_3$—$(CH_2)_9$— | $CH_3$— | $CH_3$— | 4 | 1 | 2 | 1 |
| 284 | $CH_3$—$(CH_2)_9$— | $CH_3$— | $CH_3$— | 4 | 2 | 1 | 1 |
| 285 | $CH_3$—$(CH_2)_9$— | $CH_3$— | $CH_3$— | 1 | 1 | 4 | 3 |
| 286 | $CH_3$—$(CH_2)_9$— | $CH_3$— | $CH_3$— | 1 | 1 | 3 | 4 |
| 287 | $CH_3$—$(CH_2)_9$— | $CH_3$— | $CH_3$— | 1 | 4 | 3 | 1 |
| 288 | $CH_3$—$(CH_2)_9$— | $CH_3$— | $CH_3$— | 1 | 3 | 4 | 1 |
| 289 | $CH_3$—$(CH_2)_9$— | $CH_3$— | $CH_3$— | 1 | 4 | 1 | 3 |
| 290 | $CH_3$—$(CH_2)_9$— | $CH_3$— | $CH_3$— | 1 | 3 | 1 | 4 |
| 291 | $CH_3$—$(CH_2)_9$— | $CH_3$— | $CH_3$— | 4 | 1 | 1 | 3 |
| 292 | $CH_3$—$(CH_2)_9$— | $CH_3$— | $CH_3$— | 4 | 1 | 3 | 1 |
| 293 | $CH_3$—$(CH_2)_9$— | $CH_3$— | $CH_3$— | 4 | 3 | 1 | 1 |
| 294 | $CH_3$—$(CH_2)_9$— | $CH_3$— | $CH_3$— | 3 | 1 | 1 | 4 |
| 295 | $CH_3$—$(CH_2)_9$— | $CH_3$— | $CH_3$— | 3 | 1 | 4 | 1 |
| 296 | $CH_3$—$(CH_2)_9$— | $CH_3$— | $CH_3$— | 3 | 4 | 1 | 1 |
| 297 | $CH_3$—$(CH_2)_9$— | $CH_3$— | $CH_3$— | 1 | 2 | 2 | 2 |
| 298 | $CH_3$—$(CH_2)_9$— | $CH_3$— | $CH_3$— | 2 | 1 | 2 | 2 |
| 299 | $CH_3$—$(CH_2)_9$— | $CH_3$— | $CH_3$— | 2 | 2 | 1 | 2 |
| 300 | $CH_3$—$(CH_2)_9$— | $CH_3$— | $CH_3$— | 2 | 2 | 2 | 1 |
| 301 | $CH_3$—$(CH_2)_9$— | $CH_3$— | $CH_3$— | 1 | 3 | 3 | 3 |
| 302 | $CH_3$—$(CH_2)_9$— | $CH_3$— | $CH_3$— | 3 | 1 | 3 | 3 |
| 303 | $CH_3$—$(CH_2)_9$— | $CH_3$— | $CH_3$— | 3 | 3 | 1 | 3 |
| 304 | $CH_3$—$(CH_2)_9$— | $CH_3$— | $CH_3$— | 3 | 3 | 3 | 1 |
| 305 | $CH_3$—$(CH_2)_9$— | $CH_3$— | $CH_3$— | 1 | 4 | 4 | 4 |
| 306 | $CH_3$—$(CH_2)_9$— | $CH_3$— | $CH_3$— | 4 | 1 | 4 | 4 |
| 307 | $CH_3$—$(CH_2)_9$— | $CH_3$— | $CH_3$— | 4 | 4 | 1 | 4 |
| 308 | $CH_3$—$(CH_2)_9$— | $CH_3$— | $CH_3$— | 4 | 4 | 4 | 1 |
| 309 | $CH_3$—$(CH_2)_9$— | $CH_3$— | $CH_3$— | 2 | 2 | 1 | 3 |
| 310 | $CH_3$—$(CH_2)_9$— | $CH_3$— | $CH_3$— | 2 | 2 | 3 | 1 |
| 311 | $CH_3$—$(CH_2)_9$— | $CH_3$— | $CH_3$— | 2 | 1 | 2 | 3 |
| 312 | $CH_3$—$(CH_2)_9$— | $CH_3$— | $CH_3$— | 2 | 3 | 2 | 1 |
| 313 | $CH_3$—$(CH_2)_9$— | $CH_3$— | $CH_3$— | 2 | 1 | 3 | 2 |
| 314 | $CH_3$—$(CH_2)_9$— | $CH_3$— | $CH_3$— | 2 | 3 | 1 | 2 |
| 315 | $CH_3$—$(CH_2)_9$— | $CH_3$— | $CH_3$— | 1 | 2 | 2 | 3 |
| 316 | $CH_3$—$(CH_2)_9$— | $CH_3$— | $CH_3$— | 1 | 2 | 3 | 2 |
| 317 | $CH_3$—$(CH_2)_9$— | $CH_3$— | $CH_3$— | 1 | 3 | 2 | 2 |
| 318 | $CH_3$—$(CH_2)_9$— | $CH_3$— | $CH_3$— | 3 | 2 | 2 | 1 |
| 319 | $CH_3$—$(CH_2)_9$— | $CH_3$— | $CH_3$— | 3 | 2 | 1 | 2 |
| 320 | $CH_3$—$(CH_2)_9$— | $CH_3$— | $CH_3$— | 3 | 1 | 2 | 2 |
| 321 | $CH_3$—$(CH_2)_9$— | $CH_3$— | $CH_3$— | 2 | 2 | 1 | 4 |
| 322 | $CH_3$—$(CH_2)_9$— | $CH_3$— | $CH_3$— | 2 | 2 | 4 | 1 |
| 323 | $CH_3$—$(CH_2)_9$— | $CH_3$— | $CH_3$— | 2 | 1 | 2 | 4 |
| 324 | $CH_3$—$(CH_2)_9$— | $CH_3$— | $CH_3$— | 2 | 4 | 2 | 1 |
| 325 | $CH_3$—$(CH_2)_9$— | $CH_3$— | $CH_3$— | 2 | 1 | 4 | 2 |
| 326 | $CH_3$—$(CH_2)_9$— | $CH_3$— | $CH_3$— | 2 | 4 | 1 | 2 |
| 327 | $CH_3$—$(CH_2)_9$— | $CH_3$— | $CH_3$— | 1 | 2 | 2 | 4 |
| 328 | $CH_3$—$(CH_2)_9$— | $CH_3$— | $CH_3$— | 1 | 2 | 4 | 2 |
| 329 | $CH_3$—$(CH_2)_9$— | $CH_3$— | $CH_3$— | 1 | 4 | 2 | 2 |

-continued

| No. | $R^1$ | $R^2$ | $R^3$ | w | x | y | z |
|---|---|---|---|---|---|---|---|
| 330 | $CH_3$—$(CH_2)_9$— | $CH_3$— | $CH_3$— | 4 | 2 | 2 | 1 |
| 331 | $CH_3$—$(CH_2)_9$— | $CH_3$— | $CH_3$— | 4 | 2 | 1 | 2 |
| 332 | $CH_3$—$(CH_2)_9$— | $CH_3$— | $CH_3$— | 4 | 1 | 2 | 2 |
| 333 | $CH_3$—$(CH_2)_9$— | $CH_3$— | $CH_3$— | 2 | 2 | 4 | 3 |
| 334 | $CH_3$—$(CH_2)_9$— | $CH_3$— | $CH_3$— | 2 | 2 | 3 | 4 |
| 335 | $CH_3$—$(CH_2)_9$— | $CH_3$— | $CH_3$— | 2 | 4 | 2 | 3 |
| 336 | $CH_3$—$(CH_2)_9$— | $CH_3$— | $CH_3$— | 2 | 3 | 2 | 4 |
| 337 | $CH_3$—$(CH_2)_9$— | $CH_3$— | $CH_3$— | 2 | 4 | 3 | 2 |
| 338 | $CH_3$—$(CH_2)_9$— | $CH_3$— | $CH_3$— | 2 | 3 | 4 | 2 |
| 339 | $CH_3$—$(CH_2)_9$— | $CH_3$— | $CH_3$— | 4 | 2 | 2 | 3 |
| 340 | $CH_3$—$(CH_2)_9$— | $CH_3$— | $CH_3$— | 4 | 2 | 3 | 2 |
| 341 | $CH_3$—$(CH_2)_9$— | $CH_3$— | $CH_3$— | 4 | 3 | 2 | 2 |
| 342 | $CH_3$—$(CH_2)_9$— | $CH_3$— | $CH_3$— | 3 | 2 | 2 | 4 |
| 343 | $CH_3$—$(CH_2)_9$— | $CH_3$— | $CH_3$— | 3 | 2 | 4 | 2 |
| 344 | $CH_3$—$(CH_2)_9$— | $CH_3$— | $CH_3$— | 3 | 4 | 2 | 2 |
| 345 | $CH_3$—$(CH_2)_9$— | $CH_3$— | $CH_3$— | 3 | 3 | 1 | 2 |
| 346 | $CH_3$—$(CH_2)_9$— | $CH_3$— | $CH_3$— | 3 | 3 | 2 | 1 |
| 347 | $CH_3$—$(CH_2)_9$— | $CH_3$— | $CH_3$— | 3 | 1 | 3 | 2 |
| 348 | $CH_3$—$(CH_2)_9$— | $CH_3$— | $CH_3$— | 3 | 2 | 3 | 1 |
| 349 | $CH_3$—$(CH_2)_9$— | $CH_3$— | $CH_3$— | 3 | 1 | 2 | 3 |
| 350 | $CH_3$—$(CH_2)_9$— | $CH_3$— | $CH_3$— | 3 | 2 | 1 | 3 |
| 351 | $CH_3$—$(CH_2)_9$— | $CH_3$— | $CH_3$— | 1 | 3 | 3 | 2 |
| 352 | $CH_3$—$(CH_2)_9$— | $CH_3$— | $CH_3$— | 1 | 3 | 2 | 3 |
| 353 | $CH_3$—$(CH_2)_9$— | $CH_3$— | $CH_3$— | 1 | 2 | 3 | 3 |
| 354 | $CH_3$—$(CH_2)_9$— | $CH_3$— | $CH_3$— | 2 | 3 | 3 | 1 |
| 355 | $CH_3$—$(CH_2)_9$— | $CH_3$— | $CH_3$— | 2 | 3 | 1 | 3 |
| 356 | $CH_3$—$(CH_2)_9$— | $CH_3$— | $CH_3$— | 2 | 1 | 3 | 3 |
| 357 | $CH_3$—$(CH_2)_9$— | $CH_3$— | $CH_3$— | 3 | 3 | 1 | 4 |
| 358 | $CH_3$—$(CH_2)_9$— | $CH_3$— | $CH_3$— | 3 | 3 | 4 | 1 |
| 359 | $CH_3$—$(CH_2)_9$— | $CH_3$— | $CH_3$— | 3 | 1 | 3 | 4 |
| 360 | $CH_3$—$(CH_2)_9$— | $CH_3$— | $CH_3$— | 3 | 4 | 3 | 1 |
| 361 | $CH_3$—$(CH_2)_9$— | $CH_3$— | $CH_3$— | 3 | 1 | 4 | 3 |
| 362 | $CH_3$—$(CH_2)_9$— | $CH_3$— | $CH_3$— | 3 | 4 | 1 | 3 |
| 363 | $CH_3$—$(CH_2)_9$— | $CH_3$— | $CH_3$— | 1 | 3 | 3 | 4 |
| 364 | $CH_3$—$(CH_2)_9$— | $CH_3$— | $CH_3$— | 1 | 3 | 4 | 3 |
| 365 | $CH_3$—$(CH_2)_9$— | $CH_3$— | $CH_3$— | 1 | 4 | 3 | 3 |
| 366 | $CH_3$—$(CH_2)_9$— | $CH_3$— | $CH_3$— | 4 | 3 | 3 | 1 |
| 367 | $CH_3$—$(CH_2)_9$— | $CH_3$— | $CH_3$— | 4 | 3 | 1 | 3 |
| 368 | $CH_3$—$(CH_2)_9$— | $CH_3$— | $CH_3$— | 4 | 1 | 3 | 3 |
| 369 | $CH_3$—$(CH_2)_9$— | $CH_3$— | $CH_3$— | 3 | 3 | 4 | 2 |
| 370 | $CH_3$—$(CH_2)_9$— | $CH_3$— | $CH_3$— | 3 | 3 | 2 | 4 |
| 371 | $CH_3$—$(CH_2)_9$— | $CH_3$— | $CH_3$— | 3 | 4 | 3 | 2 |
| 372 | $CH_3$—$(CH_2)_9$— | $CH_3$— | $CH_3$— | 3 | 2 | 3 | 4 |
| 373 | $CH_3$—$(CH_2)_9$— | $CH_3$— | $CH_3$— | 3 | 4 | 2 | 3 |
| 374 | $CH_3$—$(CH_2)_9$— | $CH_3$— | $CH_3$— | 3 | 2 | 4 | 3 |
| 375 | $CH_3$—$(CH_2)_9$— | $CH_3$— | $CH_3$— | 4 | 3 | 3 | 2 |
| 376 | $CH_3$—$(CH_2)_9$— | $CH_3$— | $CH_3$— | 4 | 3 | 2 | 3 |
| 377 | $CH_3$—$(CH_2)_9$— | $CH_3$— | $CH_3$— | 4 | 2 | 3 | 3 |
| 378 | $CH_3$—$(CH_2)_9$— | $CH_3$— | $CH_3$— | 2 | 3 | 3 | 4 |
| 379 | $CH_3$—$(CH_2)_9$— | $CH_3$— | $CH_3$— | 2 | 3 | 4 | 3 |
| 380 | $CH_3$—$(CH_2)_9$— | $CH_3$— | $CH_3$— | 2 | 4 | 3 | 3 |
| 381 | $CH_3$—$(CH_2)_9$— | $CH_3$— | $CH_3$— | 4 | 4 | 1 | 2 |
| 382 | $CH_3$—$(CH_2)_9$— | $CH_3$— | $CH_3$— | 4 | 4 | 2 | 1 |
| 383 | $CH_3$—$(CH_2)_9$— | $CH_3$— | $CH_3$— | 4 | 1 | 4 | 2 |
| 384 | $CH_3$—$(CH_2)_9$— | $CH_3$— | $CH_3$— | 4 | 2 | 4 | 1 |
| 385 | $CH_3$—$(CH_2)_9$— | $CH_3$— | $CH_3$— | 4 | 1 | 2 | 4 |
| 386 | $CH_3$—$(CH_2)_9$— | $CH_3$— | $CH_3$— | 4 | 2 | 1 | 4 |
| 387 | $CH_3$—$(CH_2)_9$— | $CH_3$— | $CH_3$— | 1 | 4 | 4 | 2 |
| 388 | $CH_3$—$(CH_2)_9$— | $CH_3$— | $CH_3$— | 1 | 4 | 2 | 4 |
| 389 | $CH_3$—$(CH_2)_9$— | $CH_3$— | $CH_3$— | 1 | 2 | 4 | 4 |
| 390 | $CH_3$—$(CH_2)_9$— | $CH_3$— | $CH_3$— | 2 | 4 | 4 | 1 |
| 391 | $CH_3$—$(CH_2)_9$— | $CH_3$— | $CH_3$— | 2 | 4 | 1 | 4 |
| 392 | $CH_3$—$(CH_2)_9$— | $CH_3$— | $CH_3$— | 2 | 1 | 4 | 4 |
| 393 | $CH_3$—$(CH_2)_9$— | $CH_3$— | $CH_3$— | 4 | 4 | 1 | 3 |
| 394 | $CH_3$—$(CH_2)_9$— | $CH_3$— | $CH_3$— | 4 | 4 | 3 | 1 |
| 395 | $CH_3$—$(CH_2)_9$— | $CH_3$— | $CH_3$— | 4 | 1 | 4 | 3 |
| 396 | $CH_3$—$(CH_2)_9$— | $CH_3$— | $CH_3$— | 4 | 3 | 4 | 1 |
| 397 | $CH_3$—$(CH_2)_9$— | $CH_3$— | $CH_3$— | 4 | 1 | 3 | 4 |
| 398 | $CH_3$—$(CH_2)_9$— | $CH_3$— | $CH_3$— | 4 | 3 | 1 | 4 |
| 399 | $CH_3$—$(CH_2)_9$— | $CH_3$— | $CH_3$— | 1 | 4 | 4 | 3 |
| 400 | $CH_3$—$(CH_2)_9$— | $CH_3$— | $CH_3$— | 1 | 4 | 3 | 4 |
| 401 | $CH_3$—$(CH_2)_9$— | $CH_3$— | $CH_3$— | 1 | 3 | 4 | 4 |
| 402 | $CH_3$—$(CH_2)_9$— | $CH_3$— | $CH_3$— | 3 | 4 | 4 | 1 |
| 403 | $CH_3$—$(CH_2)_9$— | $CH_3$— | $CH_3$— | 3 | 4 | 1 | 4 |
| 404 | $CH_3$—$(CH_2)_9$— | $CH_3$— | $CH_3$— | 3 | 1 | 4 | 4 |
| 405 | $CH_3$—$(CH_2)_9$— | $CH_3$— | $CH_3$— | 4 | 4 | 3 | 2 |
| 406 | $CH_3$—$(CH_2)_9$— | $CH_3$— | $CH_3$— | 4 | 4 | 2 | 3 |

-continued

| No. | $R^1$ | $R^2$ | $R^3$ | w | x | y | z |
|---|---|---|---|---|---|---|---|
| 407 | $CH_3$—$(CH_2)_9$— | $CH_3$— | $CH_3$— | 4 | 3 | 4 | 2 |
| 408 | $CH_3$—$(CH_2)_9$— | $CH_3$— | $CH_3$— | 4 | 2 | 4 | 3 |
| 409 | $CH_3$—$(CH_2)_9$— | $CH_3$— | $CH_3$— | 4 | 3 | 2 | 4 |
| 410 | $CH_3$—$(CH_2)_9$— | $CH_3$— | $CH_3$— | 4 | 2 | 3 | 4 |
| 411 | $CH_3$—$(CH_2)_9$— | $CH_3$— | $CH_3$— | 3 | 4 | 4 | 2 |
| 412 | $CH_3$—$(CH_2)_9$— | $CH_3$— | $CH_3$— | 3 | 4 | 2 | 4 |
| 413 | $CH_3$—$(CH_2)_9$— | $CH_3$— | $CH_3$— | 3 | 2 | 4 | 4 |
| 414 | $CH_3$—$(CH_2)_9$— | $CH_3$— | $CH_3$— | 2 | 4 | 4 | 3 |
| 415 | $CH_3$—$(CH_2)_9$— | $CH_3$— | $CH_3$— | 2 | 4 | 3 | 4 |
| 416 | $CH_3$—$(CH_2)_9$— | $CH_3$— | $CH_3$— | 2 | 3 | 4 | 4 |
| 417 | $CH_3$—$(CH_2)_9$— | $CH_3$— | $CH_3$— | 1 | 2 | 3 | 4 |
| 418 | $CH_3$—$(CH_2)_9$— | $CH_3$— | $CH_3$— | 1 | 2 | 4 | 3 |
| 419 | $CH_3$—$(CH_2)_9$— | $CH_3$— | $CH_3$— | 1 | 3 | 2 | 4 |
| 420 | $CH_3$—$(CH_2)_9$— | $CH_3$— | $CH_3$— | 1 | 3 | 4 | 2 |
| 421 | $CH_3$—$(CH_2)_9$— | $CH_3$— | $CH_3$— | 1 | 4 | 2 | 3 |
| 422 | $CH_3$—$(CH_2)_9$— | $CH_3$— | $CH_3$— | 1 | 4 | 3 | 2 |
| 423 | $CH_3$—$(CH_2)_9$— | $CH_3$— | $CH_3$— | 2 | 1 | 3 | 4 |
| 424 | $CH_3$—$(CH_2)_9$— | $CH_3$— | $CH_3$— | 2 | 1 | 4 | 3 |
| 425 | $CH_3$—$(CH_2)_9$— | $CH_3$— | $CH_3$— | 2 | 3 | 1 | 4 |
| 426 | $CH_3$—$(CH_2)_9$— | $CH_3$— | $CH_3$— | 2 | 3 | 4 | 1 |
| 427 | $CH_3$—$(CH_2)_9$— | $CH_3$— | $CH_3$— | 2 | 4 | 1 | 3 |
| 428 | $CH_3$—$(CH_2)_9$— | $CH_3$— | $CH_3$— | 2 | 4 | 3 | 1 |
| 429 | $CH_3$—$(CH_2)_9$— | $CH_3$— | $CH_3$— | 3 | 1 | 2 | 4 |
| 430 | $CH_3$—$(CH_2)_9$— | $CH_3$— | $CH_3$— | 3 | 1 | 4 | 2 |
| 431 | $CH_3$—$(CH_2)_9$— | $CH_3$— | $CH_3$— | 3 | 2 | 1 | 4 |
| 432 | $CH_3$—$(CH_2)_9$— | $CH_3$— | $CH_3$— | 3 | 2 | 4 | 1 |
| 433 | $CH_3$—$(CH_2)_9$— | $CH_3$— | $CH_3$— | 3 | 4 | 1 | 2 |
| 434 | $CH_3$—$(CH_2)_9$— | $CH_3$— | $CH_3$— | 3 | 4 | 2 | 1 |
| 435 | $CH_3$—$(CH_2)_9$— | $CH_3$— | $CH_3$— | 4 | 1 | 2 | 3 |
| 436 | $CH_3$—$(CH_2)_9$— | $CH_3$— | $CH_3$— | 4 | 1 | 3 | 2 |
| 437 | $CH_3$—$(CH_2)_9$— | $CH_3$— | $CH_3$— | 4 | 2 | 1 | 3 |
| 438 | $CH_3$—$(CH_2)_9$— | $CH_3$— | $CH_3$— | 4 | 2 | 3 | 1 |
| 439 | $CH_3$—$(CH_2)_9$— | $CH_3$— | $CH_3$— | 4 | 3 | 1 | 2 |
| 440 | $CH_3$—$(CH_2)_9$— | $CH_3$— | $CH_3$— | 4 | 3 | 2 | 1 |
| 441 | $CH_3$—$(CH_2)_9$— | $CH_3$— | $CH_3$— | 2 | 3 | 3 | 2 |
| 442 | $CH_3$—$(CH_2)_9$— | $CH_3$— | $CH_3$— | 2 | 3 | 2 | 3 |
| 443 | $CH_3$—$(CH_2)_9$— | $CH_3$— | $CH_3$— | 2 | 2 | 3 | 3 |
| 444 | $CH_3$—$(CH_2)_9$— | $CH_3$— | $CH_3$— | 3 | 3 | 2 | 2 |
| 445 | $CH_3$—$(CH_2)_9$— | $CH_3$— | $CH_3$— | 3 | 2 | 3 | 2 |
| 446 | $CH_3$—$(CH_2)_9$— | $CH_3$— | $CH_3$— | 3 | 2 | 2 | 3 |
| 447 | $CH_3$—$(CH_2)_9$— | $CH_3$— | $CH_3$— | 2 | 4 | 4 | 2 |
| 448 | $CH_3$—$(CH_2)_9$— | $CH_3$— | $CH_3$— | 2 | 4 | 2 | 4 |
| 449 | $CH_3$—$(CH_2)_9$— | $CH_3$— | $CH_3$— | 2 | 2 | 4 | 4 |
| 450 | $CH_3$—$(CH_2)_9$— | $CH_3$— | $CH_3$— | 4 | 4 | 2 | 2 |
| 451 | $CH_3$—$(CH_2)_9$— | $CH_3$— | $CH_3$— | 4 | 2 | 4 | 2 |
| 452 | $CH_3$—$(CH_2)_9$— | $CH_3$— | $CH_3$— | 4 | 2 | 2 | 4 |
| 453 | $CH_3$—$(CH_2)_9$— | $CH_3$— | $CH_3$— | 3 | 4 | 4 | 3 |
| 454 | $CH_3$—$(CH_2)_9$— | $CH_3$— | $CH_3$— | 3 | 4 | 3 | 4 |
| 455 | $CH_3$—$(CH_2)_9$— | $CH_3$— | $CH_3$— | 3 | 3 | 4 | 4 |
| 456 | $CH_3$—$(CH_2)_9$— | $CH_3$— | $CH_3$— | 4 | 4 | 3 | 3 |
| 457 | $CH_3$—$(CH_2)_9$— | $CH_3$— | $CH_3$— | 4 | 3 | 4 | 3 |
| 458 | $CH_3$—$(CH_2)_9$— | $CH_3$— | $CH_3$— | 4 | 3 | 3 | 4 |
| 459 | $CH_3$—$(CH_2)_{10}$— | $CH_3$— | $CH_3$— | 1 | 1 | 1 | 1 |
| 460 | $CH_3$—$(CH_2)_{10}$— | $CH_3$— | $CH_3$— | 2 | 1 | 1 | 1 |
| 461 | $CH_3$—$(CH_2)_{10}$— | $CH_3$— | $CH_3$— | 1 | 2 | 1 | 1 |
| 462 | $CH_3$—$(CH_2)_{10}$— | $CH_3$— | $CH_3$— | 1 | 1 | 2 | 1 |
| 463 | $CH_3$—$(CH_2)_{10}$— | $CH_3$— | $CH_3$— | 1 | 1 | 1 | 2 |
| 464 | $CH_3$—$(CH_2)_{10}$— | $CH_3$— | $CH_3$— | 3 | 1 | 1 | 1 |
| 465 | $CH_3$—$(CH_2)_{10}$— | $CH_3$— | $CH_3$— | 1 | 3 | 1 | 1 |
| 466 | $CH_3$—$(CH_2)_{10}$— | $CH_3$— | $CH_3$— | 1 | 1 | 3 | 1 |
| 467 | $CH_3$—$(CH_2)_{10}$— | $CH_3$— | $CH_3$— | 1 | 1 | 1 | 3 |
| 468 | $CH_3$—$(CH_2)_{10}$— | $CH_3$— | $CH_3$— | 4 | 1 | 1 | 1 |
| 469 | $CH_3$—$(CH_2)_{10}$— | $CH_3$— | $CH_3$— | 1 | 4 | 1 | 1 |
| 470 | $CH_3$—$(CH_2)_{10}$— | $CH_3$— | $CH_3$— | 1 | 1 | 4 | 1 |
| 471 | $CH_3$—$(CH_2)_{10}$— | $CH_3$— | $CH_3$— | 1 | 1 | 1 | 4 |
| 472 | $CH_3$—$(CH_2)_{10}$— | $CH_3$— | $CH_3$— | 1 | 2 | 2 | 1 |
| 473 | $CH_3$—$(CH_2)_{10}$— | $CH_3$— | $CH_3$— | 1 | 2 | 1 | 2 |
| 474 | $CH_3$—$(CH_2)_{10}$— | $CH_3$— | $CH_3$— | 1 | 1 | 2 | 2 |
| 475 | $CH_3$—$(CH_2)_{10}$— | $CH_3$— | $CH_3$— | 2 | 2 | 1 | 1 |
| 476 | $CH_3$—$(CH_2)_{10}$— | $CH_3$— | $CH_3$— | 2 | 1 | 2 | 1 |
| 477 | $CH_3$—$(CH_2)_{10}$— | $CH_3$— | $CH_3$— | 2 | 1 | 1 | 2 |
| 478 | $CH_3$—$(CH_2)_{10}$— | $CH_3$— | $CH_3$— | 1 | 3 | 3 | 1 |
| 479 | $CH_3$—$(CH_2)_{10}$— | $CH_3$— | $CH_3$— | 1 | 3 | 1 | 3 |
| 480 | $CH_3$—$(CH_2)_{10}$— | $CH_3$— | $CH_3$— | 1 | 1 | 3 | 3 |
| 481 | $CH_3$—$(CH_2)_{10}$— | $CH_3$— | $CH_3$— | 3 | 3 | 1 | 1 |
| 482 | $CH_3$—$(CH_2)_{10}$— | $CH_3$— | $CH_3$— | 3 | 1 | 3 | 1 |
| 483 | $CH_3$—$(CH_2)_{10}$— | $CH_3$— | $CH_3$— | 3 | 1 | 1 | 3 |

-continued

| No. | $R^1$ | $R^2$ | $R^3$ | w | x | y | z |
|---|---|---|---|---|---|---|---|
| 484 | $CH_3$—$(CH_2)_{10}$— | $CH_3$— | $CH_3$— | 1 | 4 | 4 | 1 |
| 485 | $CH_3$—$(CH_2)_{10}$— | $CH_3$— | $CH_3$— | 1 | 4 | 1 | 4 |
| 486 | $CH_3$—$(CH_2)_{10}$— | $CH_3$— | $CH_3$— | 1 | 1 | 4 | 4 |
| 487 | $CH_3$—$(CH_2)_{10}$— | $CH_3$— | $CH_3$— | 4 | 4 | 1 | 1 |
| 488 | $CH_3$—$(CH_2)_{10}$— | $CH_3$— | $CH_3$— | 4 | 1 | 4 | 1 |
| 489 | $CH_3$—$(CH_2)_{10}$— | $CH_3$— | $CH_3$— | 4 | 1 | 1 | 4 |
| 490 | $CH_3$—$(CH_2)_{10}$— | $CH_3$— | $CH_3$— | 1 | 1 | 2 | 3 |
| 491 | $CH_3$—$(CH_2)_{10}$— | $CH_3$— | $CH_3$— | 1 | 1 | 3 | 2 |
| 492 | $CH_3$—$(CH_2)_{10}$— | $CH_3$— | $CH_3$— | 1 | 2 | 3 | 1 |
| 493 | $CH_3$—$(CH_2)_{10}$— | $CH_3$— | $CH_3$— | 1 | 3 | 2 | 1 |
| 494 | $CH_3$—$(CH_2)_{10}$— | $CH_3$— | $CH_3$— | 1 | 2 | 1 | 3 |
| 495 | $CH_3$—$(CH_2)_{10}$— | $CH_3$— | $CH_3$— | 1 | 3 | 1 | 2 |
| 496 | $CH_3$—$(CH_2)_{10}$— | $CH_3$— | $CH_3$— | 2 | 1 | 1 | 3 |
| 497 | $CH_3$—$(CH_2)_{10}$— | $CH_3$— | $CH_3$— | 2 | 1 | 3 | 1 |
| 498 | $CH_3$—$(CH_2)_{10}$— | $CH_3$— | $CH_3$— | 2 | 3 | 1 | 1 |
| 499 | $CH_3$—$(CH_2)_{10}$— | $CH_3$— | $CH_3$— | 3 | 1 | 1 | 2 |
| 500 | $CH_3$—$(CH_2)_{10}$— | $CH_3$— | $CH_3$— | 3 | 1 | 2 | 1 |
| 501 | $CH_3$—$(CH_2)_{10}$— | $CH_3$— | $CH_3$— | 3 | 2 | 1 | 1 |
| 502 | $CH_3$—$(CH_2)_{10}$— | $CH_3$— | $CH_3$— | 1 | 1 | 2 | 4 |
| 503 | $CH_3$—$(CH_2)_{10}$— | $CH_3$— | $CH_3$— | 1 | 1 | 4 | 2 |
| 504 | $CH_3$—$(CH_2)_{10}$— | $CH_3$— | $CH_3$— | 1 | 2 | 4 | 1 |
| 505 | $CH_3$—$(CH_2)_{10}$— | $CH_3$— | $CH_3$— | 1 | 4 | 2 | 1 |
| 506 | $CH_3$—$(CH_2)_{10}$— | $CH_3$— | $CH_3$— | 1 | 2 | 1 | 4 |
| 507 | $CH_3$—$(CH_2)_{10}$— | $CH_3$— | $CH_3$— | 1 | 4 | 1 | 2 |
| 508 | $CH_3$—$(CH_2)_{10}$— | $CH_3$— | $CH_3$— | 2 | 1 | 1 | 4 |
| 509 | $CH_3$—$(CH_2)_{10}$— | $CH_3$— | $CH_3$— | 2 | 1 | 4 | 1 |
| 510 | $CH_3$—$(CH_2)_{10}$— | $CH_3$— | $CH_3$— | 2 | 4 | 1 | 1 |
| 511 | $CH_3$—$(CH_2)_{10}$— | $CH_3$— | $CH_3$— | 4 | 1 | 1 | 2 |
| 512 | $CH_3$—$(CH_2)_{10}$— | $CH_3$— | $CH_3$— | 4 | 1 | 2 | 1 |
| 513 | $CH_3$—$(CH_2)_{10}$— | $CH_3$— | $CH_3$— | 4 | 2 | 1 | 1 |
| 514 | $CH_3$—$(CH_2)_{10}$— | $CH_3$— | $CH_3$— | 1 | 1 | 4 | 3 |
| 515 | $CH_3$—$(CH_2)_{10}$— | $CH_3$— | $CH_3$— | 1 | 1 | 3 | 4 |
| 516 | $CH_3$—$(CH_2)_{10}$— | $CH_3$— | $CH_3$— | 1 | 4 | 3 | 1 |
| 517 | $CH_3$—$(CH_2)_{10}$— | $CH_3$— | $CH_3$— | 1 | 3 | 4 | 1 |
| 518 | $CH_3$—$(CH_2)_{10}$— | $CH_3$— | $CH_3$— | 1 | 4 | 1 | 3 |
| 519 | $CH_3$—$(CH_2)_{10}$— | $CH_3$— | $CH_3$— | 1 | 3 | 1 | 4 |
| 520 | $CH_3$—$(CH_2)_{10}$— | $CH_3$— | $CH_3$— | 4 | 1 | 1 | 3 |
| 521 | $CH_3$—$(CH_2)_{10}$— | $CH_3$— | $CH_3$— | 4 | 1 | 3 | 1 |
| 522 | $CH_3$—$(CH_2)_{10}$— | $CH_3$— | $CH_3$— | 4 | 3 | 1 | 1 |
| 523 | $CH_3$—$(CH_2)_{10}$— | $CH_3$— | $CH_3$— | 3 | 1 | 1 | 4 |
| 524 | $CH_3$—$(CH_2)_{10}$— | $CH_3$— | $CH_3$— | 3 | 1 | 4 | 1 |
| 525 | $CH_3$—$(CH_2)_{10}$— | $CH_3$— | $CH_3$— | 3 | 4 | 1 | 1 |
| 526 | $CH_3$—$(CH_2)_{10}$— | $CH_3$— | $CH_3$— | 1 | 2 | 2 | 2 |
| 527 | $CH_3$—$(CH_2)_{10}$— | $CH_3$— | $CH_3$— | 2 | 1 | 2 | 2 |
| 528 | $CH_3$—$(CH_2)_{10}$— | $CH_3$— | $CH_3$— | 2 | 2 | 1 | 2 |
| 529 | $CH_3$—$(CH_2)_{10}$— | $CH_3$— | $CH_3$— | 2 | 2 | 2 | 1 |
| 530 | $CH_3$—$(CH_2)_{10}$— | $CH_3$— | $CH_3$— | 1 | 3 | 3 | 3 |
| 531 | $CH_3$—$(CH_2)_{10}$— | $CH_3$— | $CH_3$— | 3 | 1 | 3 | 3 |
| 532 | $CH_3$—$(CH_2)_{10}$— | $CH_3$— | $CH_3$— | 3 | 3 | 1 | 3 |
| 533 | $CH_3$—$(CH_2)_{10}$— | $CH_3$— | $CH_3$— | 3 | 3 | 3 | 1 |
| 534 | $CH_3$—$(CH_2)_{10}$— | $CH_3$— | $CH_3$— | 1 | 4 | 4 | 4 |
| 535 | $CH_3$—$(CH_2)_{10}$— | $CH_3$— | $CH_3$— | 4 | 1 | 4 | 4 |
| 536 | $CH_3$—$(CH_2)_{10}$— | $CH_3$— | $CH_3$— | 4 | 4 | 1 | 4 |
| 537 | $CH_3$—$(CH_2)_{10}$— | $CH_3$— | $CH_3$— | 4 | 4 | 4 | 1 |
| 538 | $CH_3$—$(CH_2)_{10}$— | $CH_3$— | $CH_3$— | 2 | 2 | 1 | 3 |
| 539 | $CH_3$—$(CH_2)_{10}$— | $CH_3$— | $CH_3$— | 2 | 2 | 3 | 1 |
| 540 | $CH_3$—$(CH_2)_{10}$— | $CH_3$— | $CH_3$— | 2 | 1 | 2 | 3 |
| 541 | $CH_3$—$(CH_2)_{10}$— | $CH_3$— | $CH_3$— | 2 | 3 | 2 | 1 |
| 542 | $CH_3$—$(CH_2)_{10}$— | $CH_3$— | $CH_3$— | 2 | 1 | 3 | 2 |
| 543 | $CH_3$—$(CH_2)_{10}$— | $CH_3$— | $CH_3$— | 2 | 3 | 1 | 2 |
| 544 | $CH_3$—$(CH_2)_{10}$— | $CH_3$— | $CH_3$— | 1 | 2 | 2 | 3 |
| 545 | $CH_3$—$(CH_2)_{10}$— | $CH_3$— | $CH_3$— | 1 | 2 | 3 | 2 |
| 546 | $CH_3$—$(CH_2)_{10}$— | $CH_3$— | $CH_3$— | 1 | 3 | 2 | 2 |
| 547 | $CH_3$—$(CH_2)_{10}$— | $CH_3$— | $CH_3$— | 3 | 2 | 2 | 1 |
| 548 | $CH_3$—$(CH_2)_{10}$— | $CH_3$— | $CH_3$— | 3 | 2 | 1 | 2 |
| 549 | $CH_3$—$(CH_2)_{10}$— | $CH_3$— | $CH_3$— | 3 | 1 | 2 | 2 |
| 550 | $CH_3$—$(CH_2)_{10}$— | $CH_3$— | $CH_3$— | 2 | 2 | 1 | 4 |
| 551 | $CH_3$—$(CH_2)_{10}$— | $CH_3$— | $CH_3$— | 2 | 2 | 4 | 1 |
| 552 | $CH_3$—$(CH_2)_{10}$— | $CH_3$— | $CH_3$— | 2 | 1 | 2 | 4 |
| 553 | $CH_3$—$(CH_2)_{10}$— | $CH_3$— | $CH_3$— | 2 | 4 | 2 | 1 |
| 554 | $CH_3$—$(CH_2)_{10}$— | $CH_3$— | $CH_3$— | 2 | 1 | 4 | 2 |
| 555 | $CH_3$—$(CH_2)_{10}$— | $CH_3$— | $CH_3$— | 2 | 4 | 1 | 2 |
| 556 | $CH_3$—$(CH_2)_{10}$— | $CH_3$— | $CH_3$— | 1 | 2 | 2 | 4 |
| 557 | $CH_3$—$(CH_2)_{10}$— | $CH_3$— | $CH_3$— | 1 | 2 | 4 | 2 |
| 558 | $CH_3$—$(CH_2)_{10}$— | $CH_3$— | $CH_3$— | 1 | 4 | 2 | 2 |
| 559 | $CH_3$—$(CH_2)_{10}$— | $CH_3$— | $CH_3$— | 4 | 2 | 2 | 1 |
| 560 | $CH_3$—$(CH_2)_{10}$— | $CH_3$— | $CH_3$— | 4 | 2 | 1 | 2 |

-continued

| No. | $R^1$ | $R^2$ | $R^3$ | w | x | y | z |
|---|---|---|---|---|---|---|---|
| 561 | $CH_3$—$(CH_2)_{10}$— | $CH_3$— | $CH_3$— | 4 | 1 | 2 | 2 |
| 562 | $CH_3$—$(CH_2)_{10}$— | $CH_3$— | $CH_3$— | 2 | 2 | 4 | 3 |
| 563 | $CH_3$—$(CH_2)_{10}$— | $CH_3$— | $CH_3$— | 2 | 2 | 3 | 4 |
| 564 | $CH_3$—$(CH_2)_{10}$— | $CH_3$— | $CH_3$— | 2 | 4 | 2 | 3 |
| 565 | $CH_3$—$(CH_2)_{10}$— | $CH_3$— | $CH_3$— | 2 | 3 | 2 | 4 |
| 566 | $CH_3$—$(CH_2)_{10}$— | $CH_3$— | $CH_3$— | 2 | 4 | 3 | 2 |
| 567 | $CH_3$—$(CH_2)_{10}$— | $CH_3$— | $CH_3$— | 2 | 3 | 4 | 2 |
| 568 | $CH_3$—$(CH_2)_{10}$— | $CH_3$— | $CH_3$— | 4 | 2 | 2 | 3 |
| 569 | $CH_3$—$(CH_2)_{10}$— | $CH_3$— | $CH_3$— | 4 | 2 | 3 | 2 |
| 570 | $CH_3$—$(CH_2)_{10}$— | $CH_3$— | $CH_3$— | 4 | 3 | 2 | 2 |
| 571 | $CH_3$—$(CH_2)_{10}$— | $CH_3$— | $CH_3$— | 3 | 2 | 2 | 4 |
| 572 | $CH_3$—$(CH_2)_{10}$— | $CH_3$— | $CH_3$— | 3 | 2 | 4 | 2 |
| 573 | $CH_3$—$(CH_2)_{10}$— | $CH_3$— | $CH_3$— | 3 | 4 | 2 | 2 |
| 574 | $CH_3$—$(CH_2)_{10}$— | $CH_3$— | $CH_3$— | 3 | 3 | 1 | 2 |
| 575 | $CH_3$—$(CH_2)_{10}$— | $CH_3$— | $CH_3$— | 3 | 3 | 2 | 1 |
| 576 | $CH_3$—$(CH_2)_{10}$— | $CH_3$— | $CH_3$— | 3 | 1 | 3 | 2 |
| 577 | $CH_3$—$(CH_2)_{10}$— | $CH_3$— | $CH_3$— | 3 | 2 | 3 | 1 |
| 578 | $CH_3$—$(CH_2)_{10}$— | $CH_3$— | $CH_3$— | 3 | 1 | 2 | 3 |
| 579 | $CH_3$—$(CH_2)_{10}$— | $CH_3$— | $CH_3$— | 3 | 2 | 1 | 3 |
| 580 | $CH_3$—$(CH_2)_{10}$— | $CH_3$— | $CH_3$— | 1 | 3 | 3 | 2 |
| 581 | $CH_3$—$(CH_2)_{10}$— | $CH_3$— | $CH_3$— | 1 | 3 | 2 | 3 |
| 582 | $CH_3$—$(CH_2)_{10}$— | $CH_3$— | $CH_3$— | 1 | 2 | 3 | 3 |
| 583 | $CH_3$—$(CH_2)_{10}$— | $CH_3$— | $CH_3$— | 2 | 3 | 3 | 1 |
| 584 | $CH_3$—$(CH_2)_{10}$— | $CH_3$— | $CH_3$— | 2 | 3 | 1 | 3 |
| 585 | $CH_3$—$(CH_2)_{10}$— | $CH_3$— | $CH_3$— | 2 | 1 | 3 | 3 |
| 586 | $CH_3$—$(CH_2)_{10}$— | $CH_3$— | $CH_3$— | 3 | 3 | 1 | 4 |
| 587 | $CH_3$—$(CH_2)_{10}$— | $CH_3$— | $CH_3$— | 3 | 3 | 4 | 1 |
| 588 | $CH_3$—$(CH_2)_{10}$— | $CH_3$— | $CH_3$— | 3 | 1 | 3 | 4 |
| 589 | $CH_3$—$(CH_2)_{10}$— | $CH_3$— | $CH_3$— | 3 | 4 | 3 | 1 |
| 590 | $CH_3$—$(CH_2)_{10}$— | $CH_3$— | $CH_3$— | 3 | 1 | 4 | 3 |
| 591 | $CH_3$—$(CH_2)_{10}$— | $CH_3$— | $CH_3$— | 3 | 4 | 1 | 3 |
| 592 | $CH_3$—$(CH_2)_{10}$— | $CH_3$— | $CH_3$— | 1 | 3 | 3 | 4 |
| 593 | $CH_3$—$(CH_2)_{10}$— | $CH_3$— | $CH_3$— | 1 | 3 | 4 | 3 |
| 594 | $CH_3$—$(CH_2)_{10}$— | $CH_3$— | $CH_3$— | 1 | 4 | 3 | 3 |
| 595 | $CH_3$—$(CH_2)_{10}$— | $CH_3$— | $CH_3$— | 4 | 3 | 3 | 1 |
| 596 | $CH_3$—$(CH_2)_{10}$— | $CH_3$— | $CH_3$— | 4 | 3 | 1 | 3 |
| 597 | $CH_3$—$(CH_2)_{10}$— | $CH_3$— | $CH_3$— | 4 | 1 | 3 | 3 |
| 598 | $CH_3$—$(CH_2)_{10}$— | $CH_3$— | $CH_3$— | 3 | 3 | 4 | 2 |
| 599 | $CH_3$—$(CH_2)_{10}$— | $CH_3$— | $CH_3$— | 3 | 3 | 2 | 4 |
| 600 | $CH_3$—$(CH_2)_{10}$— | $CH_3$— | $CH_3$— | 3 | 4 | 3 | 2 |
| 601 | $CH_3$—$(CH_2)_{10}$— | $CH_3$— | $CH_3$— | 3 | 2 | 3 | 4 |
| 602 | $CH_3$—$(CH_2)_{10}$— | $CH_3$— | $CH_3$— | 3 | 4 | 2 | 3 |
| 603 | $CH_3$—$(CH_2)_{10}$— | $CH_3$— | $CH_3$— | 3 | 2 | 4 | 3 |
| 604 | $CH_3$—$(CH_2)_{10}$— | $CH_3$— | $CH_3$— | 4 | 3 | 3 | 2 |
| 605 | $CH_3$—$(CH_2)_{10}$— | $CH_3$— | $CH_3$— | 4 | 3 | 2 | 3 |
| 606 | $CH_3$—$(CH_2)_{10}$— | $CH_3$— | $CH_3$— | 4 | 2 | 3 | 3 |
| 607 | $CH_3$—$(CH_2)_{10}$— | $CH_3$— | $CH_3$— | 2 | 3 | 3 | 4 |
| 608 | $CH_3$—$(CH_2)_{10}$— | $CH_3$— | $CH_3$— | 2 | 3 | 4 | 3 |
| 609 | $CH_3$—$(CH_2)_{10}$— | $CH_3$— | $CH_3$— | 2 | 4 | 3 | 3 |
| 610 | $CH_3$—$(CH_2)_{10}$— | $CH_3$— | $CH_3$— | 4 | 4 | 1 | 2 |
| 611 | $CH_3$—$(CH_2)_{10}$— | $CH_3$— | $CH_3$— | 4 | 4 | 2 | 1 |
| 612 | $CH_3$—$(CH_2)_{10}$— | $CH_3$— | $CH_3$— | 4 | 1 | 4 | 2 |
| 613 | $CH_3$—$(CH_2)_{10}$— | $CH_3$— | $CH_3$— | 4 | 2 | 4 | 1 |
| 614 | $CH_3$—$(CH_2)_{10}$— | $CH_3$— | $CH_3$— | 4 | 1 | 2 | 4 |
| 615 | $CH_3$—$(CH_2)_{10}$— | $CH_3$— | $CH_3$— | 4 | 2 | 1 | 4 |
| 616 | $CH_3$—$(CH_2)_{10}$— | $CH_3$— | $CH_3$— | 1 | 4 | 4 | 2 |
| 617 | $CH_3$—$(CH_2)_{10}$— | $CH_3$— | $CH_3$— | 1 | 4 | 2 | 4 |
| 618 | $CH_3$—$(CH_2)_{10}$— | $CH_3$— | $CH_3$— | 1 | 2 | 4 | 4 |
| 619 | $CH_3$—$(CH_2)_{10}$— | $CH_3$— | $CH_3$— | 2 | 4 | 4 | 1 |
| 620 | $CH_3$—$(CH_2)_{10}$— | $CH_3$— | $CH_3$— | 2 | 4 | 1 | 4 |
| 621 | $CH_3$—$(CH_2)_{10}$— | $CH_3$— | $CH_3$— | 2 | 1 | 4 | 4 |
| 622 | $CH_3$—$(CH_2)_{10}$— | $CH_3$— | $CH_3$— | 4 | 4 | 1 | 3 |
| 623 | $CH_3$—$(CH_2)_{10}$— | $CH_3$— | $CH_3$— | 4 | 4 | 3 | 1 |
| 624 | $CH_3$—$(CH_2)_{10}$— | $CH_3$— | $CH_3$— | 4 | 1 | 4 | 3 |
| 625 | $CH_3$—$(CH_2)_{10}$— | $CH_3$— | $CH_3$— | 4 | 3 | 4 | 1 |
| 626 | $CH_3$—$(CH_2)_{10}$— | $CH_3$— | $CH_3$— | 4 | 1 | 3 | 4 |
| 627 | $CH_3$—$(CH_2)_{10}$— | $CH_3$— | $CH_3$— | 4 | 3 | 1 | 4 |
| 628 | $CH_3$—$(CH_2)_{10}$— | $CH_3$— | $CH_3$— | 1 | 4 | 4 | 3 |
| 629 | $CH_3$—$(CH_2)_{10}$— | $CH_3$— | $CH_3$— | 1 | 4 | 3 | 4 |
| 630 | $CH_3$—$(CH_2)_{10}$— | $CH_3$— | $CH_3$— | 1 | 3 | 4 | 4 |
| 631 | $CH_3$—$(CH_2)_{10}$— | $CH_3$— | $CH_3$— | 3 | 4 | 4 | 1 |
| 632 | $CH_3$—$(CH_2)_{10}$— | $CH_3$— | $CH_3$— | 3 | 4 | 1 | 4 |
| 633 | $CH_3$—$(CH_2)_{10}$— | $CH_3$— | $CH_3$— | 3 | 1 | 4 | 4 |
| 634 | $CH_3$—$(CH_2)_{10}$— | $CH_3$— | $CH_3$— | 4 | 4 | 3 | 2 |
| 635 | $CH_3$—$(CH_2)_{10}$— | $CH_3$— | $CH_3$— | 4 | 4 | 2 | 3 |
| 636 | $CH_3$—$(CH_2)_{10}$— | $CH_3$— | $CH_3$— | 4 | 3 | 4 | 2 |
| 637 | $CH_3$—$(CH_2)_{10}$— | $CH_3$— | $CH_3$— | 4 | 2 | 4 | 3 |

-continued

| No. | $R^1$ | $R^2$ | $R^3$ | w | x | y | z |
|---|---|---|---|---|---|---|---|
| 638 | $CH_3$—$(CH_2)_{10}$— | $CH_3$— | $CH_3$— | 4 | 3 | 2 | 4 |
| 639 | $CH_3$—$(CH_2)_{10}$— | $CH_3$— | $CH_3$— | 4 | 2 | 3 | 4 |
| 640 | $CH_3$—$(CH_2)_{10}$— | $CH_3$— | $CH_3$— | 3 | 4 | 4 | 2 |
| 641 | $CH_3$—$(CH_2)_{10}$— | $CH_3$— | $CH_3$— | 3 | 4 | 2 | 4 |
| 642 | $CH_3$—$(CH_2)_{10}$— | $CH_3$— | $CH_3$— | 3 | 2 | 4 | 4 |
| 643 | $CH_3$—$(CH_2)_{10}$— | $CH_3$— | $CH_3$— | 2 | 4 | 4 | 3 |
| 644 | $CH_3$—$(CH_2)_{10}$— | $CH_3$— | $CH_3$— | 2 | 4 | 3 | 4 |
| 645 | $CH_3$—$(CH_2)_{10}$— | $CH_3$— | $CH_3$— | 2 | 3 | 4 | 4 |
| 646 | $CH_3$—$(CH_2)_{10}$— | $CH_3$— | $CH_3$— | 1 | 2 | 3 | 4 |
| 647 | $CH_3$—$(CH_2)_{10}$— | $CH_3$— | $CH_3$— | 1 | 2 | 4 | 3 |
| 648 | $CH_3$—$(CH_2)_{10}$— | $CH_3$— | $CH_3$— | 1 | 3 | 2 | 4 |
| 649 | $CH_3$—$(CH_2)_{10}$— | $CH_3$— | $CH_3$— | 1 | 3 | 4 | 2 |
| 650 | $CH_3$—$(CH_2)_{10}$— | $CH_3$— | $CH_3$— | 1 | 4 | 2 | 3 |
| 651 | $CH_3$—$(CH_2)_{10}$— | $CH_3$— | $CH_3$— | 1 | 4 | 3 | 2 |
| 652 | $CH_3$—$(CH_2)_{10}$— | $CH_3$— | $CH_3$— | 2 | 1 | 3 | 4 |
| 653 | $CH_3$—$(CH_2)_{10}$— | $CH_3$— | $CH_3$— | 2 | 1 | 4 | 3 |
| 654 | $CH_3$—$(CH_2)_{10}$— | $CH_3$— | $CH_3$— | 2 | 3 | 1 | 4 |
| 655 | $CH_3$—$(CH_2)_{10}$— | $CH_3$— | $CH_3$— | 2 | 3 | 4 | 1 |
| 656 | $CH_3$—$(CH_2)_{10}$— | $CH_3$— | $CH_3$— | 2 | 4 | 1 | 3 |
| 657 | $CH_3$—$(CH_2)_{10}$— | $CH_3$— | $CH_3$— | 2 | 4 | 3 | 1 |
| 658 | $CH_3$—$(CH_2)_{10}$— | $CH_3$— | $CH_3$— | 3 | 1 | 2 | 4 |
| 659 | $CH_3$—$(CH_2)_{10}$— | $CH_3$— | $CH_3$— | 3 | 1 | 4 | 2 |
| 660 | $CH_3$—$(CH_2)_{10}$— | $CH_3$— | $CH_3$— | 3 | 2 | 1 | 4 |
| 661 | $CH_3$—$(CH_2)_{10}$— | $CH_3$— | $CH_3$— | 3 | 2 | 4 | 1 |
| 662 | $CH_3$—$(CH_2)_{10}$— | $CH_3$— | $CH_3$— | 3 | 4 | 1 | 2 |
| 663 | $CH_3$—$(CH_2)_{10}$— | $CH_3$— | $CH_3$— | 3 | 4 | 2 | 1 |
| 664 | $CH_3$—$(CH_2)_{10}$— | $CH_3$— | $CH_3$— | 4 | 1 | 2 | 3 |
| 665 | $CH_3$—$(CH_2)_{10}$— | $CH_3$— | $CH_3$— | 4 | 1 | 3 | 2 |
| 666 | $CH_3$—$(CH_2)_{10}$— | $CH_3$— | $CH_3$— | 4 | 2 | 1 | 3 |
| 667 | $CH_3$—$(CH_2)_{10}$— | $CH_3$— | $CH_3$— | 4 | 2 | 3 | 1 |
| 668 | $CH_3$—$(CH_2)_{10}$— | $CH_3$— | $CH_3$— | 4 | 3 | 1 | 2 |
| 669 | $CH_3$—$(CH_2)_{10}$— | $CH_3$— | $CH_3$— | 4 | 3 | 2 | 1 |
| 670 | $CH_3$—$(CH_2)_{10}$— | $CH_3$— | $CH_3$— | 2 | 3 | 3 | 2 |
| 671 | $CH_3$—$(CH_2)_{10}$— | $CH_3$— | $CH_3$— | 2 | 3 | 2 | 3 |
| 672 | $CH_3$—$(CH_2)_{10}$— | $CH_3$— | $CH_3$— | 2 | 2 | 3 | 3 |
| 673 | $CH_3$—$(CH_2)_{10}$— | $CH_3$— | $CH_3$— | 3 | 3 | 2 | 2 |
| 674 | $CH_3$—$(CH_2)_{10}$— | $CH_3$— | $CH_3$— | 3 | 2 | 3 | 2 |
| 675 | $CH_3$—$(CH_2)_{10}$— | $CH_3$— | $CH_3$— | 3 | 2 | 2 | 3 |
| 676 | $CH_3$—$(CH_2)_{10}$— | $CH_3$— | $CH_3$— | 2 | 4 | 4 | 2 |
| 677 | $CH_3$—$(CH_2)_{10}$— | $CH_3$— | $CH_3$— | 2 | 4 | 2 | 4 |
| 678 | $CH_3$—$(CH_2)_{10}$— | $CH_3$— | $CH_3$— | 2 | 2 | 4 | 4 |
| 679 | $CH_3$—$(CH_2)_{10}$— | $CH_3$— | $CH_3$— | 4 | 4 | 2 | 2 |
| 680 | $CH_3$—$(CH_2)_{10}$— | $CH_3$— | $CH_3$— | 4 | 2 | 4 | 2 |
| 681 | $CH_3$—$(CH_2)_{10}$— | $CH_3$— | $CH_3$— | 4 | 2 | 2 | 4 |
| 682 | $CH_3$—$(CH_2)_{10}$— | $CH_3$— | $CH_3$— | 3 | 4 | 4 | 3 |
| 683 | $CH_3$—$(CH_2)_{10}$— | $CH_3$— | $CH_3$— | 3 | 4 | 3 | 4 |
| 684 | $CH_3$—$(CH_2)_{10}$— | $CH_3$— | $CH_3$— | 3 | 3 | 4 | 4 |
| 685 | $CH_3$—$(CH_2)_{10}$— | $CH_3$— | $CH_3$— | 4 | 4 | 3 | 3 |
| 686 | $CH_3$—$(CH_2)_{10}$— | $CH_3$— | $CH_3$— | 4 | 3 | 4 | 3 |
| 687 | $CH_3$—$(CH_2)_{10}$— | $CH_3$— | $CH_3$— | 4 | 3 | 3 | 4 |
| 688 | $CH_3$—$(CH_2)_{11}$— | $CH_3$— | $CH_3$— | 1 | 1 | 1 | 1 |
| 689 | $CH_3$—$(CH_2)_{11}$— | $CH_3$— | $CH_3$— | 2 | 1 | 1 | 1 |
| 690 | $CH_3$—$(CH_2)_{11}$— | $CH_3$— | $CH_3$— | 1 | 2 | 1 | 1 |
| 691 | $CH_3$—$(CH_2)_{11}$— | $CH_3$— | $CH_3$— | 1 | 1 | 2 | 1 |
| 692 | $CH_3$—$(CH_2)_{11}$— | $CH_3$— | $CH_3$— | 1 | 1 | 1 | 2 |
| 693 | $CH_3$—$(CH_2)_{11}$— | $CH_3$— | $CH_3$— | 3 | 1 | 1 | 1 |
| 694 | $CH_3$—$(CH_2)_{11}$— | $CH_3$— | $CH_3$— | 1 | 3 | 1 | 1 |
| 695 | $CH_3$—$(CH_2)_{11}$— | $CH_3$— | $CH_3$— | 1 | 1 | 3 | 1 |
| 696 | $CH_3$—$(CH_2)_{11}$— | $CH_3$— | $CH_3$— | 1 | 1 | 1 | 3 |
| 697 | $CH_3$—$(CH_2)_{11}$— | $CH_3$— | $CH_3$— | 4 | 1 | 1 | 1 |
| 698 | $CH_3$—$(CH_2)_{11}$— | $CH_3$— | $CH_3$— | 1 | 4 | 1 | 1 |
| 699 | $CH_3$—$(CH_2)_{11}$— | $CH_3$— | $CH_3$— | 1 | 1 | 4 | 1 |
| 700 | $CH_3$—$(CH_2)_{11}$— | $CH_3$— | $CH_3$— | 1 | 1 | 1 | 4 |
| 701 | $CH_3$—$(CH_2)_{11}$— | $CH_3$— | $CH_3$— | 1 | 2 | 2 | 1 |
| 702 | $CH_3$—$(CH_2)_{11}$— | $CH_3$— | $CH_3$— | 1 | 2 | 1 | 2 |
| 703 | $CH_3$—$(CH_2)_{11}$— | $CH_3$— | $CH_3$— | 1 | 1 | 2 | 2 |
| 704 | $CH_3$—$(CH_2)_{11}$— | $CH_3$— | $CH_3$— | 2 | 2 | 1 | 1 |
| 705 | $CH_3$—$(CH_2)_{11}$— | $CH_3$— | $CH_3$— | 2 | 1 | 2 | 1 |
| 706 | $CH_3$—$(CH_2)_{11}$— | $CH_3$— | $CH_3$— | 2 | 1 | 1 | 2 |
| 707 | $CH_3$—$(CH_2)_{11}$— | $CH_3$— | $CH_3$— | 1 | 3 | 3 | 1 |
| 708 | $CH_3$—$(CH_2)_{11}$— | $CH_3$— | $CH_3$— | 1 | 3 | 1 | 3 |
| 709 | $CH_3$—$(CH_2)_{11}$— | $CH_3$— | $CH_3$— | 1 | 1 | 3 | 3 |
| 710 | $CH_3$—$(CH_2)_{11}$— | $CH_3$— | $CH_3$— | 3 | 3 | 1 | 1 |
| 711 | $CH_3$—$(CH_2)_{11}$— | $CH_3$— | $CH_3$— | 3 | 1 | 3 | 1 |
| 712 | $CH_3$—$(CH_2)_{11}$— | $CH_3$— | $CH_3$— | 3 | 1 | 1 | 3 |
| 713 | $CH_3$—$(CH_2)_{11}$— | $CH_3$— | $CH_3$— | 1 | 4 | 4 | 1 |
| 714 | $CH_3$—$(CH_2)_{11}$— | $CH_3$— | $CH_3$— | 1 | 4 | 1 | 4 |

-continued

| No. | $R^1$ | $R^2$ | $R^3$ | w | x | y | z |
|---|---|---|---|---|---|---|---|
| 715 | $CH_3$—$(CH_2)_{11}$— | $CH_3$— | $CH_3$— | 1 | 1 | 4 | 4 |
| 716 | $CH_3$—$(CH_2)_{11}$— | $CH_3$— | $CH_3$— | 4 | 4 | 1 | 1 |
| 717 | $CH_3$—$(CH_2)_{11}$— | $CH_3$— | $CH_3$— | 4 | 1 | 4 | 1 |
| 718 | $CH_3$—$(CH_2)_{11}$— | $CH_3$— | $CH_3$— | 4 | 1 | 1 | 4 |
| 719 | $CH_3$—$(CH_2)_{11}$— | $CH_3$— | $CH_3$— | 1 | 1 | 2 | 3 |
| 720 | $CH_3$—$(CH_2)_{11}$— | $CH_3$— | $CH_3$— | 1 | 1 | 3 | 2 |
| 721 | $CH_3$—$(CH_2)_{11}$— | $CH_3$— | $CH_3$— | 1 | 2 | 3 | 1 |
| 722 | $CH_3$—$(CH_2)_{11}$— | $CH_3$— | $CH_3$— | 1 | 3 | 2 | 1 |
| 723 | $CH_3$—$(CH_2)_{11}$— | $CH_3$— | $CH_3$— | 1 | 2 | 1 | 3 |
| 724 | $CH_3$—$(CH_2)_{11}$— | $CH_3$— | $CH_3$— | 1 | 3 | 1 | 2 |
| 725 | $CH_3$—$(CH_2)_{11}$— | $CH_3$— | $CH_3$— | 2 | 1 | 1 | 3 |
| 726 | $CH_3$—$(CH_2)_{11}$— | $CH_3$— | $CH_3$— | 2 | 1 | 3 | 1 |
| 727 | $CH_3$—$(CH_2)_{11}$— | $CH_3$— | $CH_3$— | 2 | 3 | 1 | 1 |
| 728 | $CH_3$—$(CH_2)_{11}$— | $CH_3$— | $CH_3$— | 3 | 1 | 1 | 2 |
| 729 | $CH_3$—$(CH_2)_{11}$— | $CH_3$— | $CH_3$— | 3 | 1 | 2 | 1 |
| 730 | $CH_3$—$(CH_2)_{11}$— | $CH_3$— | $CH_3$— | 3 | 2 | 1 | 1 |
| 731 | $CH_3$—$(CH_2)_{11}$— | $CH_3$— | $CH_3$— | 1 | 1 | 2 | 4 |
| 732 | $CH_3$—$(CH_2)_{11}$— | $CH_3$— | $CH_3$— | 1 | 1 | 4 | 2 |
| 733 | $CH_3$—$(CH_2)_{11}$— | $CH_3$— | $CH_3$— | 1 | 2 | 4 | 1 |
| 734 | $CH_3$—$(CH_2)_{11}$— | $CH_3$— | $CH_3$— | 1 | 4 | 2 | 1 |
| 735 | $CH_3$—$(CH_2)_{11}$— | $CH_3$— | $CH_3$— | 1 | 2 | 1 | 4 |
| 736 | $CH_3$—$(CH_2)_{11}$— | $CH_3$— | $CH_3$— | 1 | 4 | 1 | 2 |
| 737 | $CH_3$—$(CH_2)_{11}$— | $CH_3$— | $CH_3$— | 2 | 1 | 1 | 4 |
| 738 | $CH_3$—$(CH_2)_{11}$— | $CH_3$— | $CH_3$— | 2 | 1 | 4 | 1 |
| 739 | $CH_3$—$(CH_2)_{11}$— | $CH_3$— | $CH_3$— | 2 | 4 | 1 | 1 |
| 740 | $CH_3$—$(CH_2)_{11}$— | $CH_3$— | $CH_3$— | 4 | 1 | 1 | 2 |
| 741 | $CH_3$—$(CH_2)_{11}$— | $CH_3$— | $CH_3$— | 4 | 1 | 2 | 1 |
| 742 | $CH_3$—$(CH_2)_{11}$— | $CH_3$— | $CH_3$— | 4 | 2 | 1 | 1 |
| 743 | $CH_3$—$(CH_2)_{11}$— | $CH_3$— | $CH_3$— | 1 | 1 | 4 | 3 |
| 744 | $CH_3$—$(CH_2)_{11}$— | $CH_3$— | $CH_3$— | 1 | 1 | 3 | 4 |
| 745 | $CH_3$—$(CH_2)_{11}$— | $CH_3$— | $CH_3$— | 1 | 4 | 3 | 1 |
| 746 | $CH_3$—$(CH_2)_{11}$— | $CH_3$— | $CH_3$— | 1 | 3 | 4 | 1 |
| 747 | $CH_3$—$(CH_2)_{11}$— | $CH_3$— | $CH_3$— | 1 | 4 | 1 | 3 |
| 748 | $CH_3$—$(CH_2)_{11}$— | $CH_3$— | $CH_3$— | 1 | 3 | 1 | 4 |
| 749 | $CH_3$—$(CH_2)_{11}$— | $CH_3$— | $CH_3$— | 4 | 1 | 1 | 3 |
| 750 | $CH_3$—$(CH_2)_{11}$— | $CH_3$— | $CH_3$— | 4 | 1 | 3 | 1 |
| 751 | $CH_3$—$(CH_2)_{11}$— | $CH_3$— | $CH_3$— | 4 | 3 | 1 | 1 |
| 752 | $CH_3$—$(CH_2)_{11}$— | $CH_3$— | $CH_3$— | 3 | 1 | 1 | 4 |
| 753 | $CH_3$—$(CH_2)_{11}$— | $CH_3$— | $CH_3$— | 3 | 1 | 4 | 1 |
| 754 | $CH_3$—$(CH_2)_{11}$— | $CH_3$— | $CH_3$— | 3 | 4 | 1 | 1 |
| 755 | $CH_3$—$(CH_2)_{11}$— | $CH_3$— | $CH_3$— | 1 | 2 | 2 | 2 |
| 756 | $CH_3$—$(CH_2)_{11}$— | $CH_3$— | $CH_3$— | 2 | 1 | 2 | 2 |
| 757 | $CH_3$—$(CH_2)_{11}$— | $CH_3$— | $CH_3$— | 2 | 2 | 1 | 2 |
| 758 | $CH_3$—$(CH_2)_{11}$— | $CH_3$— | $CH_3$— | 2 | 2 | 2 | 1 |
| 759 | $CH_3$—$(CH_2)_{11}$— | $CH_3$— | $CH_3$— | 1 | 3 | 3 | 3 |
| 760 | $CH_3$—$(CH_2)_{11}$— | $CH_3$— | $CH_3$— | 3 | 1 | 3 | 3 |
| 761 | $CH_3$—$(CH_2)_{11}$— | $CH_3$— | $CH_3$— | 3 | 3 | 1 | 3 |
| 762 | $CH_3$—$(CH_2)_{11}$— | $CH_3$— | $CH_3$— | 3 | 3 | 3 | 1 |
| 763 | $CH_3$—$(CH_2)_{11}$— | $CH_3$— | $CH_3$— | 1 | 4 | 4 | 4 |
| 764 | $CH_3$—$(CH_2)_{11}$— | $CH_3$— | $CH_3$— | 4 | 1 | 4 | 4 |
| 765 | $CH_3$—$(CH_2)_{11}$— | $CH_3$— | $CH_3$— | 4 | 4 | 1 | 4 |
| 766 | $CH_3$—$(CH_2)_{11}$— | $CH_3$— | $CH_3$— | 4 | 4 | 4 | 1 |
| 767 | $CH_3$—$(CH_2)_{11}$— | $CH_3$— | $CH_3$— | 2 | 2 | 1 | 3 |
| 768 | $CH_3$—$(CH_2)_{11}$— | $CH_3$— | $CH_3$— | 2 | 2 | 3 | 1 |
| 769 | $CH_3$—$(CH_2)_{11}$— | $CH_3$— | $CH_3$— | 2 | 1 | 2 | 3 |
| 770 | $CH_3$—$(CH_2)_{11}$— | $CH_3$— | $CH_3$— | 2 | 3 | 2 | 1 |
| 771 | $CH_3$—$(CH_2)_{11}$— | $CH_3$— | $CH_3$— | 2 | 1 | 3 | 2 |
| 772 | $CH_3$—$(CH_2)_{11}$— | $CH_3$— | $CH_3$— | 2 | 3 | 1 | 2 |
| 773 | $CH_3$—$(CH_2)_{11}$— | $CH_3$— | $CH_3$— | 1 | 2 | 2 | 3 |
| 774 | $CH_3$—$(CH_2)_{11}$— | $CH_3$— | $CH_3$— | 1 | 2 | 3 | 2 |
| 775 | $CH_3$—$(CH_2)_{11}$— | $CH_3$— | $CH_3$— | 1 | 3 | 2 | 2 |
| 776 | $CH_3$—$(CH_2)_{11}$— | $CH_3$— | $CH_3$— | 3 | 2 | 2 | 1 |
| 777 | $CH_3$—$(CH_2)_{11}$— | $CH_3$— | $CH_3$— | 3 | 2 | 1 | 2 |
| 778 | $CH_3$—$(CH_2)_{11}$— | $CH_3$— | $CH_3$— | 3 | 1 | 2 | 2 |
| 779 | $CH_3$—$(CH_2)_{11}$— | $CH_3$— | $CH_3$— | 2 | 2 | 1 | 4 |
| 780 | $CH_3$—$(CH_2)_{11}$— | $CH_3$— | $CH_3$— | 2 | 2 | 4 | 1 |
| 781 | $CH_3$—$(CH_2)_{11}$— | $CH_3$— | $CH_3$— | 2 | 1 | 2 | 4 |
| 782 | $CH_3$—$(CH_2)_{11}$— | $CH_3$— | $CH_3$— | 2 | 4 | 2 | 1 |
| 783 | $CH_3$—$(CH_2)_{11}$— | $CH_3$— | $CH_3$— | 2 | 1 | 4 | 2 |
| 784 | $CH_3$—$(CH_2)_{11}$— | $CH_3$— | $CH_3$— | 2 | 4 | 1 | 2 |
| 785 | $CH_3$—$(CH_2)_{11}$— | $CH_3$— | $CH_3$— | 1 | 2 | 2 | 4 |
| 786 | $CH_3$—$(CH_2)_{11}$— | $CH_3$— | $CH_3$— | 1 | 2 | 4 | 2 |
| 787 | $CH_3$—$(CH_2)_{11}$— | $CH_3$— | $CH_3$— | 1 | 4 | 2 | 2 |
| 788 | $CH_3$—$(CH_2)_{11}$— | $CH_3$— | $CH_3$— | 4 | 2 | 2 | 1 |
| 789 | $CH_3$—$(CH_2)_{11}$— | $CH_3$— | $CH_3$— | 4 | 2 | 1 | 2 |
| 790 | $CH_3$—$(CH_2)_{11}$— | $CH_3$— | $CH_3$— | 4 | 1 | 2 | 2 |
| 791 | $CH_3$—$(CH_2)_{11}$— | $CH_3$— | $CH_3$— | 2 | 2 | 4 | 3 |

-continued

| No. | $R^1$ | $R^2$ | $R^3$ | w | x | y | z |
|---|---|---|---|---|---|---|---|
| 792 | $CH_3$—$(CH_2)_{11}$— | $CH_3$— | $CH_3$— | 2 | 2 | 3 | 4 |
| 793 | $CH_3$—$(CH_2)_{11}$— | $CH_3$— | $CH_3$— | 2 | 4 | 2 | 3 |
| 794 | $CH_3$—$(CH_2)_{11}$— | $CH_3$— | $CH_3$— | 2 | 3 | 2 | 4 |
| 795 | $CH_3$—$(CH_2)_{11}$— | $CH_3$— | $CH_3$— | 2 | 4 | 3 | 2 |
| 796 | $CH_3$—$(CH_2)_{11}$— | $CH_3$— | $CH_3$— | 2 | 3 | 4 | 2 |
| 797 | $CH_3$—$(CH_2)_{11}$— | $CH_3$— | $CH_3$— | 4 | 2 | 2 | 3 |
| 798 | $CH_3$—$(CH_2)_{11}$— | $CH_3$— | $CH_3$— | 4 | 2 | 3 | 2 |
| 799 | $CH_3$—$(CH_2)_{11}$— | $CH_3$— | $CH_3$— | 4 | 3 | 2 | 2 |
| 800 | $CH_3$—$(CH_2)_{11}$— | $CH_3$— | $CH_3$— | 3 | 2 | 2 | 4 |
| 801 | $CH_3$—$(CH_2)_{11}$— | $CH_3$— | $CH_3$— | 3 | 2 | 4 | 2 |
| 802 | $CH_3$—$(CH_2)_{11}$— | $CH_3$— | $CH_3$— | 3 | 4 | 2 | 2 |
| 803 | $CH_3$—$(CH_2)_{11}$— | $CH_3$— | $CH_3$— | 3 | 3 | 1 | 2 |
| 804 | $CH_3$—$(CH_2)_{11}$— | $CH_3$— | $CH_3$— | 3 | 3 | 2 | 1 |
| 805 | $CH_3$—$(CH_2)_{11}$— | $CH_3$— | $CH_3$— | 3 | 1 | 3 | 2 |
| 806 | $CH_3$—$(CH_2)_{11}$— | $CH_3$— | $CH_3$— | 3 | 2 | 3 | 1 |
| 807 | $CH_3$—$(CH_2)_{11}$— | $CH_3$— | $CH_3$— | 3 | 1 | 2 | 3 |
| 808 | $CH_3$—$(CH_2)_{11}$— | $CH_3$— | $CH_3$— | 3 | 2 | 1 | 3 |
| 809 | $CH_3$—$(CH_2)_{11}$— | $CH_3$— | $CH_3$— | 1 | 3 | 3 | 2 |
| 810 | $CH_3$—$(CH_2)_{11}$— | $CH_3$— | $CH_3$— | 1 | 3 | 2 | 3 |
| 811 | $CH_3$—$(CH_2)_{11}$— | $CH_3$— | $CH_3$— | 1 | 2 | 3 | 3 |
| 812 | $CH_3$—$(CH_2)_{11}$— | $CH_3$— | $CH_3$— | 2 | 3 | 3 | 1 |
| 813 | $CH_3$—$(CH_2)_{11}$— | $CH_3$— | $CH_3$— | 2 | 3 | 1 | 3 |
| 814 | $CH_3$—$(CH_2)_{11}$— | $CH_3$— | $CH_3$— | 2 | 1 | 3 | 3 |
| 815 | $CH_3$—$(CH_2)_{11}$— | $CH_3$— | $CH_3$— | 3 | 3 | 1 | 4 |
| 816 | $CH_3$—$(CH_2)_{11}$— | $CH_3$— | $CH_3$— | 3 | 3 | 4 | 1 |
| 817 | $CH_3$—$(CH_2)_{11}$— | $CH_3$— | $CH_3$— | 3 | 1 | 3 | 4 |
| 818 | $CH_3$—$(CH_2)_{11}$— | $CH_3$— | $CH_3$— | 3 | 4 | 3 | 1 |
| 819 | $CH_3$—$(CH_2)_{11}$— | $CH_3$— | $CH_3$— | 3 | 1 | 4 | 3 |
| 820 | $CH_3$—$(CH_2)_{11}$— | $CH_3$— | $CH_3$— | 3 | 4 | 1 | 3 |
| 821 | $CH_3$—$(CH_2)_{11}$— | $CH_3$— | $CH_3$— | 1 | 3 | 3 | 4 |
| 822 | $CH_3$—$(CH_2)_{11}$— | $CH_3$— | $CH_3$— | 1 | 3 | 4 | 3 |
| 823 | $CH_3$—$(CH_2)_{11}$— | $CH_3$— | $CH_3$— | 1 | 4 | 3 | 3 |
| 824 | $CH_3$—$(CH_2)_{11}$— | $CH_3$— | $CH_3$— | 4 | 3 | 3 | 1 |
| 825 | $CH_3$—$(CH_2)_{11}$— | $CH_3$— | $CH_3$— | 4 | 3 | 1 | 3 |
| 826 | $CH_3$—$(CH_2)_{11}$— | $CH_3$— | $CH_3$— | 4 | 1 | 3 | 3 |
| 827 | $CH_3$—$(CH_2)_{11}$— | $CH_3$— | $CH_3$— | 3 | 3 | 4 | 2 |
| 828 | $CH_3$—$(CH_2)_{11}$— | $CH_3$— | $CH_3$— | 3 | 3 | 2 | 4 |
| 829 | $CH_3$—$(CH_2)_{11}$— | $CH_3$— | $CH_3$— | 3 | 4 | 3 | 2 |
| 830 | $CH_3$—$(CH_2)_{11}$— | $CH_3$— | $CH_3$— | 3 | 2 | 3 | 4 |
| 831 | $CH_3$—$(CH_2)_{11}$— | $CH_3$— | $CH_3$— | 3 | 4 | 2 | 3 |
| 832 | $CH_3$—$(CH_2)_{11}$— | $CH_3$— | $CH_3$— | 3 | 2 | 4 | 3 |
| 833 | $CH_3$—$(CH_2)_{11}$— | $CH_3$— | $CH_3$— | 4 | 3 | 3 | 2 |
| 834 | $CH_3$—$(CH_2)_{11}$— | $CH_3$— | $CH_3$— | 4 | 3 | 2 | 3 |
| 835 | $CH_3$—$(CH_2)_{11}$— | $CH_3$— | $CH_3$— | 4 | 2 | 3 | 3 |
| 836 | $CH_3$—$(CH_2)_{11}$— | $CH_3$— | $CH_3$— | 2 | 3 | 3 | 4 |
| 837 | $CH_3$—$(CH_2)_{11}$— | $CH_3$— | $CH_3$— | 2 | 3 | 4 | 3 |
| 838 | $CH_3$—$(CH_2)_{11}$— | $CH_3$— | $CH_3$— | 2 | 4 | 3 | 3 |
| 839 | $CH_3$—$(CH_2)_{11}$— | $CH_3$— | $CH_3$— | 4 | 4 | 1 | 2 |
| 840 | $CH_3$—$(CH_2)_{11}$— | $CH_3$— | $CH_3$— | 4 | 4 | 2 | 1 |
| 841 | $CH_3$—$(CH_2)_{11}$— | $CH_3$— | $CH_3$— | 4 | 1 | 4 | 2 |
| 842 | $CH_3$—$(CH_2)_{11}$— | $CH_3$— | $CH_3$— | 4 | 2 | 4 | 1 |
| 843 | $CH_3$—$(CH_2)_{11}$— | $CH_3$— | $CH_3$— | 4 | 1 | 2 | 4 |
| 844 | $CH_3$—$(CH_2)_{11}$— | $CH_3$— | $CH_3$— | 4 | 2 | 1 | 4 |
| 845 | $CH_3$—$(CH_2)_{11}$— | $CH_3$— | $CH_3$— | 1 | 4 | 4 | 2 |
| 846 | $CH_3$—$(CH_2)_{11}$— | $CH_3$— | $CH_3$— | 1 | 4 | 2 | 4 |
| 847 | $CH_3$—$(CH_2)_{11}$— | $CH_3$— | $CH_3$— | 1 | 2 | 4 | 4 |
| 848 | $CH_3$—$(CH_2)_{11}$— | $CH_3$— | $CH_3$— | 2 | 4 | 4 | 1 |
| 849 | $CH_3$—$(CH_2)_{11}$— | $CH_3$— | $CH_3$— | 2 | 4 | 1 | 4 |
| 850 | $CH_3$—$(CH_2)_{11}$— | $CH_3$— | $CH_3$— | 2 | 1 | 4 | 4 |
| 851 | $CH_3$—$(CH_2)_{11}$— | $CH_3$— | $CH_3$— | 4 | 4 | 1 | 3 |
| 852 | $CH_3$—$(CH_2)_{11}$— | $CH_3$— | $CH_3$— | 4 | 4 | 3 | 1 |
| 853 | $CH_3$—$(CH_2)_{11}$— | $CH_3$— | $CH_3$— | 4 | 1 | 4 | 3 |
| 854 | $CH_3$—$(CH_2)_{11}$— | $CH_3$— | $CH_3$— | 4 | 3 | 4 | 1 |
| 855 | $CH_3$—$(CH_2)_{11}$— | $CH_3$— | $CH_3$— | 4 | 1 | 3 | 4 |
| 856 | $CH_3$—$(CH_2)_{11}$— | $CH_3$— | $CH_3$— | 4 | 3 | 1 | 4 |
| 857 | $CH_3$—$(CH_2)_{11}$— | $CH_3$— | $CH_3$— | 1 | 4 | 4 | 3 |
| 858 | $CH_3$—$(CH_2)_{11}$— | $CH_3$— | $CH_3$— | 1 | 4 | 3 | 4 |
| 859 | $CH_3$—$(CH_2)_{11}$— | $CH_3$— | $CH_3$— | 1 | 3 | 4 | 4 |
| 860 | $CH_3$—$(CH_2)_{11}$— | $CH_3$— | $CH_3$— | 3 | 4 | 4 | 1 |
| 861 | $CH_3$—$(CH_2)_{11}$— | $CH_3$— | $CH_3$— | 3 | 4 | 1 | 4 |
| 862 | $CH_3$—$(CH_2)_{11}$— | $CH_3$— | $CH_3$— | 3 | 1 | 4 | 4 |
| 863 | $CH_3$—$(CH_2)_{11}$— | $CH_3$— | $CH_3$— | 4 | 4 | 3 | 2 |
| 864 | $CH_3$—$(CH_2)_{11}$— | $CH_3$— | $CH_3$— | 4 | 4 | 2 | 3 |
| 865 | $CH_3$—$(CH_2)_{11}$— | $CH_3$— | $CH_3$— | 4 | 3 | 4 | 2 |
| 866 | $CH_3$—$(CH_2)_{11}$— | $CH_3$— | $CH_3$— | 4 | 2 | 4 | 3 |
| 867 | $CH_3$—$(CH_2)_{11}$— | $CH_3$— | $CH_3$— | 4 | 3 | 2 | 4 |
| 868 | $CH_3$—$(CH_2)_{11}$— | $CH_3$— | $CH_3$— | 4 | 2 | 3 | 4 |

-continued

| No. | $R^1$ | $R^2$ | $R^3$ | w | x | y | z |
|---|---|---|---|---|---|---|---|
| 869 | $CH_3$—$(CH_2)_{11}$— | $CH_3$— | $CH_3$— | 3 | 4 | 4 | 2 |
| 870 | $CH_3$—$(CH_2)_{11}$— | $CH_3$— | $CH_3$— | 3 | 4 | 2 | 4 |
| 871 | $CH_3$—$(CH_2)_{11}$— | $CH_3$— | $CH_3$— | 3 | 2 | 4 | 4 |
| 872 | $CH_3$—$(CH_2)_{11}$— | $CH_3$— | $CH_3$— | 2 | 4 | 4 | 3 |
| 873 | $CH_3$—$(CH_2)_{11}$— | $CH_3$— | $CH_3$— | 2 | 4 | 3 | 4 |
| 874 | $CH_3$—$(CH_2)_{11}$— | $CH_3$— | $CH_3$— | 2 | 3 | 4 | 4 |
| 875 | $CH_3$—$(CH_2)_{11}$— | $CH_3$— | $CH_3$— | 1 | 2 | 3 | 4 |
| 876 | $CH_3$—$(CH_2)_{11}$— | $CH_3$— | $CH_3$— | 1 | 2 | 4 | 3 |
| 877 | $CH_3$—$(CH_2)_{11}$— | $CH_3$— | $CH_3$— | 1 | 3 | 2 | 4 |
| 878 | $CH_3$—$(CH_2)_{11}$— | $CH_3$— | $CH_3$— | 1 | 3 | 4 | 2 |
| 879 | $CH_3$—$(CH_2)_{11}$— | $CH_3$— | $CH_3$— | 1 | 4 | 2 | 3 |
| 880 | $CH_3$—$(CH_2)_{11}$— | $CH_3$— | $CH_3$— | 1 | 4 | 3 | 2 |
| 881 | $CH_3$—$(CH_2)_{11}$— | $CH_3$— | $CH_3$— | 2 | 1 | 3 | 4 |
| 882 | $CH_3$—$(CH_2)_{11}$— | $CH_3$— | $CH_3$— | 2 | 1 | 4 | 3 |
| 883 | $CH_3$—$(CH_2)_{11}$— | $CH_3$— | $CH_3$— | 2 | 3 | 1 | 4 |
| 884 | $CH_3$—$(CH_2)_{11}$— | $CH_3$— | $CH_3$— | 2 | 3 | 4 | 1 |
| 885 | $CH_3$—$(CH_2)_{11}$— | $CH_3$— | $CH_3$— | 2 | 4 | 1 | 3 |
| 886 | $CH_3$—$(CH_2)_{11}$— | $CH_3$— | $CH_3$— | 2 | 4 | 3 | 1 |
| 887 | $CH_3$—$(CH_2)_{11}$— | $CH_3$— | $CH_3$— | 3 | 1 | 2 | 4 |
| 888 | $CH_3$—$(CH_2)_{11}$— | $CH_3$— | $CH_3$— | 3 | 1 | 4 | 2 |
| 889 | $CH_3$—$(CH_2)_{11}$— | $CH_3$— | $CH_3$— | 3 | 2 | 1 | 4 |
| 890 | $CH_3$—$(CH_2)_{11}$— | $CH_3$— | $CH_3$— | 3 | 2 | 4 | 1 |
| 891 | $CH_3$—$(CH_2)_{11}$— | $CH_3$— | $CH_3$— | 3 | 4 | 1 | 2 |
| 892 | $CH_3$—$(CH_2)_{11}$— | $CH_3$— | $CH_3$— | 3 | 4 | 2 | 1 |
| 893 | $CH_3$—$(CH_2)_{11}$— | $CH_3$— | $CH_3$— | 4 | 1 | 2 | 3 |
| 894 | $CH_3$—$(CH_2)_{11}$— | $CH_3$— | $CH_3$— | 4 | 1 | 3 | 2 |
| 895 | $CH_3$—$(CH_2)_{11}$— | $CH_3$— | $CH_3$— | 4 | 2 | 1 | 3 |
| 896 | $CH_3$—$(CH_2)_{11}$— | $CH_3$— | $CH_3$— | 4 | 2 | 3 | 1 |
| 897 | $CH_3$—$(CH_2)_{11}$— | $CH_3$— | $CH_3$— | 4 | 3 | 1 | 2 |
| 898 | $CH_3$—$(CH_2)_{11}$— | $CH_3$— | $CH_3$— | 4 | 3 | 2 | 1 |
| 899 | $CH_3$—$(CH_2)_{11}$— | $CH_3$— | $CH_3$— | 2 | 3 | 3 | 2 |
| 900 | $CH_3$—$(CH_2)_{11}$— | $CH_3$— | $CH_3$— | 2 | 3 | 2 | 3 |
| 901 | $CH_3$—$(CH_2)_{11}$— | $CH_3$— | $CH_3$— | 2 | 2 | 3 | 3 |
| 902 | $CH_3$—$(CH_2)_{11}$— | $CH_3$— | $CH_3$— | 3 | 3 | 2 | 2 |
| 903 | $CH_3$—$(CH_2)_{11}$— | $CH_3$— | $CH_3$— | 3 | 2 | 3 | 2 |
| 904 | $CH_3$—$(CH_2)_{11}$— | $CH_3$— | $CH_3$— | 3 | 2 | 2 | 3 |
| 905 | $CH_3$—$(CH_2)_{11}$— | $CH_3$— | $CH_3$— | 2 | 4 | 4 | 2 |
| 906 | $CH_3$—$(CH_2)_{11}$— | $CH_3$— | $CH_3$— | 2 | 4 | 2 | 4 |
| 907 | $CH_3$—$(CH_2)_{11}$— | $CH_3$— | $CH_3$— | 2 | 2 | 4 | 4 |
| 908 | $CH_3$—$(CH_2)_{11}$— | $CH_3$— | $CH_3$— | 4 | 4 | 2 | 2 |
| 909 | $CH_3$—$(CH_2)_{11}$— | $CH_3$— | $CH_3$— | 4 | 2 | 4 | 2 |
| 910 | $CH_3$—$(CH_2)_{11}$— | $CH_3$— | $CH_3$— | 4 | 2 | 2 | 4 |
| 911 | $CH_3$—$(CH_2)_{11}$— | $CH_3$— | $CH_3$— | 3 | 4 | 4 | 3 |
| 912 | $CH_3$—$(CH_2)_{11}$— | $CH_3$— | $CH_3$— | 3 | 4 | 3 | 4 |
| 913 | $CH_3$—$(CH_2)_{11}$— | $CH_3$— | $CH_3$— | 3 | 3 | 4 | 4 |
| 914 | $CH_3$—$(CH_2)_{11}$— | $CH_3$— | $CH_3$— | 4 | 4 | 3 | 3 |
| 915 | $CH_3$—$(CH_2)_{11}$— | $CH_3$— | $CH_3$— | 4 | 3 | 4 | 3 |
| 916 | $CH_3$—$(CH_2)_{11}$— | $CH_3$— | $CH_3$— | 4 | 3 | 3 | 4 |
| 917 | $CH_3$—$(CH_2)_{12}$— | $CH_3$— | $CH_3$— | 1 | 1 | 1 | 1 |
| 918 | $CH_3$—$(CH_2)_{12}$— | $CH_3$— | $CH_3$— | 2 | 1 | 1 | 1 |
| 919 | $CH_3$—$(CH_2)_{12}$— | $CH_3$— | $CH_3$— | 1 | 2 | 1 | 1 |
| 920 | $CH_3$—$(CH_2)_{12}$— | $CH_3$— | $CH_3$— | 1 | 1 | 2 | 1 |
| 921 | $CH_3$—$(CH_2)_{12}$— | $CH_3$— | $CH_3$— | 1 | 1 | 1 | 2 |
| 922 | $CH_3$—$(CH_2)_{12}$— | $CH_3$— | $CH_3$— | 3 | 1 | 1 | 1 |
| 923 | $CH_3$—$(CH_2)_{12}$— | $CH_3$— | $CH_3$— | 1 | 3 | 1 | 1 |
| 924 | $CH_3$—$(CH_2)_{12}$— | $CH_3$— | $CH_3$— | 1 | 1 | 3 | 1 |
| 925 | $CH_3$—$(CH_2)_{12}$— | $CH_3$— | $CH_3$— | 1 | 1 | 1 | 3 |
| 926 | $CH_3$—$(CH_2)_{12}$— | $CH_3$— | $CH_3$— | 4 | 1 | 1 | 1 |
| 927 | $CH_3$—$(CH_2)_{12}$— | $CH_3$— | $CH_3$— | 1 | 4 | 1 | 1 |
| 928 | $CH_3$—$(CH_2)_{12}$— | $CH_3$— | $CH_3$— | 1 | 1 | 4 | 1 |
| 929 | $CH_3$—$(CH_2)_{12}$— | $CH_3$— | $CH_3$— | 1 | 1 | 1 | 4 |
| 930 | $CH_3$—$(CH_2)_{12}$— | $CH_3$— | $CH_3$— | 1 | 2 | 2 | 1 |
| 931 | $CH_3$—$(CH_2)_{12}$— | $CH_3$— | $CH_3$— | 1 | 2 | 1 | 2 |
| 932 | $CH_3$—$(CH_2)_{12}$— | $CH_3$— | $CH_3$— | 1 | 1 | 2 | 2 |
| 933 | $CH_3$—$(CH_2)_{12}$— | $CH_3$— | $CH_3$— | 2 | 2 | 1 | 1 |
| 934 | $CH_3$—$(CH_2)_{12}$— | $CH_3$— | $CH_3$— | 2 | 1 | 2 | 1 |
| 935 | $CH_3$—$(CH_2)_{12}$— | $CH_3$— | $CH_3$— | 2 | 1 | 1 | 2 |
| 936 | $CH_3$—$(CH_2)_{12}$— | $CH_3$— | $CH_3$— | 1 | 3 | 3 | 1 |
| 937 | $CH_3$—$(CH_2)_{12}$— | $CH_3$— | $CH_3$— | 1 | 3 | 1 | 3 |
| 938 | $CH_3$—$(CH_2)_{12}$— | $CH_3$— | $CH_3$— | 1 | 1 | 3 | 3 |
| 939 | $CH_3$—$(CH_2)_{12}$— | $CH_3$— | $CH_3$— | 3 | 3 | 1 | 1 |
| 940 | $CH_3$—$(CH_2)_{12}$— | $CH_3$— | $CH_3$— | 3 | 1 | 3 | 1 |
| 941 | $CH_3$—$(CH_2)_{12}$— | $CH_3$— | $CH_3$— | 3 | 1 | 1 | 3 |
| 942 | $CH_3$—$(CH_2)_{12}$— | $CH_3$— | $CH_3$— | 1 | 4 | 4 | 1 |
| 943 | $CH_3$—$(CH_2)_{12}$— | $CH_3$— | $CH_3$— | 1 | 4 | 1 | 4 |
| 944 | $CH_3$—$(CH_2)_{12}$— | $CH_3$— | $CH_3$— | 1 | 1 | 4 | 4 |
| 945 | $CH_3$—$(CH_2)_{12}$— | $CH_3$— | $CH_3$— | 4 | 4 | 1 | 1 |

-continued

| No. | $R^1$ | $R^2$ | $R^3$ | w | x | y | z |
|---|---|---|---|---|---|---|---|
| 946 | $CH_3$—$(CH_2)_{12}$— | $CH_3$— | $CH_3$— | 4 | 1 | 4 | 1 |
| 947 | $CH_3$—$(CH_2)_{12}$— | $CH_3$— | $CH_3$— | 4 | 1 | 1 | 4 |
| 948 | $CH_3$—$(CH_2)_{12}$— | $CH_3$— | $CH_3$— | 1 | 1 | 2 | 3 |
| 949 | $CH_3$—$(CH_2)_{12}$— | $CH_3$— | $CH_3$— | 1 | 1 | 3 | 2 |
| 950 | $CH_3$—$(CH_2)_{12}$— | $CH_3$— | $CH_3$— | 1 | 2 | 3 | 1 |
| 951 | $CH_3$—$(CH_2)_{12}$— | $CH_3$— | $CH_3$— | 1 | 3 | 2 | 1 |
| 952 | $CH_3$—$(CH_2)_{12}$— | $CH_3$— | $CH_3$— | 1 | 2 | 1 | 3 |
| 953 | $CH_3$—$(CH_2)_{12}$— | $CH_3$— | $CH_3$— | 1 | 3 | 1 | 2 |
| 954 | $CH_3$—$(CH_2)_{12}$— | $CH_3$— | $CH_3$— | 2 | 1 | 1 | 3 |
| 955 | $CH_3$—$(CH_2)_{12}$— | $CH_3$— | $CH_3$— | 2 | 1 | 3 | 1 |
| 956 | $CH_3$—$(CH_2)_{12}$— | $CH_3$— | $CH_3$— | 2 | 3 | 1 | 1 |
| 957 | $CH_3$—$(CH_2)_{12}$— | $CH_3$— | $CH_3$— | 3 | 1 | 1 | 2 |
| 958 | $CH_3$—$(CH_2)_{12}$— | $CH_3$— | $CH_3$— | 3 | 1 | 2 | 1 |
| 959 | $CH_3$—$(CH_2)_{12}$— | $CH_3$— | $CH_3$— | 3 | 2 | 1 | 1 |
| 960 | $CH_3$—$(CH_2)_{12}$— | $CH_3$— | $CH_3$— | 1 | 1 | 2 | 4 |
| 961 | $CH_3$—$(CH_2)_{12}$— | $CH_3$— | $CH_3$— | 1 | 1 | 4 | 2 |
| 962 | $CH_3$—$(CH_2)_{12}$— | $CH_3$— | $CH_3$— | 1 | 2 | 4 | 1 |
| 963 | $CH_3$—$(CH_2)_{12}$— | $CH_3$— | $CH_3$— | 1 | 4 | 2 | 1 |
| 964 | $CH_3$—$(CH_2)_{12}$— | $CH_3$— | $CH_3$— | 1 | 2 | 1 | 4 |
| 965 | $CH_3$—$(CH_2)_{12}$— | $CH_3$— | $CH_3$— | 1 | 4 | 1 | 2 |
| 966 | $CH_3$—$(CH_2)_{12}$— | $CH_3$— | $CH_3$— | 2 | 1 | 1 | 4 |
| 967 | $CH_3$—$(CH_2)_{12}$— | $CH_3$— | $CH_3$— | 2 | 1 | 4 | 1 |
| 968 | $CH_3$—$(CH_2)_{12}$— | $CH_3$— | $CH_3$— | 2 | 4 | 1 | 1 |
| 969 | $CH_3$—$(CH_2)_{12}$— | $CH_3$— | $CH_3$— | 4 | 1 | 1 | 2 |
| 970 | $CH_3$—$(CH_2)_{12}$— | $CH_3$— | $CH_3$— | 4 | 1 | 2 | 1 |
| 971 | $CH_3$—$(CH_2)_{12}$— | $CH_3$— | $CH_3$— | 4 | 2 | 1 | 1 |
| 972 | $CH_3$—$(CH_2)_{12}$— | $CH_3$— | $CH_3$— | 1 | 1 | 4 | 3 |
| 973 | $CH_3$—$(CH_2)_{12}$— | $CH_3$— | $CH_3$— | 1 | 1 | 3 | 4 |
| 974 | $CH_3$—$(CH_2)_{12}$— | $CH_3$— | $CH_3$— | 1 | 4 | 3 | 1 |
| 975 | $CH_3$—$(CH_2)_{12}$— | $CH_3$— | $CH_3$— | 1 | 3 | 4 | 1 |
| 976 | $CH_3$—$(CH_2)_{12}$— | $CH_3$— | $CH_3$— | 1 | 4 | 1 | 3 |
| 977 | $CH_3$—$(CH_2)_{12}$— | $CH_3$— | $CH_3$— | 1 | 3 | 1 | 4 |
| 978 | $CH_3$—$(CH_2)_{12}$— | $CH_3$— | $CH_3$— | 4 | 1 | 1 | 3 |
| 979 | $CH_3$—$(CH_2)_{12}$— | $CH_3$— | $CH_3$— | 4 | 1 | 3 | 1 |
| 980 | $CH_3$—$(CH_2)_{12}$— | $CH_3$— | $CH_3$— | 4 | 3 | 1 | 1 |
| 981 | $CH_3$—$(CH_2)_{12}$— | $CH_3$— | $CH_3$— | 3 | 1 | 1 | 4 |
| 982 | $CH_3$—$(CH_2)_{12}$— | $CH_3$— | $CH_3$— | 3 | 1 | 4 | 1 |
| 983 | $CH_3$—$(CH_2)_{12}$— | $CH_3$— | $CH_3$— | 3 | 4 | 1 | 1 |
| 984 | $CH_3$—$(CH_2)_{12}$— | $CH_3$— | $CH_3$— | 1 | 2 | 2 | 2 |
| 985 | $CH_3$—$(CH_2)_{12}$— | $CH_3$— | $CH_3$— | 2 | 1 | 2 | 2 |
| 986 | $CH_3$—$(CH_2)_{12}$— | $CH_3$— | $CH_3$— | 2 | 2 | 1 | 2 |
| 987 | $CH_3$—$(CH_2)_{12}$— | $CH_3$— | $CH_3$— | 2 | 2 | 2 | 1 |
| 988 | $CH_3$—$(CH_2)_{12}$— | $CH_3$— | $CH_3$— | 1 | 3 | 3 | 3 |
| 989 | $CH_3$—$(CH_2)_{12}$— | $CH_3$— | $CH_3$— | 3 | 1 | 3 | 3 |
| 990 | $CH_3$—$(CH_2)_{12}$— | $CH_3$— | $CH_3$— | 3 | 3 | 1 | 3 |
| 991 | $CH_3$—$(CH_2)_{12}$— | $CH_3$— | $CH_3$— | 3 | 3 | 3 | 1 |
| 992 | $CH_3$—$(CH_2)_{12}$— | $CH_3$— | $CH_3$— | 1 | 4 | 4 | 4 |
| 993 | $CH_3$—$(CH_2)_{12}$— | $CH_3$— | $CH_3$— | 4 | 1 | 4 | 4 |
| 994 | $CH_3$—$(CH_2)_{12}$— | $CH_3$— | $CH_3$— | 4 | 4 | 1 | 4 |
| 995 | $CH_3$—$(CH_2)_{12}$— | $CH_3$— | $CH_3$— | 4 | 4 | 4 | 1 |
| 996 | $CH_3$—$(CH_2)_{12}$— | $CH_3$— | $CH_3$— | 2 | 2 | 1 | 3 |
| 997 | $CH_3$—$(CH_2)_{12}$— | $CH_3$— | $CH_3$— | 2 | 2 | 3 | 1 |
| 998 | $CH_3$—$(CH_2)_{12}$— | $CH_3$— | $CH_3$— | 2 | 1 | 2 | 3 |
| 999 | $CH_3$—$(CH_2)_{12}$— | $CH_3$— | $CH_3$— | 2 | 3 | 2 | 1 |
| 1000 | $CH_3$—$(CH_2)_{12}$— | $CH_3$— | $CH_3$— | 2 | 1 | 3 | 2 |
| 1001 | $CH_3$—$(CH_2)_{12}$— | $CH_3$— | $CH_3$— | 2 | 3 | 1 | 2 |
| 1002 | $CH_3$—$(CH_2)_{12}$— | $CH_3$— | $CH_3$— | 1 | 2 | 2 | 3 |
| 1003 | $CH_3$—$(CH_2)_{12}$— | $CH_3$— | $CH_3$— | 1 | 2 | 3 | 2 |
| 1004 | $CH_3$—$(CH_2)_{12}$— | $CH_3$— | $CH_3$— | 1 | 3 | 2 | 2 |
| 1005 | $CH_3$—$(CH_2)_{12}$— | $CH_3$— | $CH_3$— | 3 | 2 | 2 | 1 |
| 1006 | $CH_3$—$(CH_2)_{12}$— | $CH_3$— | $CH_3$— | 3 | 2 | 1 | 2 |
| 1007 | $CH_3$—$(CH_2)_{12}$— | $CH_3$— | $CH_3$— | 3 | 1 | 2 | 2 |
| 1008 | $CH_3$—$(CH_2)_{12}$— | $CH_3$— | $CH_3$— | 2 | 2 | 1 | 4 |
| 1009 | $CH_3$—$(CH_2)_{12}$— | $CH_3$— | $CH_3$— | 2 | 2 | 4 | 1 |
| 1010 | $CH_3$—$(CH_2)_{12}$— | $CH_3$— | $CH_3$— | 2 | 1 | 2 | 4 |
| 1011 | $CH_3$—$(CH_2)_{12}$— | $CH_3$— | $CH_3$— | 2 | 4 | 2 | 1 |
| 1012 | $CH_3$—$(CH_2)_{12}$— | $CH_3$— | $CH_3$— | 2 | 1 | 4 | 2 |
| 1013 | $CH_3$—$(CH_2)_{12}$— | $CH_3$— | $CH_3$— | 2 | 4 | 1 | 2 |
| 1014 | $CH_3$—$(CH_2)_{12}$— | $CH_3$— | $CH_3$— | 1 | 2 | 2 | 4 |
| 1015 | $CH_3$—$(CH_2)_{12}$— | $CH_3$— | $CH_3$— | 1 | 2 | 4 | 2 |
| 1016 | $CH_3$—$(CH_2)_{12}$— | $CH_3$— | $CH_3$— | 1 | 4 | 2 | 2 |
| 1017 | $CH_3$—$(CH_2)_{12}$— | $CH_3$— | $CH_3$— | 4 | 2 | 2 | 1 |
| 1018 | $CH_3$—$(CH_2)_{12}$— | $CH_3$— | $CH_3$— | 4 | 2 | 1 | 2 |
| 1019 | $CH_3$—$(CH_2)_{12}$— | $CH_3$— | $CH_3$— | 4 | 1 | 2 | 2 |
| 1020 | $CH_3$—$(CH_2)_{12}$— | $CH_3$— | $CH_3$— | 2 | 2 | 4 | 3 |
| 1021 | $CH_3$—$(CH_2)_{12}$— | $CH_3$— | $CH_3$— | 2 | 2 | 3 | 4 |
| 1022 | $CH_3$—$(CH_2)_{12}$— | $CH_3$— | $CH_3$— | 2 | 4 | 2 | 3 |

-continued

| No. | $R^1$ | $R^2$ | $R^3$ | w | x | y | z |
|---|---|---|---|---|---|---|---|
| 1023 | $CH_3$—$(CH_2)_{12}$— | $CH_3$— | $CH_3$— | 2 | 3 | 2 | 4 |
| 1024 | $CH_3$—$(CH_2)_{12}$— | $CH_3$— | $CH_3$— | 2 | 4 | 3 | 2 |
| 1025 | $CH_3$—$(CH_2)_{12}$— | $CH_3$— | $CH_3$— | 2 | 3 | 4 | 2 |
| 1026 | $CH_3$—$(CH_2)_{12}$— | $CH_3$— | $CH_3$— | 4 | 2 | 2 | 3 |
| 1027 | $CH_3$—$(CH_2)_{12}$— | $CH_3$— | $CH_3$— | 4 | 2 | 3 | 2 |
| 1028 | $CH_3$—$(CH_2)_{12}$— | $CH_3$— | $CH_3$— | 4 | 3 | 2 | 2 |
| 1029 | $CH_3$—$(CH_2)_{12}$— | $CH_3$— | $CH_3$— | 3 | 2 | 2 | 4 |
| 1030 | $CH_3$—$(CH_2)_{12}$— | $CH_3$— | $CH_3$— | 3 | 2 | 4 | 2 |
| 1031 | $CH_3$—$(CH_2)_{12}$— | $CH_3$— | $CH_3$— | 3 | 4 | 2 | 2 |
| 1032 | $CH_3$—$(CH_2)_{12}$— | $CH_3$— | $CH_3$— | 3 | 3 | 1 | 2 |
| 1033 | $CH_3$—$(CH_2)_{12}$— | $CH_3$— | $CH_3$— | 3 | 3 | 2 | 1 |
| 1034 | $CH_3$—$(CH_2)_{12}$— | $CH_3$— | $CH_3$— | 3 | 1 | 3 | 2 |
| 1035 | $CH_3$—$(CH_2)_{12}$— | $CH_3$— | $CH_3$— | 3 | 2 | 3 | 1 |
| 1036 | $CH_3$—$(CH_2)_{12}$— | $CH_3$— | $CH_3$— | 3 | 1 | 2 | 3 |
| 1037 | $CH_3$—$(CH_2)_{12}$— | $CH_3$— | $CH_3$— | 3 | 2 | 1 | 3 |
| 1038 | $CH_3$—$(CH_2)_{12}$— | $CH_3$— | $CH_3$— | 1 | 3 | 3 | 2 |
| 1039 | $CH_3$—$(CH_2)_{12}$— | $CH_3$— | $CH_3$— | 1 | 3 | 2 | 3 |
| 1040 | $CH_3$—$(CH_2)_{12}$— | $CH_3$— | $CH_3$— | 1 | 2 | 3 | 3 |
| 1041 | $CH_3$—$(CH_2)_{12}$— | $CH_3$— | $CH_3$— | 2 | 3 | 3 | 1 |
| 1042 | $CH_3$—$(CH_2)_{12}$— | $CH_3$— | $CH_3$— | 2 | 3 | 1 | 3 |
| 1043 | $CH_3$—$(CH_2)_{12}$— | $CH_3$— | $CH_3$— | 2 | 1 | 3 | 3 |
| 1044 | $CH_3$—$(CH_2)_{12}$— | $CH_3$— | $CH_3$— | 3 | 3 | 1 | 4 |
| 1045 | $CH_3$—$(CH_2)_{12}$— | $CH_3$— | $CH_3$— | 3 | 3 | 4 | 1 |
| 1046 | $CH_3$—$(CH_2)_{12}$— | $CH_3$— | $CH_3$— | 3 | 1 | 3 | 4 |
| 1047 | $CH_3$—$(CH_2)_{12}$— | $CH_3$— | $CH_3$— | 3 | 4 | 3 | 1 |
| 1048 | $CH_3$—$(CH_2)_{12}$— | $CH_3$— | $CH_3$— | 3 | 1 | 4 | 3 |
| 1049 | $CH_3$—$(CH_2)_{12}$— | $CH_3$— | $CH_3$— | 3 | 4 | 1 | 3 |
| 1050 | $CH_3$—$(CH_2)_{12}$— | $CH_3$— | $CH_3$— | 1 | 3 | 3 | 4 |
| 1051 | $CH_3$—$(CH_2)_{12}$— | $CH_3$— | $CH_3$— | 1 | 3 | 4 | 3 |
| 1052 | $CH_3$—$(CH_2)_{12}$— | $CH_3$— | $CH_3$— | 1 | 4 | 3 | 3 |
| 1053 | $CH_3$—$(CH_2)_{12}$— | $CH_3$— | $CH_3$— | 4 | 3 | 3 | 1 |
| 1054 | $CH_3$—$(CH_2)_{12}$— | $CH_3$— | $CH_3$— | 4 | 3 | 1 | 3 |
| 1055 | $CH_3$—$(CH_2)_{12}$— | $CH_3$— | $CH_3$— | 4 | 1 | 3 | 3 |
| 1056 | $CH_3$—$(CH_2)_{12}$— | $CH_3$— | $CH_3$— | 3 | 3 | 4 | 2 |
| 1057 | $CH_3$—$(CH_2)_{12}$— | $CH_3$— | $CH_3$— | 3 | 3 | 2 | 4 |
| 1058 | $CH_3$—$(CH_2)_{12}$— | $CH_3$— | $CH_3$— | 3 | 4 | 3 | 2 |
| 1059 | $CH_3$—$(CH_2)_{12}$— | $CH_3$— | $CH_3$— | 3 | 2 | 3 | 4 |
| 1060 | $CH_3$—$(CH_2)_{12}$— | $CH_3$— | $CH_3$— | 3 | 4 | 2 | 3 |
| 1061 | $CH_3$—$(CH_2)_{12}$— | $CH_3$— | $CH_3$— | 3 | 2 | 4 | 3 |
| 1062 | $CH_3$—$(CH_2)_{12}$— | $CH_3$— | $CH_3$— | 4 | 3 | 3 | 2 |
| 1063 | $CH_3$—$(CH_2)_{12}$— | $CH_3$— | $CH_3$— | 4 | 3 | 2 | 3 |
| 1064 | $CH_3$—$(CH_2)_{12}$— | $CH_3$— | $CH_3$— | 4 | 2 | 3 | 3 |
| 1065 | $CH_3$—$(CH_2)_{12}$— | $CH_3$— | $CH_3$— | 2 | 3 | 3 | 4 |
| 1066 | $CH_3$—$(CH_2)_{12}$— | $CH_3$— | $CH_3$— | 2 | 3 | 4 | 3 |
| 1067 | $CH_3$—$(CH_2)_{12}$— | $CH_3$— | $CH_3$— | 2 | 4 | 3 | 3 |
| 1068 | $CH_3$—$(CH_2)_{12}$— | $CH_3$— | $CH_3$— | 4 | 4 | 1 | 2 |
| 1069 | $CH_3$—$(CH_2)_{12}$— | $CH_3$— | $CH_3$— | 4 | 4 | 2 | 1 |
| 1070 | $CH_3$—$(CH_2)_{12}$— | $CH_3$— | $CH_3$— | 4 | 1 | 4 | 2 |
| 1071 | $CH_3$—$(CH_2)_{12}$— | $CH_3$— | $CH_3$— | 4 | 2 | 4 | 1 |
| 1072 | $CH_3$—$(CH_2)_{12}$— | $CH_3$— | $CH_3$— | 4 | 1 | 2 | 4 |
| 1073 | $CH_3$—$(CH_2)_{12}$— | $CH_3$— | $CH_3$— | 4 | 2 | 1 | 4 |
| 1074 | $CH_3$—$(CH_2)_{12}$— | $CH_3$— | $CH_3$— | 1 | 4 | 4 | 2 |
| 1075 | $CH_3$—$(CH_2)_{12}$— | $CH_3$— | $CH_3$— | 1 | 4 | 2 | 4 |
| 1076 | $CH_3$—$(CH_2)_{12}$— | $CH_3$— | $CH_3$— | 1 | 2 | 4 | 4 |
| 1077 | $CH_3$—$(CH_2)_{12}$— | $CH_3$— | $CH_3$— | 2 | 4 | 4 | 1 |
| 1078 | $CH_3$—$(CH_2)_{12}$— | $CH_3$— | $CH_3$— | 2 | 4 | 1 | 4 |
| 1079 | $CH_3$—$(CH_2)_{12}$— | $CH_3$— | $CH_3$— | 2 | 1 | 4 | 4 |
| 1080 | $CH_3$—$(CH_2)_{12}$— | $CH_3$— | $CH_3$— | 4 | 4 | 1 | 3 |
| 1081 | $CH_3$—$(CH_2)_{12}$— | $CH_3$— | $CH_3$— | 4 | 4 | 3 | 1 |
| 1082 | $CH_3$—$(CH_2)_{12}$— | $CH_3$— | $CH_3$— | 4 | 1 | 4 | 3 |
| 1083 | $CH_3$—$(CH_2)_{12}$— | $CH_3$— | $CH_3$— | 4 | 3 | 4 | 1 |
| 1084 | $CH_3$—$(CH_2)_{12}$— | $CH_3$— | $CH_3$— | 4 | 1 | 3 | 4 |
| 1085 | $CH_3$—$(CH_2)_{12}$— | $CH_3$— | $CH_3$— | 4 | 3 | 1 | 4 |
| 1086 | $CH_3$—$(CH_2)_{12}$— | $CH_3$— | $CH_3$— | 1 | 4 | 4 | 3 |
| 1087 | $CH_3$—$(CH_2)_{12}$— | $CH_3$— | $CH_3$— | 1 | 4 | 3 | 4 |
| 1088 | $CH_3$—$(CH_2)_{12}$— | $CH_3$— | $CH_3$— | 1 | 3 | 4 | 4 |
| 1089 | $CH_3$—$(CH_2)_{12}$— | $CH_3$— | $CH_3$— | 3 | 4 | 4 | 1 |
| 1090 | $CH_3$—$(CH_2)_{12}$— | $CH_3$— | $CH_3$— | 3 | 4 | 1 | 4 |
| 1091 | $CH_3$—$(CH_2)_{12}$— | $CH_3$— | $CH_3$— | 3 | 1 | 4 | 4 |
| 1092 | $CH_3$—$(CH_2)_{12}$— | $CH_3$— | $CH_3$— | 4 | 4 | 3 | 2 |
| 1093 | $CH_3$—$(CH_2)_{12}$— | $CH_3$— | $CH_3$— | 4 | 4 | 2 | 3 |
| 1094 | $CH_3$—$(CH_2)_{12}$— | $CH_3$— | $CH_3$— | 4 | 3 | 4 | 2 |
| 1095 | $CH_3$—$(CH_2)_{12}$— | $CH_3$— | $CH_3$— | 4 | 2 | 4 | 3 |
| 1096 | $CH_3$—$(CH_2)_{12}$— | $CH_3$— | $CH_3$— | 4 | 3 | 2 | 4 |
| 1097 | $CH_3$—$(CH_2)_{12}$— | $CH_3$— | $CH_3$— | 4 | 2 | 3 | 4 |
| 1098 | $CH_3$—$(CH_2)_{12}$— | $CH_3$— | $CH_3$— | 3 | 4 | 4 | 2 |
| 1099 | $CH_3$—$(CH_2)_{12}$— | $CH_3$— | $CH_3$— | 3 | 4 | 2 | 4 |

-continued

| No. | $R^1$ | $R^2$ | $R^3$ | w | x | y | z |
|---|---|---|---|---|---|---|---|
| 1100 | $CH_3$—$(CH_2)_{12}$— | $CH_3$— | $CH_3$— | 3 | 2 | 4 | 4 |
| 1101 | $CH_3$—$(CH_2)_{12}$— | $CH_3$— | $CH_3$— | 2 | 4 | 4 | 3 |
| 1102 | $CH_3$—$(CH_2)_{12}$— | $CH_3$— | $CH_3$— | 2 | 4 | 3 | 4 |
| 1103 | $CH_3$—$(CH_2)_{12}$— | $CH_3$— | $CH_3$— | 2 | 3 | 4 | 4 |
| 1104 | $CH_3$—$(CH_2)_{12}$— | $CH_3$— | $CH_3$— | 1 | 2 | 3 | 4 |
| 1105 | $CH_3$—$(CH_2)_{12}$— | $CH_3$— | $CH_3$— | 1 | 2 | 4 | 3 |
| 1106 | $CH_3$—$(CH_2)_{12}$— | $CH_3$— | $CH_3$— | 1 | 3 | 2 | 4 |
| 1107 | $CH_3$—$(CH_2)_{12}$— | $CH_3$— | $CH_3$— | 1 | 3 | 4 | 2 |
| 1108 | $CH_3$—$(CH_2)_{12}$— | $CH_3$— | $CH_3$— | 1 | 4 | 2 | 3 |
| 1109 | $CH_3$—$(CH_2)_{12}$— | $CH_3$— | $CH_3$— | 1 | 4 | 3 | 2 |
| 1110 | $CH_3$—$(CH_2)_{12}$— | $CH_3$— | $CH_3$— | 2 | 1 | 3 | 4 |
| 1111 | $CH_3$—$(CH_2)_{12}$— | $CH_3$— | $CH_3$— | 2 | 1 | 4 | 3 |
| 1112 | $CH_3$—$(CH_2)_{12}$— | $CH_3$— | $CH_3$— | 2 | 3 | 1 | 4 |
| 1113 | $CH_3$—$(CH_2)_{12}$— | $CH_3$— | $CH_3$— | 2 | 3 | 4 | 1 |
| 1114 | $CH_3$—$(CH_2)_{12}$— | $CH_3$— | $CH_3$— | 2 | 4 | 1 | 3 |
| 1115 | $CH_3$—$(CH_2)_{12}$— | $CH_3$— | $CH_3$— | 2 | 4 | 3 | 1 |
| 1116 | $CH_3$—$(CH_2)_{12}$— | $CH_3$— | $CH_3$— | 3 | 1 | 2 | 4 |
| 1117 | $CH_3$—$(CH_2)_{12}$— | $CH_3$— | $CH_3$— | 3 | 1 | 4 | 2 |
| 1118 | $CH_3$—$(CH_2)_{12}$— | $CH_3$— | $CH_3$— | 3 | 2 | 1 | 4 |
| 1119 | $CH_3$—$(CH_2)_{12}$— | $CH_3$— | $CH_3$— | 3 | 2 | 4 | 1 |
| 1120 | $CH_3$—$(CH_2)_{12}$— | $CH_3$— | $CH_3$— | 3 | 4 | 1 | 2 |
| 1121 | $CH_3$—$(CH_2)_{12}$— | $CH_3$— | $CH_3$— | 3 | 4 | 2 | 1 |
| 1122 | $CH_3$—$(CH_2)_{12}$— | $CH_3$— | $CH_3$— | 4 | 1 | 2 | 3 |
| 1123 | $CH_3$—$(CH_2)_{12}$— | $CH_3$— | $CH_3$— | 4 | 1 | 3 | 2 |
| 1124 | $CH_3$—$(CH_2)_{12}$— | $CH_3$— | $CH_3$— | 4 | 2 | 1 | 3 |
| 1125 | $CH_3$—$(CH_2)_{12}$— | $CH_3$— | $CH_3$— | 4 | 2 | 3 | 1 |
| 1126 | $CH_3$—$(CH_2)_{12}$— | $CH_3$— | $CH_3$— | 4 | 3 | 1 | 2 |
| 1127 | $CH_3$—$(CH_2)_{12}$— | $CH_3$— | $CH_3$— | 4 | 3 | 2 | 1 |
| 1128 | $CH_3$—$(CH_2)_{12}$— | $CH_3$— | $CH_3$— | 2 | 3 | 3 | 2 |
| 1129 | $CH_3$—$(CH_2)_{12}$— | $CH_3$— | $CH_3$— | 2 | 3 | 2 | 3 |
| 1130 | $CH_3$—$(CH_2)_{12}$— | $CH_3$— | $CH_3$— | 2 | 2 | 3 | 3 |
| 1131 | $CH_3$—$(CH_2)_{12}$— | $CH_3$— | $CH_3$— | 3 | 3 | 2 | 2 |
| 1132 | $CH_3$—$(CH_2)_{12}$— | $CH_3$— | $CH_3$— | 3 | 2 | 3 | 2 |
| 1133 | $CH_3$—$(CH_2)_{12}$— | $CH_3$— | $CH_3$— | 3 | 2 | 2 | 3 |
| 1134 | $CH_3$—$(CH_2)_{12}$— | $CH_3$— | $CH_3$— | 2 | 4 | 4 | 2 |
| 1135 | $CH_3$—$(CH_2)_{12}$— | $CH_3$— | $CH_3$— | 2 | 4 | 2 | 4 |
| 1136 | $CH_3$—$(CH_2)_{12}$— | $CH_3$— | $CH_3$— | 2 | 2 | 4 | 4 |
| 1137 | $CH_3$—$(CH_2)_{12}$— | $CH_3$— | $CH_3$— | 4 | 4 | 2 | 2 |
| 1138 | $CH_3$—$(CH_2)_{12}$— | $CH_3$— | $CH_3$— | 4 | 2 | 4 | 2 |
| 1139 | $CH_3$—$(CH_2)_{12}$— | $CH_3$— | $CH_3$— | 4 | 2 | 2 | 4 |
| 1140 | $CH_3$—$(CH_2)_{12}$— | $CH_3$— | $CH_3$— | 3 | 4 | 4 | 3 |
| 1141 | $CH_3$—$(CH_2)_{12}$— | $CH_3$— | $CH_3$— | 3 | 4 | 3 | 4 |
| 1142 | $CH_3$—$(CH_2)_{12}$— | $CH_3$— | $CH_3$— | 3 | 3 | 4 | 4 |
| 1143 | $CH_3$—$(CH_2)_{12}$— | $CH_3$— | $CH_3$— | 4 | 4 | 3 | 3 |
| 1144 | $CH_3$—$(CH_2)_{12}$— | $CH_3$— | $CH_3$— | 4 | 3 | 4 | 3 |
| 1145 | $CH_3$—$(CH_2)_{12}$— | $CH_3$— | $CH_3$— | 4 | 3 | 3 | 4 |
| 1146 | $CH_3$—$(CH_2)_{13}$— | $CH_3$— | $CH_3$— | 1 | 1 | 1 | 1 |
| 1147 | $CH_3$—$(CH_2)_{13}$— | $CH_3$— | $CH_3$— | 2 | 1 | 1 | 1 |
| 1148 | $CH_3$—$(CH_2)_{13}$— | $CH_3$— | $CH_3$— | 1 | 2 | 1 | 1 |
| 1149 | $CH_3$—$(CH_2)_{13}$— | $CH_3$— | $CH_3$— | 1 | 1 | 2 | 1 |
| 1150 | $CH_3$—$(CH_2)_{13}$— | $CH_3$— | $CH_3$— | 1 | 1 | 1 | 2 |
| 1151 | $CH_3$—$(CH_2)_{13}$— | $CH_3$— | $CH_3$— | 3 | 1 | 1 | 1 |
| 1152 | $CH_3$—$(CH_2)_{13}$— | $CH_3$— | $CH_3$— | 1 | 3 | 1 | 1 |
| 1153 | $CH_3$—$(CH_2)_{13}$— | $CH_3$— | $CH_3$— | 1 | 1 | 3 | 1 |
| 1154 | $CH_3$—$(CH_2)_{13}$— | $CH_3$— | $CH_3$— | 1 | 1 | 1 | 3 |
| 1155 | $CH_3$—$(CH_2)_{13}$— | $CH_3$— | $CH_3$— | 4 | 1 | 1 | 1 |
| 1156 | $CH_3$—$(CH_2)_{13}$— | $CH_3$— | $CH_3$— | 1 | 4 | 1 | 1 |
| 1157 | $CH_3$—$(CH_2)_{13}$— | $CH_3$— | $CH_3$— | 1 | 1 | 4 | 1 |
| 1158 | $CH_3$—$(CH_2)_{13}$— | $CH_3$— | $CH_3$— | 1 | 1 | 1 | 4 |
| 1159 | $CH_3$—$(CH_2)_{13}$— | $CH_3$— | $CH_3$— | 1 | 2 | 2 | 1 |
| 1160 | $CH_3$—$(CH_2)_{13}$— | $CH_3$— | $CH_3$— | 1 | 2 | 1 | 2 |
| 1161 | $CH_3$—$(CH_2)_{13}$— | $CH_3$— | $CH_3$— | 1 | 1 | 2 | 2 |
| 1162 | $CH_3$—$(CH_2)_{13}$— | $CH_3$— | $CH_3$— | 2 | 2 | 1 | 1 |
| 1163 | $CH_3$—$(CH_2)_{13}$— | $CH_3$— | $CH_3$— | 2 | 1 | 2 | 1 |
| 1164 | $CH_3$—$(CH_2)_{13}$— | $CH_3$— | $CH_3$— | 2 | 1 | 1 | 2 |
| 1165 | $CH_3$—$(CH_2)_{13}$— | $CH_3$— | $CH_3$— | 1 | 3 | 3 | 1 |
| 1166 | $CH_3$—$(CH_2)_{13}$— | $CH_3$— | $CH_3$— | 1 | 3 | 1 | 3 |
| 1167 | $CH_3$—$(CH_2)_{13}$— | $CH_3$— | $CH_3$— | 1 | 1 | 3 | 3 |
| 1168 | $CH_3$—$(CH_2)_{13}$— | $CH_3$— | $CH_3$— | 3 | 3 | 1 | 1 |
| 1169 | $CH_3$—$(CH_2)_{13}$— | $CH_3$— | $CH_3$— | 3 | 1 | 3 | 1 |
| 1170 | $CH_3$—$(CH_2)_{13}$— | $CH_3$— | $CH_3$— | 3 | 1 | 1 | 3 |
| 1171 | $CH_3$—$(CH_2)_{13}$— | $CH_3$— | $CH_3$— | 1 | 4 | 4 | 1 |
| 1172 | $CH_3$—$(CH_2)_{13}$— | $CH_3$— | $CH_3$— | 1 | 4 | 1 | 4 |
| 1173 | $CH_3$—$(CH_2)_{13}$— | $CH_3$— | $CH_3$— | 1 | 1 | 4 | 4 |
| 1174 | $CH_3$—$(CH_2)_{13}$— | $CH_3$— | $CH_3$— | 4 | 4 | 1 | 1 |
| 1175 | $CH_3$—$(CH_2)_{13}$— | $CH_3$— | $CH_3$— | 4 | 1 | 4 | 1 |
| 1176 | $CH_3$—$(CH_2)_{13}$— | $CH_3$— | $CH_3$— | 4 | 1 | 1 | 4 |

-continued

| No. | $R^1$ | $R^2$ | $R^3$ | w | x | y | z |
|---|---|---|---|---|---|---|---|
| 1177 | $CH_3$—$(CH_2)_{13}$— | $CH_3$— | $CH_3$— | 1 | 1 | 2 | 3 |
| 1178 | $CH_3$—$(CH_2)_{13}$— | $CH_3$— | $CH_3$— | 1 | 1 | 3 | 2 |
| 1179 | $CH_3$—$(CH_2)_{13}$— | $CH_3$— | $CH_3$— | 1 | 2 | 3 | 1 |
| 1180 | $CH_3$—$(CH_2)_{13}$— | $CH_3$— | $CH_3$— | 1 | 3 | 2 | 1 |
| 1181 | $CH_3$—$(CH_2)_{13}$— | $CH_3$— | $CH_3$— | 1 | 2 | 1 | 3 |
| 1182 | $CH_3$—$(CH_2)_{13}$— | $CH_3$— | $CH_3$— | 1 | 3 | 1 | 2 |
| 1183 | $CH_3$—$(CH_2)_{13}$— | $CH_3$— | $CH_3$— | 2 | 1 | 1 | 3 |
| 1184 | $CH_3$—$(CH_2)_{13}$— | $CH_3$— | $CH_3$— | 2 | 1 | 3 | 1 |
| 1185 | $CH_3$—$(CH_2)_{13}$— | $CH_3$— | $CH_3$— | 2 | 3 | 1 | 1 |
| 1186 | $CH_3$—$(CH_2)_{13}$— | $CH_3$— | $CH_3$— | 3 | 1 | 1 | 2 |
| 1187 | $CH_3$—$(CH_2)_{13}$— | $CH_3$— | $CH_3$— | 3 | 1 | 2 | 1 |
| 1188 | $CH_3$—$(CH_2)_{13}$— | $CH_3$— | $CH_3$— | 3 | 2 | 1 | 1 |
| 1189 | $CH_3$—$(CH_2)_{13}$— | $CH_3$— | $CH_3$— | 1 | 1 | 2 | 4 |
| 1190 | $CH_3$—$(CH_2)_{13}$— | $CH_3$— | $CH_3$— | 1 | 1 | 4 | 2 |
| 1191 | $CH_3$—$(CH_2)_{13}$— | $CH_3$— | $CH_3$— | 1 | 2 | 4 | 1 |
| 1192 | $CH_3$—$(CH_2)_{13}$— | $CH_3$— | $CH_3$— | 1 | 4 | 2 | 1 |
| 1193 | $CH_3$—$(CH_2)_{13}$— | $CH_3$— | $CH_3$— | 1 | 2 | 1 | 4 |
| 1194 | $CH_3$—$(CH_2)_{13}$— | $CH_3$— | $CH_3$— | 1 | 4 | 1 | 2 |
| 1195 | $CH_3$—$(CH_2)_{13}$— | $CH_3$— | $CH_3$— | 2 | 1 | 1 | 4 |
| 1196 | $CH_3$—$(CH_2)_{13}$— | $CH_3$— | $CH_3$— | 2 | 1 | 4 | 1 |
| 1197 | $CH_3$—$(CH_2)_{13}$— | $CH_3$— | $CH_3$— | 2 | 4 | 1 | 1 |
| 1198 | $CH_3$—$(CH_2)_{13}$— | $CH_3$— | $CH_3$— | 4 | 1 | 1 | 2 |
| 1199 | $CH_3$—$(CH_2)_{13}$— | $CH_3$— | $CH_3$— | 4 | 1 | 2 | 1 |
| 1200 | $CH_3$—$(CH_2)_{13}$— | $CH_3$— | $CH_3$— | 4 | 2 | 1 | 1 |
| 1201 | $CH_3$—$(CH_2)_{13}$— | $CH_3$— | $CH_3$— | 1 | 1 | 4 | 3 |
| 1202 | $CH_3$—$(CH_2)_{13}$— | $CH_3$— | $CH_3$— | 1 | 1 | 3 | 4 |
| 1203 | $CH_3$—$(CH_2)_{13}$— | $CH_3$— | $CH_3$— | 1 | 4 | 3 | 1 |
| 1204 | $CH_3$—$(CH_2)_{13}$— | $CH_3$— | $CH_3$— | 1 | 3 | 4 | 1 |
| 1205 | $CH_3$—$(CH_2)_{13}$— | $CH_3$— | $CH_3$— | 1 | 4 | 1 | 3 |
| 1206 | $CH_3$—$(CH_2)_{13}$— | $CH_3$— | $CH_3$— | 1 | 3 | 1 | 4 |
| 1207 | $CH_3$—$(CH_2)_{13}$— | $CH_3$— | $CH_3$— | 4 | 1 | 1 | 3 |
| 1208 | $CH_3$—$(CH_2)_{13}$— | $CH_3$— | $CH_3$— | 4 | 1 | 3 | 1 |
| 1209 | $CH_3$—$(CH_2)_{13}$— | $CH_3$— | $CH_3$— | 4 | 3 | 1 | 1 |
| 1210 | $CH_3$—$(CH_2)_{13}$— | $CH_3$— | $CH_3$— | 3 | 1 | 1 | 4 |
| 1211 | $CH_3$—$(CH_2)_{13}$— | $CH_3$— | $CH_3$— | 3 | 1 | 4 | 1 |
| 1212 | $CH_3$—$(CH_2)_{13}$— | $CH_3$— | $CH_3$— | 3 | 4 | 1 | 1 |
| 1213 | $CH_3$—$(CH_2)_{13}$— | $CH_3$— | $CH_3$— | 1 | 2 | 2 | 2 |
| 1214 | $CH_3$—$(CH_2)_{13}$— | $CH_3$— | $CH_3$— | 2 | 1 | 2 | 2 |
| 1215 | $CH_3$—$(CH_2)_{13}$— | $CH_3$— | $CH_3$— | 2 | 2 | 1 | 2 |
| 1216 | $CH_3$—$(CH_2)_{13}$— | $CH_3$— | $CH_3$— | 2 | 2 | 2 | 1 |
| 1217 | $CH_3$—$(CH_2)_{13}$— | $CH_3$— | $CH_3$— | 1 | 3 | 3 | 3 |
| 1218 | $CH_3$—$(CH_2)_{13}$— | $CH_3$— | $CH_3$— | 3 | 1 | 3 | 3 |
| 1219 | $CH_3$—$(CH_2)_{13}$— | $CH_3$— | $CH_3$— | 3 | 3 | 1 | 3 |
| 1220 | $CH_3$—$(CH_2)_{13}$— | $CH_3$— | $CH_3$— | 3 | 3 | 3 | 1 |
| 1221 | $CH_3$—$(CH_2)_{13}$— | $CH_3$— | $CH_3$— | 1 | 4 | 4 | 4 |
| 1222 | $CH_3$—$(CH_2)_{13}$— | $CH_3$— | $CH_3$— | 4 | 1 | 4 | 4 |
| 1223 | $CH_3$—$(CH_2)_{13}$— | $CH_3$— | $CH_3$— | 4 | 4 | 1 | 4 |
| 1224 | $CH_3$—$(CH_2)_{13}$— | $CH_3$— | $CH_3$— | 4 | 4 | 4 | 1 |
| 1225 | $CH_3$—$(CH_2)_{13}$— | $CH_3$— | $CH_3$— | 2 | 2 | 1 | 3 |
| 1226 | $CH_3$—$(CH_2)_{13}$— | $CH_3$— | $CH_3$— | 2 | 2 | 3 | 1 |
| 1227 | $CH_3$—$(CH_2)_{13}$— | $CH_3$— | $CH_3$— | 2 | 1 | 2 | 3 |
| 1228 | $CH_3$—$(CH_2)_{13}$— | $CH_3$— | $CH_3$— | 2 | 3 | 2 | 1 |
| 1229 | $CH_3$—$(CH_2)_{13}$— | $CH_3$— | $CH_3$— | 2 | 1 | 3 | 2 |
| 1230 | $CH_3$—$(CH_2)_{13}$— | $CH_3$— | $CH_3$— | 2 | 3 | 1 | 2 |
| 1231 | $CH_3$—$(CH_2)_{13}$— | $CH_3$— | $CH_3$— | 1 | 2 | 2 | 3 |
| 1232 | $CH_3$—$(CH_2)_{13}$— | $CH_3$— | $CH_3$— | 1 | 2 | 3 | 2 |
| 1233 | $CH_3$—$(CH_2)_{13}$— | $CH_3$— | $CH_3$— | 1 | 3 | 2 | 2 |
| 1234 | $CH_3$—$(CH_2)_{13}$— | $CH_3$— | $CH_3$— | 3 | 2 | 2 | 1 |
| 1235 | $CH_3$—$(CH_2)_{13}$— | $CH_3$— | $CH_3$— | 3 | 2 | 1 | 2 |
| 1236 | $CH_3$—$(CH_2)_{13}$— | $CH_3$— | $CH_3$— | 3 | 1 | 2 | 2 |
| 1237 | $CH_3$—$(CH_2)_{13}$— | $CH_3$— | $CH_3$— | 2 | 2 | 1 | 4 |
| 1238 | $CH_3$—$(CH_2)_{13}$— | $CH_3$— | $CH_3$— | 2 | 2 | 4 | 1 |
| 1239 | $CH_3$—$(CH_2)_{13}$— | $CH_3$— | $CH_3$— | 2 | 1 | 2 | 4 |
| 1240 | $CH_3$—$(CH_2)_{13}$— | $CH_3$— | $CH_3$— | 2 | 4 | 2 | 1 |
| 1241 | $CH_3$—$(CH_2)_{13}$— | $CH_3$— | $CH_3$— | 2 | 1 | 4 | 2 |
| 1242 | $CH_3$—$(CH_2)_{13}$— | $CH_3$— | $CH_3$— | 2 | 4 | 1 | 2 |
| 1243 | $CH_3$—$(CH_2)_{13}$— | $CH_3$— | $CH_3$— | 1 | 2 | 2 | 4 |
| 1244 | $CH_3$—$(CH_2)_{13}$— | $CH_3$— | $CH_3$— | 1 | 2 | 4 | 2 |
| 1245 | $CH_3$—$(CH_2)_{13}$— | $CH_3$— | $CH_3$— | 1 | 4 | 2 | 2 |
| 1246 | $CH_3$—$(CH_2)_{13}$— | $CH_3$— | $CH_3$— | 4 | 2 | 2 | 1 |
| 1247 | $CH_3$—$(CH_2)_{13}$— | $CH_3$— | $CH_3$— | 4 | 2 | 1 | 2 |
| 1248 | $CH_3$—$(CH_2)_{13}$— | $CH_3$— | $CH_3$— | 4 | 1 | 2 | 2 |
| 1249 | $CH_3$—$(CH_2)_{13}$— | $CH_3$— | $CH_3$— | 2 | 2 | 4 | 3 |
| 1250 | $CH_3$—$(CH_2)_{13}$— | $CH_3$— | $CH_3$— | 2 | 2 | 3 | 4 |
| 1251 | $CH_3$—$(CH_2)_{13}$— | $CH_3$— | $CH_3$— | 2 | 4 | 2 | 3 |
| 1252 | $CH_3$—$(CH_2)_{13}$— | $CH_3$— | $CH_3$— | 2 | 3 | 2 | 4 |
| 1253 | $CH_3$—$(CH_2)_{13}$— | $CH_3$— | $CH_3$— | 2 | 4 | 3 | 2 |

-continued

| No. | $R^1$ | $R^2$ | $R^3$ | w | x | y | z |
|---|---|---|---|---|---|---|---|
| 1254 | $CH_3$—$(CH_2)_{13}$— | $CH_3$— | $CH_3$— | 2 | 3 | 4 | 2 |
| 1255 | $CH_3$—$(CH_2)_{13}$— | $CH_3$— | $CH_3$— | 4 | 2 | 2 | 3 |
| 1256 | $CH_3$—$(CH_2)_{13}$— | $CH_3$— | $CH_3$— | 4 | 2 | 3 | 2 |
| 1257 | $CH_3$—$(CH_2)_{13}$— | $CH_3$— | $CH_3$— | 4 | 3 | 2 | 2 |
| 1258 | $CH_3$—$(CH_2)_{13}$— | $CH_3$— | $CH_3$— | 3 | 2 | 2 | 4 |
| 1259 | $CH_3$—$(CH_2)_{13}$— | $CH_3$— | $CH_3$— | 3 | 2 | 4 | 2 |
| 1260 | $CH_3$—$(CH_2)_{13}$— | $CH_3$— | $CH_3$— | 3 | 4 | 2 | 2 |
| 1261 | $CH_3$—$(CH_2)_{13}$— | $CH_3$— | $CH_3$— | 3 | 3 | 1 | 2 |
| 1262 | $CH_3$—$(CH_2)_{13}$— | $CH_3$— | $CH_3$— | 3 | 3 | 2 | 1 |
| 1263 | $CH_3$—$(CH_2)_{13}$— | $CH_3$— | $CH_3$— | 3 | 1 | 3 | 2 |
| 1264 | $CH_3$—$(CH_2)_{13}$— | $CH_3$— | $CH_3$— | 3 | 2 | 3 | 1 |
| 1265 | $CH_3$—$(CH_2)_{13}$— | $CH_3$— | $CH_3$— | 3 | 1 | 2 | 3 |
| 1266 | $CH_3$—$(CH_2)_{13}$— | $CH_3$— | $CH_3$— | 3 | 2 | 1 | 3 |
| 1267 | $CH_3$—$(CH_2)_{13}$— | $CH_3$— | $CH_3$— | 1 | 3 | 3 | 2 |
| 1268 | $CH_3$—$(CH_2)_{13}$— | $CH_3$— | $CH_3$— | 1 | 3 | 2 | 3 |
| 1269 | $CH_3$—$(CH_2)_{13}$— | $CH_3$— | $CH_3$— | 1 | 2 | 3 | 3 |
| 1270 | $CH_3$—$(CH_2)_{13}$— | $CH_3$— | $CH_3$— | 2 | 3 | 3 | 1 |
| 1271 | $CH_3$—$(CH_2)_{13}$— | $CH_3$— | $CH_3$— | 2 | 3 | 1 | 3 |
| 1272 | $CH_3$—$(CH_2)_{13}$— | $CH_3$— | $CH_3$— | 2 | 1 | 3 | 3 |
| 1273 | $CH_3$—$(CH_2)_{13}$— | $CH_3$— | $CH_3$— | 3 | 3 | 1 | 4 |
| 1274 | $CH_3$—$(CH_2)_{13}$— | $CH_3$— | $CH_3$— | 3 | 3 | 4 | 1 |
| 1275 | $CH_3$—$(CH_2)_{13}$— | $CH_3$— | $CH_3$— | 3 | 1 | 3 | 4 |
| 1276 | $CH_3$—$(CH_2)_{13}$— | $CH_3$— | $CH_3$— | 3 | 4 | 3 | 1 |
| 1277 | $CH_3$—$(CH_2)_{13}$— | $CH_3$— | $CH_3$— | 3 | 1 | 4 | 3 |
| 1278 | $CH_3$—$(CH_2)_{13}$— | $CH_3$— | $CH_3$— | 3 | 4 | 1 | 3 |
| 1279 | $CH_3$—$(CH_2)_{13}$— | $CH_3$— | $CH_3$— | 1 | 3 | 3 | 4 |
| 1280 | $CH_3$—$(CH_2)_{13}$— | $CH_3$— | $CH_3$— | 1 | 3 | 4 | 3 |
| 1281 | $CH_3$—$(CH_2)_{13}$— | $CH_3$— | $CH_3$— | 1 | 4 | 3 | 3 |
| 1282 | $CH_3$—$(CH_2)_{13}$— | $CH_3$— | $CH_3$— | 4 | 3 | 3 | 1 |
| 1283 | $CH_3$—$(CH_2)_{13}$— | $CH_3$— | $CH_3$— | 4 | 3 | 1 | 3 |
| 1284 | $CH_3$—$(CH_2)_{13}$— | $CH_3$— | $CH_3$— | 4 | 1 | 3 | 3 |
| 1285 | $CH_3$—$(CH_2)_{13}$— | $CH_3$— | $CH_3$— | 3 | 3 | 4 | 2 |
| 1286 | $CH_3$—$(CH_2)_{13}$— | $CH_3$— | $CH_3$— | 3 | 3 | 2 | 4 |
| 1287 | $CH_3$—$(CH_2)_{13}$— | $CH_3$— | $CH_3$— | 3 | 4 | 3 | 2 |
| 1288 | $CH_3$—$(CH_2)_{13}$— | $CH_3$— | $CH_3$— | 3 | 2 | 3 | 4 |
| 1289 | $CH_3$—$(CH_2)_{13}$— | $CH_3$— | $CH_3$— | 3 | 4 | 2 | 3 |
| 1290 | $CH_3$—$(CH_2)_{13}$— | $CH_3$— | $CH_3$— | 3 | 2 | 4 | 3 |
| 1291 | $CH_3$—$(CH_2)_{13}$— | $CH_3$— | $CH_3$— | 4 | 3 | 3 | 2 |
| 1292 | $CH_3$—$(CH_2)_{13}$— | $CH_3$— | $CH_3$— | 4 | 3 | 2 | 3 |
| 1293 | $CH_3$—$(CH_2)_{13}$— | $CH_3$— | $CH_3$— | 4 | 2 | 3 | 3 |
| 1294 | $CH_3$—$(CH_2)_{13}$— | $CH_3$— | $CH_3$— | 2 | 3 | 3 | 4 |
| 1295 | $CH_3$—$(CH_2)_{13}$— | $CH_3$— | $CH_3$— | 2 | 3 | 4 | 3 |
| 1296 | $CH_3$—$(CH_2)_{13}$— | $CH_3$— | $CH_3$— | 2 | 4 | 3 | 3 |
| 1297 | $CH_3$—$(CH_2)_{13}$— | $CH_3$— | $CH_3$— | 4 | 4 | 1 | 2 |
| 1298 | $CH_3$—$(CH_2)_{13}$— | $CH_3$— | $CH_3$— | 4 | 4 | 2 | 1 |
| 1299 | $CH_3$—$(CH_2)_{13}$— | $CH_3$— | $CH_3$— | 4 | 1 | 4 | 2 |
| 1300 | $CH_3$—$(CH_2)_{13}$— | $CH_3$— | $CH_3$— | 4 | 2 | 4 | 1 |
| 1301 | $CH_3$—$(CH_2)_{13}$— | $CH_3$— | $CH_3$— | 4 | 1 | 2 | 4 |
| 1302 | $CH_3$—$(CH_2)_{13}$— | $CH_3$— | $CH_3$— | 4 | 2 | 1 | 4 |
| 1303 | $CH_3$—$(CH_2)_{13}$— | $CH_3$— | $CH_3$— | 1 | 4 | 4 | 2 |
| 1304 | $CH_3$—$(CH_2)_{13}$— | $CH_3$— | $CH_3$— | 1 | 4 | 2 | 4 |
| 1305 | $CH_3$—$(CH_2)_{13}$— | $CH_3$— | $CH_3$— | 1 | 2 | 4 | 4 |
| 1306 | $CH_3$—$(CH_2)_{13}$— | $CH_3$— | $CH_3$— | 2 | 4 | 4 | 1 |
| 1307 | $CH_3$—$(CH_2)_{13}$— | $CH_3$— | $CH_3$— | 2 | 4 | 1 | 4 |
| 1308 | $CH_3$—$(CH_2)_{13}$— | $CH_3$— | $CH_3$— | 2 | 1 | 4 | 4 |
| 1309 | $CH_3$—$(CH_2)_{13}$— | $CH_3$— | $CH_3$— | 4 | 4 | 1 | 3 |
| 1310 | $CH_3$—$(CH_2)_{13}$— | $CH_3$— | $CH_3$— | 4 | 4 | 3 | 1 |
| 1311 | $CH_3$—$(CH_2)_{13}$— | $CH_3$— | $CH_3$— | 4 | 1 | 4 | 3 |
| 1312 | $CH_3$—$(CH_2)_{13}$— | $CH_3$— | $CH_3$— | 4 | 3 | 4 | 1 |
| 1313 | $CH_3$—$(CH_2)_{13}$— | $CH_3$— | $CH_3$— | 4 | 1 | 3 | 4 |
| 1314 | $CH_3$—$(CH_2)_{13}$— | $CH_3$— | $CH_3$— | 4 | 3 | 1 | 4 |
| 1315 | $CH_3$—$(CH_2)_{13}$— | $CH_3$— | $CH_3$— | 1 | 4 | 4 | 3 |
| 1316 | $CH_3$—$(CH_2)_{13}$— | $CH_3$— | $CH_3$— | 1 | 4 | 3 | 4 |
| 1317 | $CH_3$—$(CH_2)_{13}$— | $CH_3$— | $CH_3$— | 1 | 3 | 4 | 4 |
| 1318 | $CH_3$—$(CH_2)_{13}$— | $CH_3$— | $CH_3$— | 3 | 4 | 4 | 1 |
| 1319 | $CH_3$—$(CH_2)_{13}$— | $CH_3$— | $CH_3$— | 3 | 4 | 1 | 4 |
| 1320 | $CH_3$—$(CH_2)_{13}$— | $CH_3$— | $CH_3$— | 3 | 1 | 4 | 4 |
| 1321 | $CH_3$—$(CH_2)_{13}$— | $CH_3$— | $CH_3$— | 4 | 4 | 3 | 2 |
| 1322 | $CH_3$—$(CH_2)_{13}$— | $CH_3$— | $CH_3$— | 4 | 4 | 2 | 3 |
| 1323 | $CH_3$—$(CH_2)_{13}$— | $CH_3$— | $CH_3$— | 4 | 3 | 4 | 2 |
| 1324 | $CH_3$—$(CH_2)_{13}$— | $CH_3$— | $CH_3$— | 4 | 2 | 4 | 3 |
| 1325 | $CH_3$—$(CH_2)_{13}$— | $CH_3$— | $CH_3$— | 4 | 3 | 2 | 4 |
| 1326 | $CH_3$—$(CH_2)_{13}$— | $CH_3$— | $CH_3$— | 4 | 2 | 3 | 4 |
| 1327 | $CH_3$—$(CH_2)_{13}$— | $CH_3$— | $CH_3$— | 3 | 4 | 4 | 2 |
| 1328 | $CH_3$—$(CH_2)_{13}$— | $CH_3$— | $CH_3$— | 3 | 4 | 2 | 4 |
| 1329 | $CH_3$—$(CH_2)_{13}$— | $CH_3$— | $CH_3$— | 3 | 2 | 4 | 4 |
| 1330 | $CH_3$—$(CH_2)_{13}$— | $CH_3$— | $CH_3$— | 2 | 4 | 4 | 3 |

-continued

| No. | $R^1$ | $R^2$ | $R^3$ | w | x | y | z |
|---|---|---|---|---|---|---|---|
| 1331 | $CH_3$—$(CH_2)_{13}$— | $CH_3$— | $CH_3$— | 2 | 4 | 3 | 4 |
| 1332 | $CH_3$—$(CH_2)_{13}$— | $CH_3$— | $CH_3$— | 2 | 3 | 4 | 4 |
| 1333 | $CH_3$—$(CH_2)_{13}$— | $CH_3$— | $CH_3$— | 1 | 2 | 3 | 4 |
| 1334 | $CH_3$—$(CH_2)_{13}$— | $CH_3$— | $CH_3$— | 1 | 2 | 4 | 3 |
| 1335 | $CH_3$—$(CH_2)_{13}$— | $CH_3$— | $CH_3$— | 1 | 3 | 2 | 4 |
| 1336 | $CH_3$—$(CH_2)_{13}$— | $CH_3$— | $CH_3$— | 1 | 3 | 4 | 2 |
| 1337 | $CH_3$—$(CH_2)_{13}$— | $CH_3$— | $CH_3$— | 1 | 4 | 2 | 3 |
| 1338 | $CH_3$—$(CH_2)_{13}$— | $CH_3$— | $CH_3$— | 1 | 4 | 3 | 2 |
| 1339 | $CH_3$—$(CH_2)_{13}$— | $CH_3$— | $CH_3$— | 2 | 1 | 3 | 4 |
| 1340 | $CH_3$—$(CH_2)_{13}$— | $CH_3$— | $CH_3$— | 2 | 1 | 4 | 3 |
| 1341 | $CH_3$—$(CH_2)_{13}$— | $CH_3$— | $CH_3$— | 2 | 3 | 1 | 4 |
| 1342 | $CH_3$—$(CH_2)_{13}$— | $CH_3$— | $CH_3$— | 2 | 3 | 4 | 1 |
| 1343 | $CH_3$—$(CH_2)_{13}$— | $CH_3$— | $CH_3$— | 2 | 4 | 1 | 3 |
| 1344 | $CH_3$—$(CH_2)_{13}$— | $CH_3$— | $CH_3$— | 2 | 4 | 3 | 1 |
| 1345 | $CH_3$—$(CH_2)_{13}$— | $CH_3$— | $CH_3$— | 3 | 1 | 2 | 4 |
| 1346 | $CH_3$—$(CH_2)_{13}$— | $CH_3$— | $CH_3$— | 3 | 1 | 4 | 2 |
| 1347 | $CH_3$—$(CH_2)_{13}$— | $CH_3$— | $CH_3$— | 3 | 2 | 1 | 4 |
| 1348 | $CH_3$—$(CH_2)_{13}$— | $CH_3$— | $CH_3$— | 3 | 2 | 4 | 1 |
| 1349 | $CH_3$—$(CH_2)_{13}$— | $CH_3$— | $CH_3$— | 3 | 4 | 1 | 2 |
| 1350 | $CH_3$—$(CH_2)_{13}$— | $CH_3$— | $CH_3$— | 3 | 4 | 2 | 1 |
| 1351 | $CH_3$—$(CH_2)_{13}$— | $CH_3$— | $CH_3$— | 4 | 1 | 2 | 3 |
| 1352 | $CH_3$—$(CH_2)_{13}$— | $CH_3$— | $CH_3$— | 4 | 1 | 3 | 2 |
| 1353 | $CH_3$—$(CH_2)_{13}$— | $CH_3$— | $CH_3$— | 4 | 2 | 1 | 3 |
| 1354 | $CH_3$—$(CH_2)_{13}$— | $CH_3$— | $CH_3$— | 4 | 2 | 3 | 1 |
| 1355 | $CH_3$—$(CH_2)_{13}$— | $CH_3$— | $CH_3$— | 4 | 3 | 1 | 2 |
| 1356 | $CH_3$—$(CH_2)_{13}$— | $CH_3$— | $CH_3$— | 4 | 3 | 2 | 1 |
| 1357 | $CH_3$—$(CH_2)_{13}$— | $CH_3$— | $CH_3$— | 2 | 3 | 3 | 2 |
| 1358 | $CH_3$—$(CH_2)_{13}$— | $CH_3$— | $CH_3$— | 2 | 3 | 2 | 3 |
| 1359 | $CH_3$—$(CH_2)_{13}$— | $CH_3$— | $CH_3$— | 2 | 2 | 3 | 3 |
| 1360 | $CH_3$—$(CH_2)_{13}$— | $CH_3$— | $CH_3$— | 3 | 3 | 2 | 2 |
| 1361 | $CH_3$—$(CH_2)_{13}$— | $CH_3$— | $CH_3$— | 3 | 2 | 3 | 2 |
| 1362 | $CH_3$—$(CH_2)_{13}$— | $CH_3$— | $CH_3$— | 3 | 2 | 2 | 3 |
| 1363 | $CH_3$—$(CH_2)_{13}$— | $CH_3$— | $CH_3$— | 2 | 4 | 4 | 2 |
| 1364 | $CH_3$—$(CH_2)_{13}$— | $CH_3$— | $CH_3$— | 2 | 4 | 2 | 4 |
| 1365 | $CH_3$—$(CH_2)_{13}$— | $CH_3$— | $CH_3$— | 2 | 2 | 4 | 4 |
| 1366 | $CH_3$—$(CH_2)_{13}$— | $CH_3$— | $CH_3$— | 4 | 4 | 2 | 2 |
| 1367 | $CH_3$—$(CH_2)_{13}$— | $CH_3$— | $CH_3$— | 4 | 2 | 4 | 2 |
| 1368 | $CH_3$—$(CH_2)_{13}$— | $CH_3$— | $CH_3$— | 4 | 2 | 2 | 4 |
| 1369 | $CH_3$—$(CH_2)_{13}$— | $CH_3$— | $CH_3$— | 3 | 4 | 4 | 3 |
| 1370 | $CH_3$—$(CH_2)_{13}$— | $CH_3$— | $CH_3$— | 3 | 4 | 3 | 4 |
| 1371 | $CH_3$—$(CH_2)_{13}$— | $CH_3$— | $CH_3$— | 3 | 3 | 4 | 4 |
| 1372 | $CH_3$—$(CH_2)_{13}$— | $CH_3$— | $CH_3$— | 4 | 4 | 3 | 3 |
| 1373 | $CH_3$—$(CH_2)_{13}$— | $CH_3$— | $CH_3$— | 4 | 3 | 4 | 3 |
| 1374 | $CH_3$—$(CH_2)_{13}$— | $CH_3$— | $CH_3$— | 4 | 3 | 3 | 4 |
| 1375 | $CH_3$—$(CH_2)_{14}$— | $CH_3$— | $CH_3$— | 1 | 1 | 1 | 1 |
| 1376 | $CH_3$—$(CH_2)_{14}$— | $CH_3$— | $CH_3$— | 2 | 1 | 1 | 1 |
| 1377 | $CH_3$—$(CH_2)_{14}$— | $CH_3$— | $CH_3$— | 1 | 2 | 1 | 1 |
| 1378 | $CH_3$—$(CH_2)_{14}$— | $CH_3$— | $CH_3$— | 1 | 1 | 2 | 1 |
| 1379 | $CH_3$—$(CH_2)_{14}$— | $CH_3$— | $CH_3$— | 1 | 1 | 1 | 2 |
| 1380 | $CH_3$—$(CH_2)_{14}$— | $CH_3$— | $CH_3$— | 3 | 1 | 1 | 1 |
| 1381 | $CH_3$—$(CH_2)_{14}$— | $CH_3$— | $CH_3$— | 1 | 3 | 1 | 1 |
| 1382 | $CH_3$—$(CH_2)_{14}$— | $CH_3$— | $CH_3$— | 1 | 1 | 3 | 1 |
| 1383 | $CH_3$—$(CH_2)_{14}$— | $CH_3$— | $CH_3$— | 1 | 1 | 1 | 3 |
| 1384 | $CH_3$—$(CH_2)_{14}$— | $CH_3$— | $CH_3$— | 4 | 1 | 1 | 1 |
| 1385 | $CH_3$—$(CH_2)_{14}$— | $CH_3$— | $CH_3$— | 1 | 4 | 1 | 1 |
| 1386 | $CH_3$—$(CH_2)_{14}$— | $CH_3$— | $CH_3$— | 1 | 1 | 4 | 1 |
| 1387 | $CH_3$—$(CH_2)_{14}$— | $CH_3$— | $CH_3$— | 1 | 1 | 1 | 4 |
| 1388 | $CH_3$—$(CH_2)_{14}$— | $CH_3$— | $CH_3$— | 1 | 2 | 2 | 1 |
| 1389 | $CH_3$—$(CH_2)_{14}$— | $CH_3$— | $CH_3$— | 1 | 2 | 1 | 2 |
| 1390 | $CH_3$—$(CH_2)_{14}$— | $CH_3$— | $CH_3$— | 1 | 1 | 2 | 2 |
| 1391 | $CH_3$—$(CH_2)_{14}$— | $CH_3$— | $CH_3$— | 2 | 2 | 1 | 1 |
| 1392 | $CH_3$—$(CH_2)_{14}$— | $CH_3$— | $CH_3$— | 2 | 1 | 2 | 1 |
| 1393 | $CH_3$—$(CH_2)_{14}$— | $CH_3$— | $CH_3$— | 2 | 1 | 1 | 2 |
| 1394 | $CH_3$—$(CH_2)_{14}$— | $CH_3$— | $CH_3$— | 1 | 3 | 3 | 1 |
| 1395 | $CH_3$—$(CH_2)_{14}$— | $CH_3$— | $CH_3$— | 1 | 3 | 1 | 3 |
| 1396 | $CH_3$—$(CH_2)_{14}$— | $CH_3$— | $CH_3$— | 1 | 1 | 3 | 3 |
| 1397 | $CH_3$—$(CH_2)_{14}$— | $CH_3$— | $CH_3$— | 3 | 3 | 1 | 1 |
| 1398 | $CH_3$—$(CH_2)_{14}$— | $CH_3$— | $CH_3$— | 3 | 1 | 3 | 1 |
| 1399 | $CH_3$—$(CH_2)_{14}$— | $CH_3$— | $CH_3$— | 3 | 1 | 1 | 3 |
| 1400 | $CH_3$—$(CH_2)_{14}$— | $CH_3$— | $CH_3$— | 1 | 4 | 4 | 1 |
| 1401 | $CH_3$—$(CH_2)_{14}$— | $CH_3$— | $CH_3$— | 1 | 4 | 1 | 4 |
| 1402 | $CH_3$—$(CH_2)_{14}$— | $CH_3$— | $CH_3$— | 1 | 1 | 4 | 4 |
| 1403 | $CH_3$—$(CH_2)_{14}$— | $CH_3$— | $CH_3$— | 4 | 4 | 1 | 1 |
| 1404 | $CH_3$—$(CH_2)_{14}$— | $CH_3$— | $CH_3$— | 4 | 1 | 4 | 1 |
| 1405 | $CH_3$—$(CH_2)_{14}$— | $CH_3$— | $CH_3$— | 4 | 1 | 1 | 4 |
| 1406 | $CH_3$—$(CH_2)_{14}$— | $CH_3$— | $CH_3$— | 1 | 1 | 2 | 3 |
| 1407 | $CH_3$—$(CH_2)_{14}$— | $CH_3$— | $CH_3$— | 1 | 1 | 3 | 2 |

-continued

| No. | $R^1$ | $R^2$ | $R^3$ | w | x | y | z |
|---|---|---|---|---|---|---|---|
| 1408 | $CH_3$—$(CH_2)_{14}$— | $CH_3$— | $CH_3$— | 1 | 2 | 3 | 1 |
| 1409 | $CH_3$—$(CH_2)_{14}$— | $CH_3$— | $CH_3$— | 1 | 3 | 2 | 1 |
| 1410 | $CH_3$—$(CH_2)_{14}$— | $CH_3$— | $CH_3$— | 1 | 2 | 1 | 3 |
| 1411 | $CH_3$—$(CH_2)_{14}$— | $CH_3$— | $CH_3$— | 1 | 3 | 1 | 2 |
| 1412 | $CH_3$—$(CH_2)_{14}$— | $CH_3$— | $CH_3$— | 2 | 1 | 1 | 3 |
| 1413 | $CH_3$—$(CH_2)_{14}$— | $CH_3$— | $CH_3$— | 2 | 1 | 3 | 1 |
| 1414 | $CH_3$—$(CH_2)_{14}$— | $CH_3$— | $CH_3$— | 2 | 3 | 1 | 1 |
| 1415 | $CH_3$—$(CH_2)_{14}$— | $CH_3$— | $CH_3$— | 3 | 1 | 1 | 2 |
| 1416 | $CH_3$—$(CH_2)_{14}$— | $CH_3$— | $CH_3$— | 3 | 1 | 2 | 1 |
| 1417 | $CH_3$—$(CH_2)_{14}$— | $CH_3$— | $CH_3$— | 3 | 2 | 1 | 1 |
| 1418 | $CH_3$—$(CH_2)_{14}$— | $CH_3$— | $CH_3$— | 1 | 1 | 2 | 4 |
| 1419 | $CH_3$—$(CH_2)_{14}$— | $CH_3$— | $CH_3$— | 1 | 1 | 4 | 2 |
| 1420 | $CH_3$—$(CH_2)_{14}$— | $CH_3$— | $CH_3$— | 1 | 2 | 4 | 1 |
| 1421 | $CH_3$—$(CH_2)_{14}$— | $CH_3$— | $CH_3$— | 1 | 4 | 2 | 1 |
| 1422 | $CH_3$—$(CH_2)_{14}$— | $CH_3$— | $CH_3$— | 1 | 2 | 1 | 4 |
| 1423 | $CH_3$—$(CH_2)_{14}$— | $CH_3$— | $CH_3$— | 1 | 4 | 1 | 2 |
| 1424 | $CH_3$—$(CH_2)_{14}$— | $CH_3$— | $CH_3$— | 2 | 1 | 1 | 4 |
| 1425 | $CH_3$—$(CH_2)_{14}$— | $CH_3$— | $CH_3$— | 2 | 1 | 4 | 1 |
| 1426 | $CH_3$—$(CH_2)_{14}$— | $CH_3$— | $CH_3$— | 2 | 4 | 1 | 1 |
| 1427 | $CH_3$—$(CH_2)_{14}$— | $CH_3$— | $CH_3$— | 4 | 1 | 1 | 2 |
| 1428 | $CH_3$—$(CH_2)_{14}$— | $CH_3$— | $CH_3$— | 4 | 1 | 2 | 1 |
| 1429 | $CH_3$—$(CH_2)_{14}$— | $CH_3$— | $CH_3$— | 4 | 2 | 1 | 1 |
| 1430 | $CH_3$—$(CH_2)_{14}$— | $CH_3$— | $CH_3$— | 1 | 1 | 4 | 3 |
| 1431 | $CH_3$—$(CH_2)_{14}$— | $CH_3$— | $CH_3$— | 1 | 1 | 3 | 4 |
| 1432 | $CH_3$—$(CH_2)_{14}$— | $CH_3$— | $CH_3$— | 1 | 4 | 3 | 1 |
| 1433 | $CH_3$—$(CH_2)_{14}$— | $CH_3$— | $CH_3$— | 1 | 3 | 4 | 1 |
| 1434 | $CH_3$—$(CH_2)_{14}$— | $CH_3$— | $CH_3$— | 1 | 4 | 1 | 3 |
| 1435 | $CH_3$—$(CH_2)_{14}$— | $CH_3$— | $CH_3$— | 1 | 3 | 1 | 4 |
| 1436 | $CH_3$—$(CH_2)_{14}$— | $CH_3$— | $CH_3$— | 4 | 1 | 1 | 3 |
| 1437 | $CH_3$—$(CH_2)_{14}$— | $CH_3$— | $CH_3$— | 4 | 1 | 3 | 1 |
| 1438 | $CH_3$—$(CH_2)_{14}$— | $CH_3$— | $CH_3$— | 4 | 3 | 1 | 1 |
| 1439 | $CH_3$—$(CH_2)_{14}$— | $CH_3$— | $CH_3$— | 3 | 1 | 1 | 4 |
| 1440 | $CH_3$—$(CH_2)_{14}$— | $CH_3$— | $CH_3$— | 3 | 1 | 4 | 1 |
| 1441 | $CH_3$—$(CH_2)_{14}$— | $CH_3$— | $CH_3$— | 3 | 4 | 1 | 1 |
| 1442 | $CH_3$—$(CH_2)_{14}$— | $CH_3$— | $CH_3$— | 1 | 2 | 2 | 2 |
| 1443 | $CH_3$—$(CH_2)_{14}$— | $CH_3$— | $CH_3$— | 2 | 1 | 2 | 2 |
| 1444 | $CH_3$—$(CH_2)_{14}$— | $CH_3$— | $CH_3$— | 2 | 2 | 1 | 2 |
| 1445 | $CH_3$—$(CH_2)_{14}$— | $CH_3$— | $CH_3$— | 2 | 2 | 2 | 1 |
| 1446 | $CH_3$—$(CH_2)_{14}$— | $CH_3$— | $CH_3$— | 1 | 3 | 3 | 3 |
| 1447 | $CH_3$—$(CH_2)_{14}$— | $CH_3$— | $CH_3$— | 3 | 1 | 3 | 3 |
| 1448 | $CH_3$—$(CH_2)_{14}$— | $CH_3$— | $CH_3$— | 3 | 3 | 1 | 3 |
| 1449 | $CH_3$—$(CH_2)_{14}$— | $CH_3$— | $CH_3$— | 3 | 3 | 3 | 1 |
| 1450 | $CH_3$—$(CH_2)_{14}$— | $CH_3$— | $CH_3$— | 1 | 4 | 4 | 4 |
| 1451 | $CH_3$—$(CH_2)_{14}$— | $CH_3$— | $CH_3$— | 4 | 1 | 4 | 4 |
| 1452 | $CH_3$—$(CH_2)_{14}$— | $CH_3$— | $CH_3$— | 4 | 4 | 1 | 4 |
| 1453 | $CH_3$—$(CH_2)_{14}$— | $CH_3$— | $CH_3$— | 4 | 4 | 4 | 1 |
| 1454 | $CH_3$—$(CH_2)_{14}$— | $CH_3$— | $CH_3$— | 2 | 2 | 1 | 3 |
| 1455 | $CH_3$—$(CH_2)_{14}$— | $CH_3$— | $CH_3$— | 2 | 2 | 3 | 1 |
| 1456 | $CH_3$—$(CH_2)_{14}$— | $CH_3$— | $CH_3$— | 2 | 1 | 2 | 3 |
| 1457 | $CH_3$—$(CH_2)_{14}$— | $CH_3$— | $CH_3$— | 2 | 3 | 2 | 1 |
| 1458 | $CH_3$—$(CH_2)_{14}$— | $CH_3$— | $CH_3$— | 2 | 1 | 3 | 2 |
| 1459 | $CH_3$—$(CH_2)_{14}$— | $CH_3$— | $CH_3$— | 2 | 3 | 1 | 2 |
| 1460 | $CH_3$—$(CH_2)_{14}$— | $CH_3$— | $CH_3$— | 1 | 2 | 2 | 3 |
| 1461 | $CH_3$—$(CH_2)_{14}$— | $CH_3$— | $CH_3$— | 1 | 2 | 3 | 2 |
| 1462 | $CH_3$—$(CH_2)_{14}$— | $CH_3$— | $CH_3$— | 1 | 3 | 2 | 2 |
| 1463 | $CH_3$—$(CH_2)_{14}$— | $CH_3$— | $CH_3$— | 3 | 2 | 2 | 1 |
| 1464 | $CH_3$—$(CH_2)_{14}$— | $CH_3$— | $CH_3$— | 3 | 2 | 1 | 2 |
| 1465 | $CH_3$—$(CH_2)_{14}$— | $CH_3$— | $CH_3$— | 3 | 1 | 2 | 2 |
| 1466 | $CH_3$—$(CH_2)_{14}$— | $CH_3$— | $CH_3$— | 2 | 2 | 1 | 4 |
| 1467 | $CH_3$—$(CH_2)_{14}$— | $CH_3$— | $CH_3$— | 2 | 2 | 4 | 1 |
| 1468 | $CH_3$—$(CH_2)_{14}$— | $CH_3$— | $CH_3$— | 2 | 1 | 2 | 4 |
| 1469 | $CH_3$—$(CH_2)_{14}$— | $CH_3$— | $CH_3$— | 2 | 4 | 2 | 1 |
| 1470 | $CH_3$—$(CH_2)_{14}$— | $CH_3$— | $CH_3$— | 2 | 1 | 4 | 2 |
| 1471 | $CH_3$—$(CH_2)_{14}$— | $CH_3$— | $CH_3$— | 2 | 4 | 1 | 2 |
| 1472 | $CH_3$—$(CH_2)_{14}$— | $CH_3$— | $CH_3$— | 1 | 2 | 2 | 4 |
| 1473 | $CH_3$—$(CH_2)_{14}$— | $CH_3$— | $CH_3$— | 1 | 2 | 4 | 2 |
| 1474 | $CH_3$—$(CH_2)_{14}$— | $CH_3$— | $CH_3$— | 1 | 4 | 2 | 2 |
| 1475 | $CH_3$—$(CH_2)_{14}$— | $CH_3$— | $CH_3$— | 4 | 2 | 2 | 1 |
| 1476 | $CH_3$—$(CH_2)_{14}$— | $CH_3$— | $CH_3$— | 4 | 2 | 1 | 2 |
| 1477 | $CH_3$—$(CH_2)_{14}$— | $CH_3$— | $CH_3$— | 4 | 1 | 2 | 2 |
| 1478 | $CH_3$—$(CH_2)_{14}$— | $CH_3$— | $CH_3$— | 2 | 2 | 4 | 3 |
| 1479 | $CH_3$—$(CH_2)_{14}$— | $CH_3$— | $CH_3$— | 2 | 2 | 3 | 4 |
| 1480 | $CH_3$—$(CH_2)_{14}$— | $CH_3$— | $CH_3$— | 2 | 4 | 2 | 3 |
| 1481 | $CH_3$—$(CH_2)_{14}$— | $CH_3$— | $CH_3$— | 2 | 3 | 2 | 4 |
| 1482 | $CH_3$—$(CH_2)_{14}$— | $CH_3$— | $CH_3$— | 2 | 4 | 3 | 2 |
| 1483 | $CH_3$—$(CH_2)_{14}$— | $CH_3$— | $CH_3$— | 2 | 3 | 4 | 2 |
| 1484 | $CH_3$—$(CH_2)_{14}$— | $CH_3$— | $CH_3$— | 4 | 2 | 2 | 3 |

-continued

| No. | $R^1$ | $R^2$ | $R^3$ | w | x | y | z |
|---|---|---|---|---|---|---|---|
| 1485 | $CH_3$—$(CH_2)_{14}$— | $CH_3$— | $CH_3$— | 4 | 2 | 3 | 2 |
| 1486 | $CH_3$—$(CH_2)_{14}$— | $CH_3$— | $CH_3$— | 4 | 3 | 2 | 2 |
| 1487 | $CH_3$—$(CH_2)_{14}$— | $CH_3$— | $CH_3$— | 3 | 2 | 2 | 4 |
| 1488 | $CH_3$—$(CH_2)_{14}$— | $CH_3$— | $CH_3$— | 3 | 2 | 4 | 2 |
| 1489 | $CH_3$—$(CH_2)_{14}$— | $CH_3$— | $CH_3$— | 3 | 4 | 2 | 2 |
| 1490 | $CH_3$—$(CH_2)_{14}$— | $CH_3$— | $CH_3$— | 3 | 3 | 1 | 2 |
| 1491 | $CH_3$—$(CH_2)_{14}$— | $CH_3$— | $CH_3$— | 3 | 3 | 2 | 1 |
| 1492 | $CH_3$—$(CH_2)_{14}$— | $CH_3$— | $CH_3$— | 3 | 1 | 3 | 2 |
| 1493 | $CH_3$—$(CH_2)_{14}$— | $CH_3$— | $CH_3$— | 3 | 2 | 3 | 1 |
| 1494 | $CH_3$—$(CH_2)_{14}$— | $CH_3$— | $CH_3$— | 3 | 1 | 2 | 3 |
| 1495 | $CH_3$—$(CH_2)_{14}$— | $CH_3$— | $CH_3$— | 3 | 2 | 1 | 3 |
| 1496 | $CH_3$—$(CH_2)_{14}$— | $CH_3$— | $CH_3$— | 1 | 3 | 3 | 2 |
| 1497 | $CH_3$—$(CH_2)_{14}$— | $CH_3$— | $CH_3$— | 1 | 3 | 2 | 3 |
| 1498 | $CH_3$—$(CH_2)_{14}$— | $CH_3$— | $CH_3$— | 1 | 2 | 3 | 3 |
| 1499 | $CH_3$—$(CH_2)_{14}$— | $CH_3$— | $CH_3$— | 2 | 3 | 3 | 1 |
| 1500 | $CH_3$—$(CH_2)_{14}$— | $CH_3$— | $CH_3$— | 2 | 3 | 1 | 3 |
| 1501 | $CH_3$—$(CH_2)_{14}$— | $CH_3$— | $CH_3$— | 2 | 1 | 3 | 3 |
| 1502 | $CH_3$—$(CH_2)_{14}$— | $CH_3$— | $CH_3$— | 3 | 3 | 1 | 4 |
| 1503 | $CH_3$—$(CH_2)_{14}$— | $CH_3$— | $CH_3$— | 3 | 3 | 4 | 1 |
| 1504 | $CH_3$—$(CH_2)_{14}$— | $CH_3$— | $CH_3$— | 3 | 1 | 3 | 4 |
| 1505 | $CH_3$—$(CH_2)_{14}$— | $CH_3$— | $CH_3$— | 3 | 4 | 3 | 1 |
| 1506 | $CH_3$—$(CH_2)_{14}$— | $CH_3$— | $CH_3$— | 3 | 1 | 4 | 3 |
| 1507 | $CH_3$—$(CH_2)_{14}$— | $CH_3$— | $CH_3$— | 3 | 4 | 1 | 3 |
| 1508 | $CH_3$—$(CH_2)_{14}$— | $CH_3$— | $CH_3$— | 1 | 3 | 3 | 4 |
| 1509 | $CH_3$—$(CH_2)_{14}$— | $CH_3$— | $CH_3$— | 1 | 3 | 4 | 3 |
| 1510 | $CH_3$—$(CH_2)_{14}$— | $CH_3$— | $CH_3$— | 1 | 4 | 3 | 3 |
| 1511 | $CH_3$—$(CH_2)_{14}$— | $CH_3$— | $CH_3$— | 4 | 3 | 3 | 1 |
| 1512 | $CH_3$—$(CH_2)_{14}$— | $CH_3$— | $CH_3$— | 4 | 3 | 1 | 3 |
| 1513 | $CH_3$—$(CH_2)_{14}$— | $CH_3$— | $CH_3$— | 4 | 1 | 3 | 3 |
| 1514 | $CH_3$—$(CH_2)_{14}$— | $CH_3$— | $CH_3$— | 3 | 3 | 4 | 2 |
| 1515 | $CH_3$—$(CH_2)_{14}$— | $CH_3$— | $CH_3$— | 3 | 3 | 2 | 4 |
| 1516 | $CH_3$—$(CH_2)_{14}$— | $CH_3$— | $CH_3$— | 3 | 4 | 3 | 2 |
| 1517 | $CH_3$—$(CH_2)_{14}$— | $CH_3$— | $CH_3$— | 3 | 2 | 3 | 4 |
| 1518 | $CH_3$—$(CH_2)_{14}$— | $CH_3$— | $CH_3$— | 3 | 4 | 2 | 3 |
| 1519 | $CH_3$—$(CH_2)_{14}$— | $CH_3$— | $CH_3$— | 3 | 2 | 4 | 3 |
| 1520 | $CH_3$—$(CH_2)_{14}$— | $CH_3$— | $CH_3$— | 4 | 3 | 3 | 2 |
| 1521 | $CH_3$—$(CH_2)_{14}$— | $CH_3$— | $CH_3$— | 4 | 3 | 2 | 3 |
| 1522 | $CH_3$—$(CH_2)_{14}$— | $CH_3$— | $CH_3$— | 4 | 2 | 3 | 3 |
| 1523 | $CH_3$—$(CH_2)_{14}$— | $CH_3$— | $CH_3$— | 2 | 3 | 3 | 4 |
| 1524 | $CH_3$—$(CH_2)_{14}$— | $CH_3$— | $CH_3$— | 2 | 3 | 4 | 3 |
| 1525 | $CH_3$—$(CH_2)_{14}$— | $CH_3$— | $CH_3$— | 2 | 4 | 3 | 3 |
| 1526 | $CH_3$—$(CH_2)_{14}$— | $CH_3$— | $CH_3$— | 4 | 4 | 1 | 2 |
| 1527 | $CH_3$—$(CH_2)_{14}$— | $CH_3$— | $CH_3$— | 4 | 4 | 2 | 1 |
| 1528 | $CH_3$—$(CH_2)_{14}$— | $CH_3$— | $CH_3$— | 4 | 1 | 4 | 2 |
| 1529 | $CH_3$—$(CH_2)_{14}$— | $CH_3$— | $CH_3$— | 4 | 2 | 4 | 1 |
| 1530 | $CH_3$—$(CH_2)_{14}$— | $CH_3$— | $CH_3$— | 4 | 1 | 2 | 4 |
| 1531 | $CH_3$—$(CH_2)_{14}$— | $CH_3$— | $CH_3$— | 4 | 2 | 1 | 4 |
| 1532 | $CH_3$—$(CH_2)_{14}$— | $CH_3$— | $CH_3$— | 1 | 4 | 4 | 2 |
| 1533 | $CH_3$—$(CH_2)_{14}$— | $CH_3$— | $CH_3$— | 1 | 4 | 2 | 4 |
| 1534 | $CH_3$—$(CH_2)_{14}$— | $CH_3$— | $CH_3$— | 1 | 2 | 4 | 4 |
| 1535 | $CH_3$—$(CH_2)_{14}$— | $CH_3$— | $CH_3$— | 2 | 4 | 4 | 1 |
| 1536 | $CH_3$—$(CH_2)_{14}$— | $CH_3$— | $CH_3$— | 2 | 4 | 1 | 4 |
| 1537 | $CH_3$—$(CH_2)_{14}$— | $CH_3$— | $CH_3$— | 2 | 1 | 4 | 4 |
| 1538 | $CH_3$—$(CH_2)_{14}$— | $CH_3$— | $CH_3$— | 4 | 4 | 1 | 3 |
| 1539 | $CH_3$—$(CH_2)_{14}$— | $CH_3$— | $CH_3$— | 4 | 4 | 3 | 1 |
| 1540 | $CH_3$—$(CH_2)_{14}$— | $CH_3$— | $CH_3$— | 4 | 1 | 4 | 3 |
| 1541 | $CH_3$—$(CH_2)_{14}$— | $CH_3$— | $CH_3$— | 4 | 3 | 4 | 1 |
| 1542 | $CH_3$—$(CH_2)_{14}$— | $CH_3$— | $CH_3$— | 4 | 1 | 3 | 4 |
| 1543 | $CH_3$—$(CH_2)_{14}$— | $CH_3$— | $CH_3$— | 4 | 3 | 1 | 4 |
| 1544 | $CH_3$—$(CH_2)_{14}$— | $CH_3$— | $CH_3$— | 1 | 4 | 4 | 3 |
| 1545 | $CH_3$—$(CH_2)_{14}$— | $CH_3$— | $CH_3$— | 1 | 4 | 3 | 4 |
| 1546 | $CH_3$—$(CH_2)_{14}$— | $CH_3$— | $CH_3$— | 1 | 3 | 4 | 4 |
| 1547 | $CH_3$—$(CH_2)_{14}$— | $CH_3$— | $CH_3$— | 3 | 4 | 4 | 1 |
| 1548 | $CH_3$—$(CH_2)_{14}$— | $CH_3$— | $CH_3$— | 3 | 4 | 1 | 4 |
| 1549 | $CH_3$—$(CH_2)_{14}$— | $CH_3$— | $CH_3$— | 3 | 1 | 4 | 4 |
| 1550 | $CH_3$—$(CH_2)_{14}$— | $CH_3$— | $CH_3$— | 4 | 4 | 3 | 2 |
| 1551 | $CH_3$—$(CH_2)_{14}$— | $CH_3$— | $CH_3$— | 4 | 4 | 2 | 3 |
| 1552 | $CH_3$—$(CH_2)_{14}$— | $CH_3$— | $CH_3$— | 4 | 3 | 4 | 2 |
| 1553 | $CH_3$—$(CH_2)_{14}$— | $CH_3$— | $CH_3$— | 4 | 2 | 4 | 3 |
| 1554 | $CH_3$—$(CH_2)_{14}$— | $CH_3$— | $CH_3$— | 4 | 3 | 2 | 4 |
| 1555 | $CH_3$—$(CH_2)_{14}$— | $CH_3$— | $CH_3$— | 4 | 2 | 3 | 4 |
| 1556 | $CH_3$—$(CH_2)_{14}$— | $CH_3$— | $CH_3$— | 3 | 4 | 4 | 2 |
| 1557 | $CH_3$—$(CH_2)_{14}$— | $CH_3$— | $CH_3$— | 3 | 4 | 2 | 4 |
| 1558 | $CH_3$—$(CH_2)_{14}$— | $CH_3$— | $CH_3$— | 3 | 2 | 4 | 4 |
| 1559 | $CH_3$—$(CH_2)_{14}$— | $CH_3$— | $CH_3$— | 2 | 4 | 4 | 3 |
| 1560 | $CH_3$—$(CH_2)_{14}$— | $CH_3$— | $CH_3$— | 2 | 4 | 3 | 4 |
| 1561 | $CH_3$—$(CH_2)_{14}$— | $CH_3$— | $CH_3$— | 2 | 3 | 4 | 4 |

-continued

| No. | $R^1$ | $R^2$ | $R^3$ | w | x | y | z |
|---|---|---|---|---|---|---|---|
| 1562 | $CH_3$—$(CH_2)_{14}$— | $CH_3$— | $CH_3$— | 1 | 2 | 3 | 4 |
| 1563 | $CH_3$—$(CH_2)_{14}$— | $CH_3$— | $CH_3$— | 1 | 2 | 4 | 3 |
| 1564 | $CH_3$—$(CH_2)_{14}$— | $CH_3$— | $CH_3$— | 1 | 3 | 2 | 4 |
| 1565 | $CH_3$—$(CH_2)_{14}$— | $CH_3$— | $CH_3$— | 1 | 3 | 4 | 2 |
| 1566 | $CH_3$—$(CH_2)_{14}$— | $CH_3$— | $CH_3$— | 1 | 4 | 2 | 3 |
| 1567 | $CH_3$—$(CH_2)_{14}$— | $CH_3$— | $CH_3$— | 1 | 4 | 3 | 2 |
| 1568 | $CH_3$—$(CH_2)_{14}$— | $CH_3$— | $CH_3$— | 2 | 1 | 3 | 4 |
| 1569 | $CH_3$—$(CH_2)_{14}$— | $CH_3$— | $CH_3$— | 2 | 1 | 4 | 3 |
| 1570 | $CH_3$—$(CH_2)_{14}$— | $CH_3$— | $CH_3$— | 2 | 3 | 1 | 4 |
| 1571 | $CH_3$—$(CH_2)_{14}$— | $CH_3$— | $CH_3$— | 2 | 3 | 4 | 1 |
| 1572 | $CH_3$—$(CH_2)_{14}$— | $CH_3$— | $CH_3$— | 2 | 4 | 1 | 3 |
| 1573 | $CH_3$—$(CH_2)_{14}$— | $CH_3$— | $CH_3$— | 2 | 4 | 3 | 1 |
| 1574 | $CH_3$—$(CH_2)_{14}$— | $CH_3$— | $CH_3$— | 3 | 1 | 2 | 4 |
| 1575 | $CH_3$—$(CH_2)_{14}$— | $CH_3$— | $CH_3$— | 3 | 1 | 4 | 2 |
| 1576 | $CH_3$—$(CH_2)_{14}$— | $CH_3$— | $CH_3$— | 3 | 2 | 1 | 4 |
| 1577 | $CH_3$—$(CH_2)_{14}$— | $CH_3$— | $CH_3$— | 3 | 2 | 4 | 1 |
| 1578 | $CH_3$—$(CH_2)_{14}$— | $CH_3$— | $CH_3$— | 3 | 4 | 1 | 2 |
| 1579 | $CH_3$—$(CH_2)_{14}$— | $CH_3$— | $CH_3$— | 3 | 4 | 2 | 1 |
| 1580 | $CH_3$—$(CH_2)_{14}$— | $CH_3$— | $CH_3$— | 4 | 1 | 2 | 3 |
| 1581 | $CH_3$—$(CH_2)_{14}$— | $CH_3$— | $CH_3$— | 4 | 1 | 3 | 2 |
| 1582 | $CH_3$—$(CH_2)_{14}$— | $CH_3$— | $CH_3$— | 4 | 2 | 1 | 3 |
| 1583 | $CH_3$—$(CH_2)_{14}$— | $CH_3$— | $CH_3$— | 4 | 2 | 3 | 1 |
| 1584 | $CH_3$—$(CH_2)_{14}$— | $CH_3$— | $CH_3$— | 4 | 3 | 1 | 2 |
| 1585 | $CH_3$—$(CH_2)_{14}$— | $CH_3$— | $CH_3$— | 4 | 3 | 2 | 1 |
| 1586 | $CH_3$—$(CH_2)_{14}$— | $CH_3$— | $CH_3$— | 2 | 3 | 3 | 2 |
| 1587 | $CH_3$—$(CH_2)_{14}$— | $CH_3$— | $CH_3$— | 2 | 3 | 2 | 3 |
| 1588 | $CH_3$—$(CH_2)_{14}$— | $CH_3$— | $CH_3$— | 2 | 2 | 3 | 3 |
| 1589 | $CH_3$—$(CH_2)_{14}$— | $CH_3$— | $CH_3$— | 3 | 3 | 2 | 2 |
| 1590 | $CH_3$—$(CH_2)_{14}$— | $CH_3$— | $CH_3$— | 3 | 2 | 3 | 2 |
| 1591 | $CH_3$—$(CH_2)_{14}$— | $CH_3$— | $CH_3$— | 3 | 2 | 2 | 3 |
| 1592 | $CH_3$—$(CH_2)_{14}$— | $CH_3$— | $CH_3$— | 2 | 4 | 4 | 2 |
| 1593 | $CH_3$—$(CH_2)_{14}$— | $CH_3$— | $CH_3$— | 2 | 4 | 2 | 4 |
| 1594 | $CH_3$—$(CH_2)_{14}$— | $CH_3$— | $CH_3$— | 2 | 2 | 4 | 4 |
| 1595 | $CH_3$—$(CH_2)_{14}$— | $CH_3$— | $CH_3$— | 4 | 4 | 2 | 2 |
| 1596 | $CH_3$—$(CH_2)_{14}$— | $CH_3$— | $CH_3$— | 4 | 2 | 4 | 2 |
| 1597 | $CH_3$—$(CH_2)_{14}$— | $CH_3$— | $CH_3$— | 4 | 2 | 2 | 4 |
| 1598 | $CH_3$—$(CH_2)_{14}$— | $CH_3$— | $CH_3$— | 3 | 4 | 4 | 3 |
| 1599 | $CH_3$—$(CH_2)_{14}$— | $CH_3$— | $CH_3$— | 3 | 4 | 3 | 4 |
| 1600 | $CH_3$—$(CH_2)_{14}$— | $CH_3$— | $CH_3$— | 3 | 3 | 4 | 4 |
| 1601 | $CH_3$—$(CH_2)_{14}$— | $CH_3$— | $CH_3$— | 4 | 4 | 3 | 3 |
| 1602 | $CH_3$—$(CH_2)_{14}$— | $CH_3$— | $CH_3$— | 4 | 3 | 4 | 3 |
| 1603 | $CH_3$—$(CH_2)_{14}$— | $CH_3$— | $CH_3$— | 4 | 3 | 3 | 4 |

In addition to the nonionic surfactants with low viscosity present in the compositions according to the invention, the compositions can comprise further surfactants from the groups of nonionic, anionic, cationic or amphoteric surfactants. The additional nonionic surfactants used are preferably alkoxylated, advantageously ethoxylated, in particular primary alcohols having preferably 8 to 18 carbon atoms and on average 1 to 12 mol of ethylene oxide (EO) per mole of alcohol, in which the alcohol radical may be linear or preferably methyl-branched in the 2 position, or may contain linear and methyl-branched radicals in the mixture, as are usually present in oxo alcohol radicals. In particular, however, preference is given to alcohol ethoxylates with linear radicals of alcohols of native origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures of these, such as mixtures of $C_{12-14}$-alcohol with 3 EO and $C_{12-18}$-alcohol with 5 EO. The stated degrees of ethoxylation represent statistical average values which, for a specific product, may be an integer or a fraction. Preferred alcohol ethoxylates have a narrowed homolog distribution (narrow range ethoxylates, NRE). In addition to these nonionic surfactants, it is also possible to use fatty alcohols with more than 12 EO. Examples thereof are tallow fatty alcohol with 14 EO, 25 EO, 30 EO or 40 EO.

In addition, further nonionic surfactants which may be used are also alkyl glycosides of the general formula $RO(G)_x$, in which R is a primary straight-chain or methyl-branched, in particular methyl-branched in the 2 position, aliphatic radical having 8 to 22 carbon atoms, preferably 12 to 18 carbon atoms, and G is the symbol which stands for a glycose unit with 5 or 6 carbon atoms, preferably for glucose. The degree of oligomerization x, which gives the distribution of monoglycosides and oligoglycosides, is any desired number between 1 and 10; preferably x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (II)

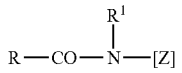

(II)

in which RCO is an aliphatic acyl radical having 6 to 22 carbon atoms; $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which are customarily obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula (III)

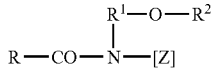

(III)

in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, for example glucose, fructose, maltose, lactose, galactose, mannose or xylose. The N-alkoxy- or N-aryloxy-substituted compounds may then be converted into the desired polyhydroxy fatty acid amides by reaction with fatty acid methyl esters in the presence of an alkoxide as catalyst.

The preferred additional surfactants used are low-foam nonionic surfactants. The machine dishwashing detergents according to the invention particularly advantageously comprise a nonionic surfactant which has a melting point above room temperature. Consequently, preferred compositions are characterized in that they comprise nonionic surfactant(s) which has/have a melting point above 20° C., preferably above 25° C., particularly preferably between 25 and 60° C. and in particular between 26.6 and 43.3° C.

In addition to the nonionic surfactants present according to the invention in the compositions, suitable nonionic surfactants which have melting points or softening points within the stated temperature range are, for example, low-foam nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Nonionic surfactants which have a wax-like consistency at room temperature are also preferred.

Preferred nonionic surfactants that are to be used in solid form at room temperature originate from the groups of alkoxylated nonionic surfactants, in particular ethoxylated primary alcohols and mixtures of these surfactants with surfactants of more complex structure, such as polyoxypropylene/polyoxyethylene/polyoxypropylene (PO/EO/PO) surfactants. Such (PO/EO/PO) nonionic surfactants are distinguished, moreover, by good foam control.

In a preferred embodiment of the present invention, the nonionic surfactant with a melting point above room temperature is an ethoxylated nonionic surfactant originating from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol.

A particularly preferred nonionic surfactant to be used that is solid at room temperature is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol, of ethylene oxide. Of these, the so-called "narrow range ethoxylates" (see above) are particularly preferred.

Accordingly, particularly preferred products according to the invention comprise ethoxylated nonionic surfactant(s) which has/have been obtained from $C_{6-20}$-monohydroxyalkanols or $C_{6-20}$-alkylphenols or $C_{16-20}$-fatty alcohols and more than 12 mol, preferably more than 15 mol and in particular more than 20 mol, of ethylene oxide per mole of alcohol.

The nonionic surfactant solid at room temperature preferably additionally has propylene oxide units in the molecule. Preferably, such PO units constitute up to 25% by weight, particularly preferably up to 20% by weight and in particular up to 15% by weight, of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol part of such nonionic surfactant molecules constitutes preferably more than 30% by weight, particularly preferably more than 50% by weight and in particular more than 70% by weight, of the total molar mass of such nonionic surfactants. Preferred rinse aids are characterized in that they comprise ethoxylated and propoxylated nonionic surfactants in which the propylene oxide units in the molecule constitute up to 25% by weight, preferably up to 20% by weight and in particular up to 15% by weight, of the total molar mass of the nonionic surfactant.

Further nonionic surfactants with melting points above room temperature which can particularly preferably be used comprise 40 to 70% of a polyoxypropylene/polyoxyethylene/polyoxypropylene block polymer blend which comprises 75% by weight of an inverted block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mole of trimethylolpropane.

Nonionic surfactants which can particularly preferably be used can be obtained, for example, under the name Poly Tergent® SLF-18 from Olin Chemicals.

A further preferred rinse aid according to the invention comprises nonionic surfactants of the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x represents values between 0.5 and 1.5 and y represents a value of at least 15.

Further nonionic surfactants which can preferably be used are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j represent values between 1 and 12, preferably between 1 and 5. If the value x is $\geqq 2$, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, —$CH_3$ or —$CH_2CH_3$ are particularly preferred. Particularly preferred values for x are in the range from 1 to 20, in particular from 6 to 15.

As described above, each $R^3$ in the above formula may be different if x is $\geqq 2$. By this means it is possible to vary the alkylene oxide unit in the square brackets. If x, for example, is 3, the radical $R^3$ may be selected in order to form ethylene oxide ($R^3$=H) or propylene oxide ($R^3$=$CH_3$) units, which may be added onto one another in any sequence, examples being (EO)(PO)(EO), (EO)(EO)(PO), (EO)(EO)(EO), (PO)(EO)(PO), (PO)(PO)(EO) and (PO) (PO) (PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of k=1 and j=1, thereby simplifying the above formula to $$R^1O[CH_2CH(R^3)O]_xCH_2CH(OH)CH_2OR^2$$

In the last-mentioned formula, $R^1$, $R^2$ and $R^3$ are as defined above and x represents numbers from 1 to 30, preferably from 1 to 20 and in particular from 6 to 18. Particular preference is given to surfactants in which the radicals $R^1$ and $R^2$ have 9 to 14 carbon atoms, $R^3$ is H, and x assumes values from 6 to 15.

Summarizing the last-mentioned statements, preference is given to rinse aids according to the invention which comprise terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j are values between 1 and 12, preferably between 1 and 5, where surfactants of the type $$R^1O[CH_2CH(R^3)O]_xCH_2CH(OH)CH_2OR^2$$

in which x represents numbers from 1 to 30, preferably from 1 to 20 and in particular from 6 to 18, are particularly preferred.

It is also possible to use anionic, cationic and/or amphoteric surfactants in conjunction with said surfactants; due to their foaming behavior, the former are only of minor importance in machine dishwashing detergents and are in most cases used only in amounts below 10% by weight, in most cases even below 5% by weight, for example from 0.01 to 2.5% by weight, in each case based on the product. The products according to the invention may thus also comprise anionic, cationic and/or amphoteric surfactants as surfactant component.

The anionic surfactants used are, for example, those of the sulfonate and sulfate type. Suitable surfactants of the sulfonate type are, preferably, $C_{9-13}$-alkylbenzenesulfonates, olefinsulfonates, i.e. mixtures of alkene- and hydroxyalkanesulfonates, and disulfonates, as are obtained, for example, from $C_{12-18}$-monoolefins having a terminal or internal double bond by sulfonation with gaseous sulfur trioxide and subsequent alkaline or acidic hydrolysis of the sulfonation products. Also suitable are alkanesulfonates, which are obtained from $C_{12-18}$-alkanes, for example by sulfochlorination or sulfoxidation with subsequent hydrolysis or neutralization, respectively. Likewise suitable are also the esters of α-sulfo fatty acids (ester sulfonates), e.g. the α-sulfonated methyl esters of hydrogenated coconut, palm kernel or tallow fatty acids.

Further suitable anionic surfactants are sulfated fatty acid glycerol esters. Fatty acid glycerol esters are understood as meaning the monoesters, diesters and triesters, and mixtures thereof, as are obtained in the preparation by esterification of a monoglycerol with 1 to 3 mol of fatty acid or in the transesterification of triglycerides with 0.3 to 2 mol of glycerol. Preferred sulfated fatty acid glycerol esters here are the sulfonation products of saturated fatty acids having 6 to 22 carbon atoms, for example those of caproic acid, caprylic acid, capric acid, myristic acid, lauric acid, palmitic acid, stearic acid or behenic acid.

Preferred alk(en)yl sulfates are the alkali metal salts, and in particular the sodium salts, of the sulfuric monoesters of $C_{12}$-$C_{18}$-fatty alcohols, for example those of coconut fatty alcohol, tallow fatty alcohol, lauryl, myristyl, cetyl or stearyl alcohol or of $C_{10}$-$C_{20}$-oxo alcohols, and those monoesters of secondary alcohols of these chain lengths. Preference is also given to alk(en)yl sulfates of said chain length which contain a synthetic straight-chain alkyl radical prepared on a petrochemical basis, and which have a degradation behavior analogous to that of the corresponding compounds based on fatty-chemical raw materials. From a washing technology viewpoint, the $C_{12}$-$C_{16}$-alkyl sulfates and $C_{12}$-$C_{15}$-alkyl sulfates and also $C_{14}$-$C_{15}$-alkyl sulfates are preferred. In addition, 2,3-alkyl sulfates, which can be obtained as commercial products from Shell Oil Company under the name DAN®, are suitable anionic surfactants.

Also suitable are the sulfuric monoesters of the straight-chain or branched $C_{7-21}$-alcohols ethoxylated with 1 to 6 mol of ethylene oxide, such as 2-methyl-branched $C_{9-11}$-alcohols containing, on average, 3.5 mol of ethylene oxide (EO) or $C_{12-18}$-fatty alcohols having 1 to 4 EO. Due to their high foaming behavior, they are used in cleaning compositions only in relatively small amounts, for example in amounts of from 1 to 5% by weight.

Further suitable anionic surfactants are also the salts of the alkylsulfosuccinic acid, which are also referred to as sulfosuccinates or as sulfosuccinic esters and which represent monoesters and/or diesters of sulfosuccinic acid with alcohols, preferably fatty alcohols and in particular ethoxylated fatty alcohols. Preferred sulfosuccinates comprise $C_{8-18}$-fatty alcohol radicals or mixtures of these. Particularly preferred sulfosuccinates comprise a fatty alcohol radical derived from ethoxylated fatty alcohols, which themselves represent nonionic surfactants (for description see below). Here, particular preference is in turn given to sulfosuccinates whose fatty alcohol radicals are derived from ethoxylated fatty alcohols having a narrowed homolog distribution. It is likewise also possible to use alk(en)ylsuccinic acid with preferably 8 to 18 carbon atoms in the alk(en)yl chain or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and in particular mixtures of soaps derived from natural fatty acids, e.g. coconut, palm kernel or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

As cationic active substances, the products according to the invention may, for example, comprise cationic compounds of the formulae IV, V or VI, (IV)

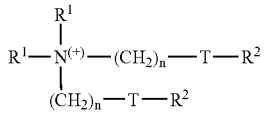

(V)

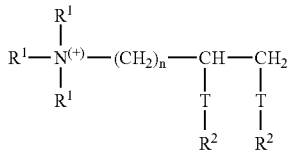

-continued

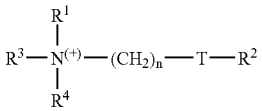

(VI)

in which each group $R^1$, independently of one another, is chosen from $C_{1-6}$-alkyl, -alkenyl or -hydroxyalkyl groups; each group $R^2$, independently of one another, is chosen from $C_{8-28}$-alkyl or -alkenyl groups; $R^3=R^1$ or $(CH_2)_n$-T-$R^2$; $R=R^1$ or $R^2$ or $(CH_2)_n$-T-$R^2$; T=—$CH_2$—, —O—CO— or —CO—O— and n is an integer from 0 to 5.

As a further ingredient, the compositions according to the invention comprise one or more builder(s). Builders are used in the compositions according to the invention primarily to bind calcium and magnesium. Customary builders are the low molecular weight polycarboxylic acids and their salts, the homopolymeric and copolymeric polycarboxylic acids and their salts, the carbonates, phosphates and sodium and potassium silicates. For the cleaning compositions according to the invention, preference is given to using trisodium citrate and/or pentasodium tripolyphosphate and silicatic builders from the class of alkali metal disilicates. In general, with the alkali metal salts, the potassium salts are preferred over the sodium salts since they often have a greater solubility in water. Preferred water-soluble builders are, for example, tripotassium citrate, potassium carbonate and the potassium waterglasses.

Particularly preferred machine dishwashing detergents comprise, as builders, phosphates, preferably alkali metal phosphates, particularly preferably pentasodium or pentapotassium triphosphate (sodium or potassium tripolyphosphate).

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, in addition to higher molecular weight representatives, may be differentiated. The phosphates combine a number of advantages: they act as alkali carriers, prevent limescale deposits and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt of density 2.33 $gcm^3$, has a melting point of 253° (decomposition with the formation of potassium polyphosphate $(KPO_3)_x$) and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^{-3}$, water loss at 95°), 7 mol of water (density 1.68 $gcm^{-3}$, melting point 48° with loss of $5H_2O$) and 12 mol of water (density 1.52 $gcm^{-3}$, melting point 35° with loss of $5H_2O$), becomes anhydrous at 100° and converts to the diphosphate $Na_4P_2O_7$ upon more severe heating. Disodium hydrogenphosphate is prepared by neutralizing phosphoric acid with soda solution using phenolphthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which as the dodecahydrate have a density of 1.62 $gcm^{-3}$ and a melting point of 73–76° C. (decomposition), as the decahydrate (corresponding to 19–20% of $P_2O_5$) have a melting point of 100° C. and in anhydrous form (corresponding to 39–40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^3$, has a melting point of 1340° and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the cleaners industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815–1.836 $gcm^{-3}$, melting point 94° with loss of water). Both substances are colorless crystals which are soluble in water with an alkaline reaction. $Na_4P_2O_7$ is formed when disodium phosphate is heated at >200° or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or high-temperature phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the salt free from water of crystallization dissolve in 100 g of water at room temperature, about 20 g dissolve at 60°, and about 32 g dissolve at 100°; after heating the solution for 2 hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is commercially available, for example, in the form of a 50% strength by weight solution (>23% $P_2O_5$, 25% $K_2O$). The potassium polyphosphates are widely used in the detergents and cleaners industry.

Further important builders are, in particular, the carbonates, citrates and silicates. Preference is given to using trisodium citrate and/or pentasodium tripolyphosphate and/or sodium carbonate and/or sodium bicarbonate and/or gluconates and/or silicatic builders from the class of disilicates and/or metasilicates.

Further constituents which may be present are alkali carriers. Suitable alkali carriers are alkali metal hydroxides, alkali metal carbonates, alkali metal hydrogencarbonates, alkali metal sesquicarbonates, alkali metal silicates, alkali metal metasilicates, and mixtures of the abovementioned substances, preference being given, for the purposes of this invention, to using alkali metal carbonates, in particular sodium carbonate, sodium hydrogencarbonate or sodium sesquicarbonate.

Particular preference is given to a builder system comprising a mixture of tripolyphosphate and sodium carbonate.

A builder system comprising a mixture of tripolyphosphate and sodium carbonate and sodium disilicate is likewise particularly preferred.

The compositions according to the invention can comprise the builder or builders in varying amounts depending on the intended use. Preference is given here to machine dishwashing detergents according to the invention which comprise the builder(s) in amounts of from 5 to 90% by weight, preferably from 7.5 to 85% by weight and in particular from 10 to 80% by weight, in each case based on the total composition.

As well as the builders, bleaches, bleach activators, enzymes, silver protectants, dyes and fragrances etc. in particular are preferred ingredients of machine dishwashing detergents. In addition, further ingredients may be present, preference being given to machine dishwashing detergents according to the invention which additionally comprise one or more substances from the group of acidifying agents, chelate complexing agents or of deposit-inhibiting polymers.

Possible acidifiers are either inorganic acids or organic acids provided these are compatible with the other ingredients. For reasons of consumer protection and handling safety, the solid mono-, oligo- and polycarboxylic acids in particular can be used. From this group, preference is in turn given to citric acid, tartaric acid, succinic acid, malonic acid, adipic acid, maleic acid, fumaric acid, oxalic acid, and polyacrylic acid. The anhydrides of these acids can also be used as acidifiers, maleic anhydride and succinic anhydride in particular being commercially available. Organic sulfonic acids, such as amidosulfonic acid can likewise be used. A product which is commercially available and which can likewise preferably be used as acidifier for the purposes of the present invention is Sokalan® DCS (trade mark of BASF), a mixture of succinic acid (max. 31% by weight), glutaric acid (max. 50% by weight) and adipic acid (max. 33% by weight).

A further possible group of ingredients are the chelate complexing agents. Chelate complexing agents are substances which form cyclic compounds with metal ions, where a single ligand occupies more than one coordination site on a central atom, i.e. is at least "bidentate". In this case, stretched compounds are thus normally closed by complex formation via an ion to give rings. The number of bonded ligands depends on the coordination number of the central ion.

Chelate complexing agents which are customary and preferred for the purposes of the present invention are, for example, polyoxycarboxylic acids, polyamines, ethylenediaminetetraacetic acid (EDTA) and nitrilotriacetic acid (NTA). Complex-forming polymers, i.e. polymers which carry functional groups either in the main chain itself or laterally relative to this, which can act as ligands and react with suitable metal atoms usually to form chelate complexes, can also be used according to the invention. The polymer-bonded ligands of the resulting metal complexes can originate from just one macromolecule or else belong to different polymer chains. The latter leads to crosslinking, of the material, provided the complex-forming polymers have not already been crosslinked beforehand via covalent bonds.

Complexing groups (ligands) of customary complex-forming polymers are iminodiacetic acid, hydroxyquinoline, thiourea, guanidine, dithiocarbamate, hydroxamic acid, amidoxime, aminophosphoric acid, (cycl.) polyamino, mercapto, 1,3-dicarbonyl and crown ether radicals, some of which have very specific activities toward ions of different metals. Basis polymers of many complex-forming polymers, which are also commercially important, are polystyrene, polyacrylates, polyacrylonitriles, polyvinyl alcohols, polyvinylpyridines and polyethylenimines. Natural polymers, such as cellulose, starch or chitin are also complex-forming polymers. Moreover, these may be provided with further ligand functionalities as a result of polymer-analogous modifications.

For the purposes of the present invention, particular preference is given to machine dishwashing detergents which comprise one or more chelate complexing agents from the groups of (i) polycarboxylic acids in which the sum of the carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins in amounts above 0.1% by weight, preferably above 0.5% by weight, particularly preferably above 1% by weight and in particular above 2.5% by weight, in each case based on the weight of the dishwasher product.

For the purposes of the present invention, it is possible to use all complexing agents of the prior art. These may belong to different chemical groups. Preference is given to using the following, individually or in a mixture with one another:

a) polycarboxylic acids in which the sum of the carboxyl and optionally hydroxyl groups is at least 5, such as gluconic acid,
b) nitrogen-containing mono- or polycarboxylic acids, such as ethylenediaminetetraacetic acid (EDTA), N-hydroxyethylethylenediaminetriacetic acid, diethylenetriaminepentaacetic acid, hydroxyethyliminodiacetic acid, nitridodiacetic acid-3-propionic acid, isoserinediacetic acid, N,N-di(β-hydroxyethyl)glycine, N-(1,2-dicarboxy-2-hydroxyethyl)glycine, N-(1,2-dicarboxy-2-hydroxyethyl) aspartic acid or nitrilotriacetic acid (NTA),
c) geminal diphosphonic acids, such as 1-hydroxyethane-1,1-diphosphonic acid (HEDP), higher homologs thereof having up to 8 carbon atoms, and hydroxy or amino group-containing derivatives thereof and 1-aminoethane-1,1-diphosphonic acid, higher homologs thereof having up to 8 carbon atoms, and hydroxy or amino group-containing derivatives thereof, d) aminophosphonic acids, such as ethylenediaminetetra(methylenephosphonic acid), diethylenetriaminepenta(methylenephosphonic acid) or nitrilotri(methylenephosphonic acid), e) phosphonopolycarboxylic acids, such as 2-phosphonobutane-1,2,4-tricarboxylic acid, and f) cyclodextrins.

For the purposes of this patent application, polycarboxylic acids a) are understood as meaning carboxylic acids—including monocarboxylic acids—in which the sum of carboxyl and the hydroxyl groups present in the molecule is at least 5. Complexing agents from the group of nitrogen-containing polycarboxylic acids, in particular EDTA, are preferred. At the alkaline pH values of the treatment solutions required according to the invention, these complexing agents are at least partially in the form of anions. It is unimportant whether they are introduced in the form of acids or in the form of salts. In the case of using salts, alkali metal, ammonium or alkylammonium salts, in particular sodium salts, are preferred.

Deposit-inhibiting polymers may likewise be present in the products according to the invention. These substances, which may have chemically different structures, originate, for example, from the groups of low molecular weight polyacrylates with molar masses between 1000 and 20 000 daltons, preference being given to polymers with molar masses below 15 000 daltons.

Deposit-inhibiting polymers may also have cobuilder properties. Organic cobuilders which may be used in the machine dishwashing detergents according to the invention are, in particular, polycarboxylates, polycarboxylic acids, polymeric polycarboxylates, aspartic acid, polyacetals, dextrins, further organic cobuilders (see below) and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is made of citric acid, succinic acid, glutaric acid, adipic acid, gluconic acid and any mixtures thereof.

Also suitable as builders or deposit inhibitors are polymeric polycarboxylates; these are, for example, the alkali metal salts of polyacrylic acid or of polymethacrylic acid, for example those having a relative molecular mass of from 500 to 70 000 g/mol.

The molar masses given for polymeric polycarboxylates are, for the purposes of this specification, weight-average molar masses $M_W$ of the respective acid form, determined fundamentally by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 500 to 20 000 g/mol. Owing to their superior solubility, preference in this group may be given in turn to the short-chain polyacrylates which have molar masses of from 1000 to 10 000 g/mol and particularly preferably from 1000 to 4000 g/mol.

Particular preference is given to using both polyacrylates and also copolymers of unsaturated carboxylic acids, monomers containing sulfonic acid groups, and optionally further ionic or nonionogenic monomers in the compositions according to the invention. The copolymers containing sulfonic acid groups are described in detail below.

Also suitable are copolymeric polycarboxylates, in particular those of acrylic acid with methacrylic acid and of acrylic acid or methacrylic acid with maleic acid. Copolymers which have proven to be particularly suitable are those of acrylic acid with maleic acid which contain from 50 to 90% by weight of acrylic acid and 50 to 10% by weight of maleic acid. Their relative molecular mass, based on free acids, is generally 2000 to 70 000 g/mol, preferably 20 000 to 50 000 g/mol and in particular 30 000 to 40 000 g/mol.

The (co)polymeric polycarboxylates can either be used as powders or as aqueous solutions. The (co)polymeric polycarboxylate content of the agents is preferably 0.5 to 20% by weight, in particular 3 to 10% by weight.

Particular preference is also given to biodegradable polymers of more than two different monomer units, for example those which contain, as monomers, salts of acrylic acid or of maleic acid, and vinyl alcohol or vinyl alcohol derivatives, or those which contain, as monomers, salts of acrylic acid and of 2-alkylallylsulfonic acid, and sugar derivatives. Further preferred copolymers are those which preferably have, as monomers, acrolein and acrylic acid/acrylic acid salts or acrolein and vinyl acetate.

Further preferred builder substances which are likewise to be mentioned are polymeric aminodicarboxylic acids, salts thereof or precursor substances thereof. Particular preference is given to polyaspartic acids or salts and derivatives thereof, which also have a bleach-stabilizing effect as well as cobuilder properties.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes, such as glyoxal, glutaraldehyde, terephthalaldehyde, and mixtures thereof and from polyolcarboxylic acids, such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with customary processes, for example acid-catalyzed or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is also possible to use maltodextrins with a DE between 3 and 20 and dried glucose syrups with a DE between 20 and 37, and also so-called yellow dextrins and white dextrins with relatively high molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on the $C_6$ of the saccharide ring may be particularly advantageous.

Oxydisuccinates and other derivatives of disuccinates, preferably ethylenediaminedisuccinate, are also further suitable cobuilders. Here, ethylenediamine N,N'-disuccinate (EDDS) is preferably used in the form of its sodium or magnesium salts. In this connection, preference is also given to glycerol disuccinates and glycerol trisuccinates. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups.

A further class of substances with cobuilder properties is the phosphonates. These are, in particular, hydroxyalkane- and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as the hexasodium salt of EDTMP or as the hepta- and octasodium salt of DTPMP. Here, preference is given to using HEDP as builder from the class of phosphonates. In addition, the aminoalkanephosphonates have a marked heavy metal-binding capacity. Accordingly, particularly if the agents also comprise bleaches, it may be preferable to use aminoalkanephosphonates, in particular DTPMP, or mixtures of said phosphonates.

In addition to the substances from the classes of substance given, the products according to the invention can comprise further customary ingredients of cleaning compositions, where bleaches, bleach activators, enzymes, silver protectants, dyes and fragrances in particular are of importance. These substances are described below.

Among the compounds which serve as bleaches and liberate $H_2O_2$ in water, sodium perborate tetrahydrate and sodium perborate monohydrate are of particular importance. Examples of further bleaches which may be used are sodium percarbonate, peroxypyrophosphates, citrate perhydrates and $H_2O_2$-supplying peracidic salts or peracids, such as perbenzoates, peroxophthalates, diperazelaic acid, phthaloiminoperacid or diperdodecanedioic acid. Cleaners according to the invention can also comprise bleaches from the group of organic bleaches. Typical organic bleaches are the diacyl peroxides, such as, for example, dibenzoyl peroxide. Further typical organic bleaches are the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimido-peroxycaproic acid (phthaloiminoperoxyhexanoic acid (PAP)), o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyl-di (6-aminopercaproic acid) can be used.

Bleaches which may be used in the cleaners according to the invention for machine dishwashing may also be substances which liberate chlorine or bromine. Among the suitable materials which liberate chlorine or bromine, suitable examples include heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Preferred machine dishwashing detergents according to the invention additionally comprise bleaches in amounts of from 1 to 40% by weight, preferably from 2.5 to 30% by weight and in particular from 5 to 20% by weight, in each case based on the total composition.

Bleach activators, which assist the action of the bleaches, have already been mentioned above as a possible ingredient of the rinse aid particles. Known bleach activators are compounds which contain one or more N- or O-acyl groups, such as substances from the class of anhydrides, of esters, of imides and of acylated imidazoles or oximes. Examples are tetraacetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

Bleach activators which can be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O-acyl and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic acid anhydrides, in particular phthalic anhydride, acylated polyhydric alcohols, in particular triacetin, ethylene glycol diacetate, 2,5-diacetoxy-2,5-dihydrofuran, n-methylmorpholinium acetonitrile methylsulfate (MMA), and enol esters and acetylated sorbitol and mannitol or mixtures thereof (SORMAN), acylated sugar derivatives, in particular pentaacetylglucose (PAG), pentaacetylfructose, tetraacetylxylose and octaacetyllactose, and acetylated, optionally N-alkylated, glucamine and gluconolactone, and/or N-acylated lactams, for example N-benzoyl-caprolactam. Hydrophilically substituted acylacetals and acyllactams are likewise preferably used. Combinations of conventional bleach activators can also be used.

In addition to the conventional bleach activators, or instead of them, so-called bleach catalysts may also be incorporated into the rinse aid particles. These substances are bleach-boosting transition metal salts or transition metal complexes, such as, for example, Mn-, Fe-, Co-, Ru- or Mo-salen complexes or -carbonyl complexes. Mn, Fe, Co, Ru, Mo, Ti, V and Cu complexes with N-containing tripod ligands, and Co-, Fe-, Cu- and Ru-ammine complexes can also be used as bleach catalysts.

Preference is given to using bleach activators from the group of polyacylated alkylenediamines, in particular tetraacetylethylenediamine (TAED), N-acylimides, in particular N-nonanoylsuccinimide (NOSI), acylated phenolsulfonates, in particular n-nonanoyl- or isononanoyloxybenzenesulfonate (n- or iso-NOBS), n-methylmorpholinium acetonitrile methylsulfate (MMA), preferably in amounts up to 10% by weight, in particular 0.1% by weight to 8% by weight, particularly 2 to 8% by weight and particularly preferably 2 to 6% by weight, based on the total agent.

Bleach-boosting transition metal complexes, in particular with the central atoms Mn, Fe, Co, Cu, Mo, V, Ti and/or Ru, preferably chosen from the group of manganese and/or cobalt salts and/or complexes, particularly preferably the cobalt (ammine) complexes, cobalt (acetato) complexes, cobalt (carbonyl) complexes, the chlorides of cobalt or manganese, manganese sulfate are used in customary amounts, preferably in an amount up to 5% by weight, in particular from 0.0025% by weight to 1% by weight and particularly preferably from 0.01% by weight to 0.25% by weight, in each case based on the total agent. However, in special cases, more bleach activator can also be used.

Suitable enzymes in the cleaners according to the invention are, in particular, those from the classes of hydrolases, such as the proteases, esterases, lipases or lipolytic enzymes, amylases, glycosyl hydrolases and mixtures of said enzymes. All of these hydrolases contribute to the removal of soilings such as protein-, grease- or starch-containing stains. For bleaching, it is also possible to use oxidoreductases. Especially suitable enzymatic active ingredients are those obtained from bacterial strains or fungi, such as *Bacillus subtilis, Bacillus licheniformis, Streptomyceus griseus, Coprinus cinereus* and *Humicola insolens*, and from genetically modified variants thereof. Preference is given to using proteases of the subtilisin type and in particular to proteases obtained from *Bacillus lentus*. Of particular interest here are enzyme mixtures, for example of protease and amylase or protease and lipase or lipolytic enzymes, or of protease, amylase and lipase or lipolytic enzymes, or protease, lipase or lipolytic enzymes, but in particular protease and/or lipase-containing mixtures or mixtures with lipolytic enzymes. Examples of such lipolytic enzymes are the known cutinases. Peroxidases or oxidases have also proven suitable in some cases. Suitable amylases include, in particular, alpha-amylases, isoamylases, pullulanases and pectinases.

The enzymes can be adsorbed on carrier substances or embedded in coating substances in order to protect them from premature decomposition. The proportion of enzymes, enzyme mixtures or enzyme granules can, for example, be about 0.1 to 5% by weight, preferably 0.5 to about 4.5% by weight.

For the purposes of the present invention, particular preference is given to the use of liquid enzyme formulations. Preference is given here to machine dishwashing detergents according to the invention which additionally comprise enzymes in amounts of from 0.01 to 15% by weight, preferably from 0.1 to 10 and in particular from 0.5 to 6% by weight, in each case based on the total product.

Dyes and fragrances can be added to the machine dishwashing detergents according to the invention in order to improve the esthetic impression of the resulting products and to provide the consumer with performance coupled with a visually and sensorily "typical and unmistakable" product. Perfume oils or fragrances which may be used are individual odorant compounds, e.g. the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether, and the aldehydes include, for example, the linear alkanals having 8–18 carbon atoms, citral, citronellal, citronellyloxyacetaldehyde, cyclamenaldehyde, hydroxycitronellal, lilial and bourgeonal, and the ketones include, for example, the ionones, α-isomethylionone and methyl cedryl ketone, and the alcohols include anethol, citronellol, eugenol, geraniol, linalool, phenylethyl alcohol and terpineol, and the hydrocarbons include primarily the terpenes, such as limonene and pinene. Preference is, however, given to using mixtures of different odorants which together produce a pleasing scent note. Such perfume oils can also contain natural odorant mixtures, as are obtainable from plant sources, e.g. pine oil, citrus oil, jasmine oil, patchouli oil, rose oil and ylang ylang oil. Likewise suitable are muscatel, sage oil, chamomile oil, oil of cloves, melissa oil, mint oil, cinnamon leaf oil, lime blossom oil, juniperberry oil, vetiver oil, olibanum oil, galbanum oil and labdanum oil, and orange blossom oil, neroliol, orange peel oil and sandalwood oil.

The fragrances can be incorporated directly into the cleaning compositions according to the invention, although it may also be advantageous to apply the fragrances to carriers which enhance the adhesion of the perfume to the laundry and, by virtue of slower fragrance release, ensure long-lasting fragrance of the textiles. Materials which have become established as such carrier materials are, for example, cyclodextrins, in which the cyclodextrin perfume complexes can additionally be coated with further auxiliaries.

In order to improve the esthetic impression of the compositions prepared according to the invention, it (or parts thereof) may be colored with suitable dyes. Preferred dyes, the choice of which does not present any problems at all to the person skilled in the art, have high storage stability and high insensitivity toward the other ingredients of the composition and toward light, and do not have marked substantivity toward the substrates to be treated with the compositions, such as glass, ceramic or plastic dishware, in order not to dye these.

The cleaning compositions according to the invention can comprise corrosion inhibitors to protect the ware or the machine, particular importance in the field of machine dishwashing being attached to silver protectants. It is possible to use the known substances of the prior art. In general, it is possible to use, in particular, silver protectants chosen from the group of triazoles, benzotriazoles, bisbenzotriazoles, aminotriazoles, alkylaminotriazoles and transition metal salts or transition metal complexes. Particular preference is given to the use of benzotriazole and/or alkylaminotriazole. Frequently encountered in cleaning formulations, moreover, are agents containing active chlorine, which can significantly reduce corrosion of the silver surface. In chlorine-free cleaners, use is made in particular of oxygen- and nitrogen-containing organic redox-active compounds, such as dihydric and trihydric phenols, e.g. hydroquinone, pyrocatechol, hydroxyhydroquinone, gallic acid, phloroglucinol, pyrogallol, and derivatives of these classes of compounds. Inorganic compounds in the form of salts and complexes, such as salts of the metals Mn, Ti, Zr, Hf, V, Co and Ce, are also often used. Preference is given here to the transition metal salts chosen from the group of manganese and/or cobalt salts and/or complexes, particularly preferably the cobalt(ammine) complexes, the cobalt(acetato) complexes, the cobalt(carbonyl) complexes, the chlorides of cobalt or manganese and manganese sulfate. It is likewise possible to use zinc compounds to prevent corrosion on the ware.

The requirements placed on dishes washed by machine are often nowadays higher than those placed on dishes washed manually. For example, even dishes which have been completely cleaned of food residues will not be evaluated as being perfect if, after machine dishwashing, they still have whitish marks based on water hardness or other mineral salts which, due to a lack of wetting agent, originate from dried-on water drops. In order to obtain sparkling and stain-free dishes, a rinse aid is therefore used. The addition of a rinse aid at the end of the wash program ensures that water runs off as completely as possible from the ware so that, at the end of the wash program, the various surfaces are residue-free and mark-free and sparkling. Machine dishwashing in domestic dishwashing machines usually includes a prerinse cycle, a main wash cycle and a clear-rinse cycle, which are interrupted by intermediate rinsing cycles. In most machines, the prerinse cycle can be included for heavily soiled dishes, but is only chosen by the consumer in exceptional cases, meaning that in most machines a main wash cycle, an intermediate rinse cycle with clean water and a clear-rinse cycle are carried out. The temperature of the main cycle varies between 40 and 65° C. depending on the type of machine and the program chosen. In the clear-rinse cycle, rinse aids, which usually comprise nonionic surfactants as the main constituent, are added from a dosing compartment within the machine. Such rinse aids are in liquid form and are widely described in the prior art. Their task is primarily to prevent lime marks and films on the dishes.

The compositions according to the invention can be formulated as "normal" cleaners which are used together with standard commercial supplementary agents (rinse aids, regeneration salts). However, it is particularly advantageous with the products according to the invention to dispense with the additional dosing of rinse aids since the surfactants with low viscosity present according to the invention in the compositions lead to excellent run-off properties of the wash liquor and significantly reduced films on the dishes compared to conventional surfactants. These so-called "2in1" products lead to easier handling and take away the burden for the consumer of additionally dosing two different products (detergent and rinse aid).

Even in the case of "2in1" products, two dosing operations are periodically required to operate a domestic dishwashing machine since the regeneration salt must be topped up in the water softening system of the machine after a certain number of wash operations. These water softening systems consist of ion exchanger polymers which soften the hard water flowing into the machine and, after the wash program, are regenerated by rinsing with salt water.

It is, however, also possible to provide products according to the invention which, in the form of so-called "3in1" products, combine the conventional detergents, rinse aid and salt replacement function. In this respect, preference is given to machine dishwashing detergents according to the invention which additionally comprise 0.1 to 70% by weight of copolymers of i) unsaturated carboxylic acids ii) monomers containing sulfonic acid groups iii) optionally further ionic or nonionogenic monomers.

These copolymers result in parts of dishes treated with such compositions becoming significantly cleaner in subsequent cleaning operations than parts of dishes which have been washed with conventional compositions.

An additional positive effect is the shortening of the drying time of the parts of dishes treated with the cleaning composition, i.e. the consumer can take the dishes from the machine earlier and reuse them after the wash program is finished.

The invention is characterized by an improved "cleanability" of the treated substrate during later washing operations and by a considerable shortening of the drying time compared with comparable compositions without the use of polymers containing sulfonic acid groups.

For the purposes of the teaching according to the invention, drying time is generally understood as having the literal meaning, i.e. the time which elapses until a surface of the dishes treated in a dishwasher machine has dried, but in particular the time which elapses until 90% of a surface treated with a cleaning composition or rinse aid in concentrated or dilute form has dried.

For the purposes of the present invention, unsaturated carboxylic acids of the formula VII are preferred as monomer, $$R^1(R^2)C{=}C(R^3)COOH \qquad \text{(VII)},$$

in which $R^1$ to $R^3$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms.

Among the unsaturated carboxylic acids which can be described by the formula I, particular preference is given to acrylic acid ($R^1$=$R^2$=$R^3$=H), methacrylic acid ($R^1$=$R^2$=H; $R^3$=$CH_3$) and/or maleic acid ($R^1$=COOH; $R^2$=$R^3$=H).

In the case of the monomers containing sulfonic acid groups, preference is given to those of the formula VIII, $$R^5(R^6)C{=}C(R^7)\text{—}X\text{—}SO_3H \qquad \text{(VIII)},$$

in which $R^5$ to $R^7$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)—.

Among these monomers, preference is given to those of the formulae VIIIa, VIIIb and/or VIIIc, $$H_2C{=}CH\text{—}X\text{—}SO_3H \qquad \text{(VIIIa)},$$

$$H_2C{=}C(CH_3)\text{—}X\text{—}SO_3H \qquad \text{(VIIIb)},$$

$$HO_3S\text{—}X\text{—}(R^6)C{=}C(R^7)\text{—}X\text{—}SO_3H \qquad \text{(VIIIc)},$$

in which $R^6$ and $R^7$, independently of one another, are chosen from —H, —$CH_3$, —$CH_2CH_3$, —$CH_2CH_2CH_3$, —$CH(CH_3)_2$ and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)—.

Particularly preferred monomers containing sulfonic acid groups here are 1-acrylamido-1-propanesulfonic acid (X=—C(O)NH—CH($CH_2CH_3$) in formula IIa), 2-acrylamido-2-propanesulfonic acid (X=—C(O)NH—C$(CH_3)_2$ in formula VIIIa), 2-acrylamido-2-methyl-1-propanesulfonic acid (X=C(O)NH—CH($CH_3$)$CH_2$— in formula VIIIa), 2-methacrylamido-2-methyl-1-propanesulfonic acid (X=C(O)NH—CH($CH_3$)$CH_2$— in formula VIIIb), 3-methacrylamido-2-hydroxypropanesulfonic acid (X=—C(O)NH—$CH_2$CH(OH)$CH_2$— in formula VIIIb), allylsulfonic acid (X=$CH_2$ in formula VIIIa), methallylsulfonic acid (X=$CH_2$ in formula VIIIb), allyloxybenzenesulfonic acid (X=—$CH_2$—O—$C_6H_4$— in formula VIIIa), methallyloxybenzenesulfonic acid (X=—$CH_2$—O—$C_6H_4$— in formula VIIIb), 2-hydroxy-3-(2-propenyloxy)propanesulfonic acid, 2-methyl-2-propene-1-sulfonic acid (X=$CH_2$ in formula VIIIb), styrenesulfonic acid (X=$C_6H_4$ in formula VIIIa), vinylsulfonic acid (X not present in formula VIIIa), 3-sulfopropyl acrylate (X=—C(O)NH—$CH_2CH_2CH_2$— in formula VIIIa), 3-sulfopropyl methacrylate (X=—C(O)NH—$CH_2CH_2CH_2$— in formula VIIIb), sulfomethacrylamide (X=—C(O)NH— in formula VIIIb), sulfomethyl methacrylamide (X=—C(O)NH—$CH_2$— in formula VIIIb) and water-soluble salts of said acids.

Suitable further ionic or nonionogenic monomers are, in particular, ethylenically unsaturated compounds. Preferably the content of the monomers of group iii) in the polymers used according to the invention is less than 20% by weight, based on the polymer. Polymers to be used with particular preference consist merely of monomers of groups i) and ii).

In summary, copolymers of i) unsaturated carboxylic acids of the formula VII $$R^1(R^2)C{=}C(R^3)COOH \quad \text{(VII)},$$

in which $R^1$ to $R^3$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, ii) monomers of the formula VIII containing sulfonic acid groups $$R^5(R^6)C{=}C(R^7)—X—SO_3H \quad \text{(VIII)},$$

in which $R^5$ to $R^7$, independently of one another, are —H. —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)— iii) optionally further ionic or nonionogenic monomers are particularly preferred.

Particularly preferred copolymers consist of i) one or more unsaturated carboxylic acids from the group consisting of acrylic acid, methacrylic acid and/or maleic acid ii) one or more monomers containing sulfonic acid groups and of the formulae VIIIa, VIIIb and/or VIIIc:

$$H_2C{=}CH—X—SO_3H \quad \text{(VIIIa)},$$

$$H_2C{=}C(CH_3)—X—SO_3H \quad \text{(VIIIb)},$$

$$HO_3S—X—(R^6)C{=}C(R^7)—X—SO_3H \quad \text{(VIIIc)},$$

in which $R^6$ and $R^7$, independently of one another, are chosen from —H, —$CH_3$, —$CH_2CH_3$, —$CH_2CH_2CH_3$, —CH$(CH_3)_2$ and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)— iii) optionally further ionic or nonionogenic monomers.

The copolymers present according to the invention in the products can comprise the monomers from groups i) and ii), and optionally iii) in varying amounts, where all of the representatives from group i) can be combined with all of the representatives from group ii) and all of the representatives from group iii). Particularly preferred polymers have certain structural units which are described below.

Thus, for example, preference is given to products according to the invention which are characterized in that they comprise one or more copolymers which contain structural units of the formula IX $$—[CH_2—CHCOOH]_m—[CH_2—CHC(O)—Y—SO_3H]_p— \quad \text{(IX)},$$

in which m and p are in each case a whole natural number between 1 and 2000, and Y is a spacer group chosen from substituted or unsubstituted aliphatic, aromatic or araliphatic hydrocarbon radicals having 1 to 24 carbon atoms, where spacer groups in which Y is —O—$(CH_2)_n$— where n=0 to 4, is —O—$(C_6H_4)$—, is —NH—C$(CH_3)_2$— or —NH—CH($CH_2CH_3$)— are preferred.

These polymers are prepared by copolymerization of acrylic acid with an acrylic acid derivative containing sulfonic acid groups. Copolymerizing the acrylic acid derivative containing sulfonic acid groups with methacrylic acid leads to another polymer which is likewise used with preference in the products according to the invention and is characterized in that the products comprise one or more copolymers which contain structural units of the formula X $$—[CH_2—C(CH_3)COOH]_m—[CH_2—CHC(O)—Y—SO_3H]_p— \quad \text{(X)},$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—$(C_6H_4)$—, is —NH—C$(CH_3)_2$— or —NH—CH($CH_2CH_3$)— are preferred.

Entirely analogously, acrylic acid and/or methacrylic acid can also be copolymerized with methacrylic acid derivatives containing sulfonic acid groups, as a result of which the structural units in the molecule are changed. For example, products according to the invention which comprise one or more copolymers which contain structural units of the formula XI $$—[CH_2—CHCOOH]_m—[CH_2—C(CH_3)C(O)—Y—SO_3H]_p— \quad (XI),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred, are likewise a preferred embodiment of the present invention, just as preference is also given to products which are characterized in that they comprise one or more copolymers which contain structural units of the formula XII $$—[CH_2—C(CH_3)COOH]_m—[CH_2—C(CH_3)C(O)—Y—SO_3H]_p— \quad (XII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In place of acrylic acid and/or methacrylic acid, or in addition thereto, it is also possible to use maleic acid as particularly preferred monomer from group i). This gives products preferred according to the invention which are characterized in that they comprise one or more copolymers which contain structural units of the formula XIII $$—[HOOCCH—CHCOOH]_m—[CH_2—CHC(O)—Y—SO_3H]_p— \quad (XIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred, and gives products which are characterized in that they comprise one or more copolymers which contain structural units of the formula XIV $$—[HOOCCH—CHCOOH]_m—[CH_2—C(CH_3)C(O)O—Y—SO_3H]_p— \quad (XIV),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In summary, machine dishwashing detergents according to the invention are preferred which comprise, as ingredient b), one or more copolymers which contain structural units of the formulae 1× and/or X and/or XI and/or XII and/or XIII and/or XIV $$—[CH_2—CHCOOH]_m—[CH_2—CHC(O)—Y—SO_3H]_p— \quad (IX),$$

$$—[CH_2—C(CH_3)COOH]_m—[CH_2—CHC(O)—Y—SO_3H]_p— \quad (X),$$

$$—[CH_2—CHCOOH]_m—[CH_2—C(CH_3)C(O)—Y—SO_3H]_p— \quad (XI),$$

$$—[CH_2—C(CH_3)COOH]_m—[CH_2—C(CH_3)C(O)—Y—SO_3H]_p— \quad (XII),$$

$$—[HOOCCH—CHCOOH]_m—[CH_2—CHC(O)—Y—SO_3H]_p— \quad (XIII),$$

$$—[HOOCCH—CHCOOH]_m—[CH_2—C(CH_3)C(O)O—Y—SO_3H]_p— \quad (XIV),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$ where n=0 to 4, is $—O—(C_6H_4)—$, is $—NH—C(CH_3)_2—$ or $—NH—CH(CH_2CH_3)—$ are preferred.

In the polymers, all or some of the sulfonic acid groups can be present in neutralized form, i.e. the acidic hydrogen atom of the sulfonic acid group in some or all sulfonic acid groups can be replaced with metal ions, preferably alkali metal ions and in particular with sodium ions. Corresponding products which are characterized in that the sulfonic acid groups in the copolymer are in partially or completely neutralized form are preferred in accordance with the invention.

The monomer distribution of the copolymers used in the products according to the invention is, in the case of copolymers which comprise only monomers from groups i) and ii), preferably in each case 5 to 95% by weight of i) or ii), particularly preferably 50 to 90% by weight of monomer from group i) and 10 to 50% by weight of monomer from group ii), in each case based on the polymer.

In the case of terpolymers, particular preference is given to those which comprise 20 to 85% by weight of monomer from group i), 10 to 60% by weight of monomer from group ii), and 5 to 30% by weight of monomer from group iii).

The molar mass of the polymers used in the products according to the invention can be varied in order to match the properties of the polymers to the desired intended use. Preferred machine dishwashing detergents are characterized in that the copolymers have molar masses of from 2000 to 200 000 $gmol^{-1}$, preferably from 4000 to 25 000 $gmol^{-1}$ and in particular from 5000 to 15 000 $gmol^{-1}$.

The content of one or more copolymers in the products according to the invention can vary depending on the intended use and desired product performance, preferred machine dishwashing detergents according to the invention being characterized in that the copolymer or copolymers is/are present in amounts of from 0.25 to 50% by weight, preferably from 0.5 to 35% by weight, particularly preferably from 0.75 to 20% by weight and in particular from 1 to 15% by weight.

As already mentioned above, particular preference is given to using both polyacrylates and also the above-described copolymers of unsaturated carboxylic acids, monomers containing sulfonic acid groups, and optionally further ionic or nonionogenic monomers in the compositions according to the invention. The polyacrylates have been described above in detail. Particular preference is given to combinations of the above-described copolymers containing sulfonic acid groups with polyacrylates of low molar mass, for example in the range between 1000 and 4000 daltons. Such polyacrylates are available commercially under the trade name Sokalan® PA15 and Sokalan® PA25 (BASF).

EXAMPLES

A mixture of the surfactants 575 and 673 from the table in the description text was prepared by ethoxylating an unbranched and saturated $C_{11}$-alcohol with ethylene oxide in the presence of KOH as catalyst in an autoclave at 150° C. After the ethylene oxide had fully reacted, propylene oxide was fed into the autoclave and, after its reaction, the procedure was repeated with ethylene oxide and then with propylene oxide. The resulting surfactant mixture can be described by the formula $$CH_3(CH_2)_{10}—O—(CH_2—CH_2—O)_3—(CH_2—CH(CH_3)—O)_3—(CH_2—CH_2—O)_2—(CH_2—CH(CH_3)—O)_{1.5}—H$$

The surfactant mixture has, in 80% strength by weight solution in distilled water, a viscosity (Brookfield, spindle 31, 30 rpm, 20° C.) of 100 mPas.

By means of granulation in a 130 liter plowshare mixer from Lödige, granular machine dishwashing detergents of the composition given in Table 1 were prepared.

TABLE 1

| Granular machine dishwashing detergents [% by weight] | | |
|---|---|---|
| | in accordance with the invention I1 | comparative example C1 |
| Trisodium phosphate | 30.44% | 30.44% |
| Sodium perborate | 3.00% | 3.00% |
| TAED | 1.07% | 1.07% |
| Nonionic surfactant* | 5.27% | 5.27% |
| Sodium carbonate | 54.11% | 54.11% |
| Polymeric cobuilder | 3.78% | 3.78% |
| Enzymes | 2.22% | 2.22% |
| Perfume | 0.11% | 0.11% |

*In Example I1 according to the invention, the nonionic surfactant described above was used; in the comparative example C1 Poly Tergent ® SLF 18 B-45 from Olin was used, which, in 80% strength by weight solution in distilled water, has a viscosity (Brookfield, spindle 31, 30 rpm, 20° C.) of 494 mPas.

Performance Assessment:

a) Film Test

To assess the performance of formulations I1 (use of the composition according to the invention) and C1, a film test is carried out in a 65° C. universal wash program in a Miele dishwasher converted to operate continuously. For this, the program was carried out without standard commercial rinse aid (storage compartment of the dishwasher empty) and with water hardened to 21° German hardness (bypassing the ion exchanger).

Test Conditions

Dishwasher: Miele Konti

Detergent: 45 g metered into the main wash cycle

Water hardness: 210 German hardness

Program: Universal 65° C.

Cycles: 30

Soiling: 50 g of liquid soiling metered into the main wash cycle

Composition: 30% protein

30% starch

30% fat

10% water/emulsifier

The film test was assessed by visual inspection of the objects in a box whose walls are lined with black velvet, and awarding the grades 0–6. Higher values indicate more film-free surfaces.

By preparing two particulate premixes and subsequently compressing them, two-layer detergent tablets for machine dishwashing of the composition given in Table 2 were produced.

TABLE 2

| Two-phase detergent tablets for machine dishwashing [% by weight] | | |
|---|---|---|
| | in accordance with the invention I2 | Comparative example C2 |
| Upper phase | | |
| Sodium perborate | 10.44% | 10.44% |
| TAED | 2.01% | 2.01% |
| Nonionic surfactant* | 7.23% | 7.23% |
| Hydroxyethane-1,1-diphosphonic acid, Na salt | 0.68% | 0.68% |
| Sodium carbonate | 10.04% | 10.04% |
| Benzotriazole | 0.12% | 0.12% |
| Polymeric cobuilder | 16.06% | 16.06% |
| Phyllosilicate (SKS6 ®) | 1.61% | 1.61% |
| Trisodium citrate | 16.06% | 16.06% |
| Sodium hydrogencarbonate | 6.02% | 6.02% |
| Lower phase | | |
| Trisodium phosphate | 25.42% | 25.42% |
| Enzymes | 2.85% | 2.85% |
| Perfume | 0.08% | 0.08% |
| Nonionic surfactant | 1.37% | 1.37% |

*In the Example I2 in accordance with the invention the nonionic surfactant described above was used; in the comparative example C2 Poly Tergent ® SLF 18 B-45 from Olin was used which, in 80% strength by weight solution in distilled water, has a viscosity (Brookfield, spindle 31, 30 rpm, 20° C.) of 494 mPas.

b) Clear-Rinse Test

To assess the clear-rinse effect, the compositions I2 and C2 were used in a universal wash program. For this, the program was carried but without standard commercial rinse aid (storage compartment of the dishwasher empty) and with water hardened to 21° German hardness (bypassing the ion exchanger).

Test Conditions

Dishwasher: Miele G575

Detergent: 24.9 g metered into the main wash cycle

Water hardness: 21° German hardness

Program: Universal 55° C.

Cycles: 3

Soiling: 50 g of minced meat soiling

The clear-rinse effect is assessed by visual inspection in a box whose walls are lined with black velvet, and the grades 0–4 are awarded separately for spotting and filming. The assessment is made in accordance with the following scheme:

| | |
|---|---|
| Spotting: | 4 = no spots<br>3 = 1–4 spots<br>2 = more than 4 spots, up to 25% of the |

-continued

| | |
|---|---|
| | surface coated with spots<br>1 = 25–50% of the surface covered with spots<br>0 = more than 50% of the surface covered with spots |
| Filming: | 4 = no film to 0 = very considerable film |

| | Spotting | Filming | Spotting | Filming | Spotting | Filming |
|---|---|---|---|---|---|---|
| | Glass | | Stainless steel | | Porcelain | |
| I2 | 3.7 | 2.3 | 3.8 | 2.8 | 3.8 | 4 |
| C2 | 3.2 | 1.0 | 3.2 | 1.3 | 3.8 | 3.7 |
| | Melamine | | PE | | SAN | |
| I2 | 3 | 3 | 2.2 | 3.0 | 2.0 | 2.3 |
| C2 | 3 | 2.3 | 2.2 | 1.7 | 2.0 | 1.0 |

The table shows that the formulation I2 is at times significantly superior to formulation C2 with regard to filming, and is at least equivalent with regard to spotting.

What is claimed is:

1. A machine dishwashing detergent comprising one or more builders and 0.1 to 50% by weight of one or more nonionic surtactants that, in 80% strength by weight solution in distilled water, have a viscosity of less than 450 mPas, said nonionic surfactants comprising one or more surfactants of the general formula I:

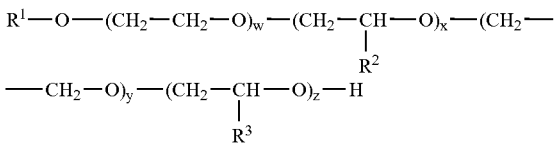

(I)

in which $R^1$ is a straight-chain or branched, saturated or mono- or polyunsaturated $C_{6-24}$-alkyl or -alkenyl radical; each group $R^2$ and $R^3$, independently of one another, is chosen from $—CH_3$, $—CH_2CH_3$, $—CH_2CH_2—CH_3$, $CH(CH_3)_2$ and the indices w, x, y, z, independently of one another, are integers from 1 to 6.

2. The machine dishwashing detergent of claim 1, wherein the nonionic surfactant(s) have a viscosity of less than 400 mPas.

3. The machine dishwashing detergent of claim 2, wherein the nonionic surfactant(s) have a viscosity of less than 300 mPas.

4. The machine dishwashing detergent of claim 3, wherein the nonionic surfactant(s) have a viscosity of less than 250 mPas.

5. The machine dishwashing detergent of claim 4, wherein the nonionic surfactant(s) have a viscosity of less than 200 mPas.

6. The machine dishwashing detergent of claim 1, wherein the nonionic surfactant(s), in 90% strength by weight solution in distilled water, have a viscosity of less than 250 mPas.

7. The machine dishwashing detergent of claim 6, wherein the nonionic surfactant(s), in 90% strength by weight solution in distilled water, have a viscosity of less than 200 mPas.

8. The machine dishwashing detergent of claim 7, wherein the nonionic surfactant(s), in 90% strength by weight solution in distilled water, have a viscosity of less than 150 mPas.

9. The machine dishwashing detergent of claim 8, wherein the nonionic surfactant(s), in 90% strength by weight solution in distilled water, have a viscosity of less than 100 mPas.

10. The machine dishwashing detergent of claim 1, wherein the nonionic surfactant(s) are present in amounts of from 0.5 to 40% by weight.

11. The machine dishwashing detergent of claim 10, wherein the nonionic surfactant(s) are present in amounts of from 1 to 30% by weight.

12. The machine dishwashing detergent of claim 11, wherein the nonionic surfactant(s) are present in amounts of from 2.5 to 25% by weight.

13. The machine dishwashing detergent of claim 1, wherein the nonionic surfactant(s) are present in amounts of from 5 to 20% by weight.

14. The machine dishwashing detergent of claim 1, wherein $R^1$ is an alkyl radical having 6 to 24 carbon atoms.

15. The machine dishwashing detergent of claim 14, wherein $R^1$ is an alkyl radical having 8 to 20 carbon atoms.

16. The machine dishwashing detergent of claim 15, wherein $R^1$ is an alkyl radical having 9 to 15 carbon atoms.

17. The machine dishwashing detergent of claim 1, wherein $R^2$ and $R^3$ are a radical $—CH_3$, w and x, independently of one another, are values of 3 or 4 and y and z, independently of one another, are values of 1 or 2.

18. The machine dishwashing detergent of claim 14, wherein $R^2$ and $R^3$ are a radical $—CH_3$, w and x, independently of one another, are values of 3 or 4 and y and z, independently of one another, are values of 1 or 2.

19. The machine dishwashing detergent of claim 1, comprising the builder(s) in amounts of from 5 to 90% by weight.

20. The machine dishwashing detergent of claim 1, comprising the builder(s) in amounts of from 7.5 to 85% by weight.

21. The machine dishwashing detergent of claim 1, comprising the builder(s) in amounts of from 10 to 80% by weight.

22. The machine dishwashing detergent of claim 1, comprising one or more enzymes in amounts of from 0.01 to 15% by weight.

23. The machine dishwashing detergent of claim 22, comprising one or more enzymes in amounts of from 0.1 to 10% by weight.

24. The machine dishwashing detergent of claim 23, comprising one or more enzymes in amounts of from 0.5 to 6% by weight.

25. The machine dishwashing detergent of claim 1, comprising one or more bleaches in amounts of from 1 to 40% by weight.

26. The machine dishwashing detergent of claim 25, comprising one or more bleaches in amounts of from 2.5 to 30% by weight.

27. The machine dishwashing detergent of claim 26, comprising one or more bleaches in amounts of from 5 to 20% by weight.

* * * * *